US010548417B2

(12) United States Patent
Buck et al.

(10) Patent No.: US 10,548,417 B2
(45) Date of Patent: Feb. 4, 2020

(54) ADAPTIVE MERCHANDISING PLATFORM (AMP) MOUNTING SYSTEM AND METHOD OF INSTALLING THEREOF

(71) Applicant: Altria Client Services LLC, Richmond, VA (US)

(72) Inventors: James Buck, Richmond, VA (US); Mike Detenber, Grand Haven, MI (US); Dathan Zang, Richmond, VA (US); Adam P. Kiteley, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 16/411,835

(22) Filed: May 14, 2019

(65) Prior Publication Data

US 2019/0261787 A1 Aug. 29, 2019

Related U.S. Application Data

(62) Division of application No. 15/367,919, filed on Dec. 2, 2016, now Pat. No. 10,334,970.

(51) Int. Cl.
*A47F 5/10* (2006.01)
*A47B 57/40* (2006.01)
(Continued)

(52) U.S. Cl.
CPC ..... *A47F 5/103* (2013.01); *A47B 57/406* (2013.01); *A47B 96/1441* (2013.01);
(Continued)

(58) Field of Classification Search
CPC ..... A47F 5/103; A47F 5/0025; A47B 57/406; A47B 96/1441
See application file for complete search history.

(56) References Cited

U.S. PATENT DOCUMENTS 2,739,777 A 3/1956 Schoenhardt
3,004,673 A 10/1961 Emery
(Continued)

FOREIGN PATENT DOCUMENTS

DE 202016102834 U1 6/2016
EP 2090197 A1 8/2009
(Continued)

OTHER PUBLICATIONS

U.S. Office Action dated Sep. 13, 2018 in related U.S. Appl. No. 15/367,852.
(Continued)

*Primary Examiner* — Stanton L Krycinski
(74) *Attorney, Agent, or Firm* — Harness, Dickey & Pierce, P.L.C.

(57) ABSTRACT

The mounting system includes at least one first crossbar with a first end cavity and a second end cavity, a first support bracket insertable into the first end cavity of the first crossbar, the first support bracket including a first engaging structure, a second support bracket insertable into the second end cavity of the first crossbar, the second support bracket including a second engaging structure. The first and second engaging structures are configured to attach to respective first and second columns of a consumer product display. The first support bracket and the second support bracket each are configured to remain freely and selectively slideable within the first end cavity and the second end cavity following assembly of the mounting system. The mounting system further includes more than one vertical upright connectable to the at least one first crossbar, where the more than one vertical upright includes a third engaging structure.

14 Claims, 42 Drawing Sheets

(51) Int. Cl.
*A47B 96/14* (2006.01)
*A47F 5/00* (2006.01)

(52) U.S. Cl.
CPC ..... *A47F 5/0025* (2013.01); *A47F 5/005* (2013.01); *A47F 5/0068* (2013.01); *A47F 5/0093* (2013.01)

(56) References Cited

U.S. PATENT DOCUMENTS

| | | | |
|---|---|---|---|
| 3,273,720 | A | 9/1966 | Seiz |
| 3,285,424 | A | 11/1966 | Emery |
| 3,352,584 | A | 11/1967 | Engel |
| 3,510,010 | A | 5/1970 | Gasner |
| 3,570,798 | A | 3/1971 | Squibb |
| 3,788,717 | A | 1/1974 | Hosmer |
| 3,886,698 | A | 6/1975 | Raith et al. |
| 3,908,830 | A | 9/1975 | Skrzelowski |
| 4,349,113 | A | 9/1982 | Schreiner |
| 4,369,887 | A | 1/1983 | Emery |
| 4,401,222 | A | 8/1983 | Kulikowski et al. |
| 4,800,821 | A | 1/1989 | Nook et al. |
| 4,828,120 | A | 5/1989 | Bell et al. |
| 5,035,626 | A | 7/1991 | Persing |
| 5,048,698 | A | 9/1991 | Konrad |
| 5,074,422 | A | 12/1991 | Holtz |
| 5,088,607 | A | 2/1992 | Risafi et al. |
| 5,101,989 | A | 4/1992 | Jones |
| 5,292,015 | A | 3/1994 | Bumbera |
| 5,427,255 | A | 6/1995 | Nook |
| 5,454,638 | A | 10/1995 | Bird et al. |
| 5,472,103 | A | 12/1995 | Merl |
| 5,509,541 | A | 4/1996 | Merl |
| 5,538,213 | A | 7/1996 | Brown |
| 5,641,081 | A | 6/1997 | Merl |
| 5,769,247 | A | 6/1998 | Merl |
| 5,921,411 | A | 7/1999 | Merl |
| 5,957,422 | A | 9/1999 | Shea |
| 6,053,460 | A | 4/2000 | Wilkinson, Jr. et al. |
| 6,070,747 | A | 6/2000 | Shea |
| 6,070,841 | A | 6/2000 | Robinson |
| 6,168,032 | B1 | 1/2001 | Merl |
| 6,199,706 | B1 | 3/2001 | Shea |
| 6,202,866 | B1 | 3/2001 | Shea |
| 6,220,464 | B1 | 4/2001 | Battaglia et al. |
| 6,223,916 | B1 | 5/2001 | Enos |
| 6,227,385 | B1 | 5/2001 | Nickerson |
| 6,234,328 | B1 | 5/2001 | Mason |
| 6,357,609 | B1 | 3/2002 | Van Noord et al. |
| 6,378,828 | B1 | 4/2002 | Valiulis et al. |
| 6,409,028 | B2 | 6/2002 | Nickerson |
| 6,497,395 | B1 | 12/2002 | Croker |
| 6,505,800 | B1 | 1/2003 | Abdullah |
| 6,659,295 | B1 | 12/2003 | De Land et al. |
| 6,672,226 | B2 | 1/2004 | Bohnacker |
| 6,722,619 | B2 | 4/2004 | Valiulis et al. |
| 7,028,852 | B2 | 4/2006 | Johnson et al. |
| 7,175,034 | B2 | 2/2007 | Nook et al. |
| 7,188,740 | B2 | 3/2007 | Marchetta et al. |
| 7,201,281 | B1 | 4/2007 | Welker |
| 7,296,697 | B2 | 11/2007 | Costa et al. |
| 7,314,144 | B2 | 1/2008 | Stitchick et al. |
| 7,419,062 | B2 | 9/2008 | Mason |
| 7,478,731 | B1 | 1/2009 | Mason |
| 7,497,344 | B2 | 3/2009 | Chen |
| 7,654,497 | B1 | 2/2010 | Karan |
| 7,681,744 | B2 | 3/2010 | Johnson |
| 7,775,379 | B2 | 8/2010 | Hodge |
| 7,950,538 | B2 | 5/2011 | Zang et al. |
| 7,992,726 | B2 | 8/2011 | Goehring |
| 8,061,539 | B2 | 11/2011 | Punzel et al. |
| 8,087,522 | B2 | 1/2012 | Stafford et al. |
| 8,113,360 | B2 | 2/2012 | Olson |
| 8,210,367 | B2 | 7/2012 | Nagel et al. |
| 8,276,766 | B2 | 10/2012 | Rataiczak, III et al. |
| 8,317,038 | B2 | 11/2012 | Luberto et al. |
| 8,413,825 | B2 | 4/2013 | Spizman et al. |
| 8,720,702 | B2 | 5/2014 | Nagel |
| 8,746,468 | B2 | 6/2014 | Poulokefalos |
| 8,770,529 | B2 | 7/2014 | Berglund et al. |
| 8,893,901 | B2 | 11/2014 | Nagel |
| 8,955,271 | B2 | 2/2015 | Keller et al. |
| 8,967,393 | B2 | 3/2015 | Bryson et al. |
| 8,985,352 | B2 | 3/2015 | Bergdoll et al. |
| 8,998,009 | B2 | 4/2015 | Kim et al. |
| 9,016,214 | B2 | 4/2015 | Zang et al. |
| 9,016,484 | B2 | 4/2015 | Kologe |
| 9,101,230 | B2 | 8/2015 | Sosso et al. |
| 9,131,771 | B2 | 9/2015 | Lindblom |
| 9,138,076 | B2 | 9/2015 | Hardy |
| 9,179,788 | B2 | 11/2015 | Hardy |
| 9,254,049 | B2 | 2/2016 | Nagel |
| 9,339,108 | B2 | 5/2016 | Zang et al. |
| 9,351,567 | B2 | 5/2016 | Go |
| 9,468,312 | B2 | 10/2016 | Denby |
| 9,486,090 | B2 | 11/2016 | Juric |
| 9,518,419 | B2 | 12/2016 | Johnson et al. |
| 9,526,357 | B2 | 12/2016 | Howard et al. |
| 9,629,479 | B2 | 4/2017 | Sosso et al. |
| 9,782,018 | B2 | 10/2017 | Hester-Redmond |
| 10,098,479 | B1 | 10/2018 | Muellerleile |
| 2001/0009639 | A1 | 7/2001 | Gunn |
| 2002/0108916 | A1 | 8/2002 | Nickerson |
| 2002/0190011 | A1 | 12/2002 | Caporale |
| 2004/0159755 | A1 | 8/2004 | Valiulis et al. |
| 2005/0167383 | A1 | 8/2005 | Taccolini et al. |
| 2006/0186066 | A1 | 8/2006 | Johnson et al. |
| 2008/0257842 | A1 | 10/2008 | Mason |
| 2008/0296245 | A1 | 12/2008 | Punzel et al. |
| 2009/0184072 | A1 | 7/2009 | Fischer et al. |
| 2012/0119043 | A1 | 5/2012 | Rataiczak, III |
| 2012/0193311 | A1 | 8/2012 | Benasillo |
| 2012/0204458 | A1 | 8/2012 | Goehring |
| 2015/0173528 | A1 | 6/2015 | Hester-Redmond |
| 2016/0022035 | A1 | 1/2016 | Hardy |
| 2016/0374466 | A1 | 12/2016 | Miller, Jr. et al. |
| 2017/0099961 | A1 | 4/2017 | Church et al. |
| 2017/0119174 | A1 | 5/2017 | Hardy |
| 2017/0172315 | A1 | 6/2017 | Hay |

FOREIGN PATENT DOCUMENTS

| | | | |
|---|---|---|---|
| FR | 2590143 | A1 | 5/1987 |
| WO | WO-2007073747 | A1 | 7/2007 |
| WO | WO-2011050406 | A1 | 5/2011 |

OTHER PUBLICATIONS

U.S. Notice of Allowance dated Jan. 30, 2019 in related U.S. Appl. No. 15/367,852.

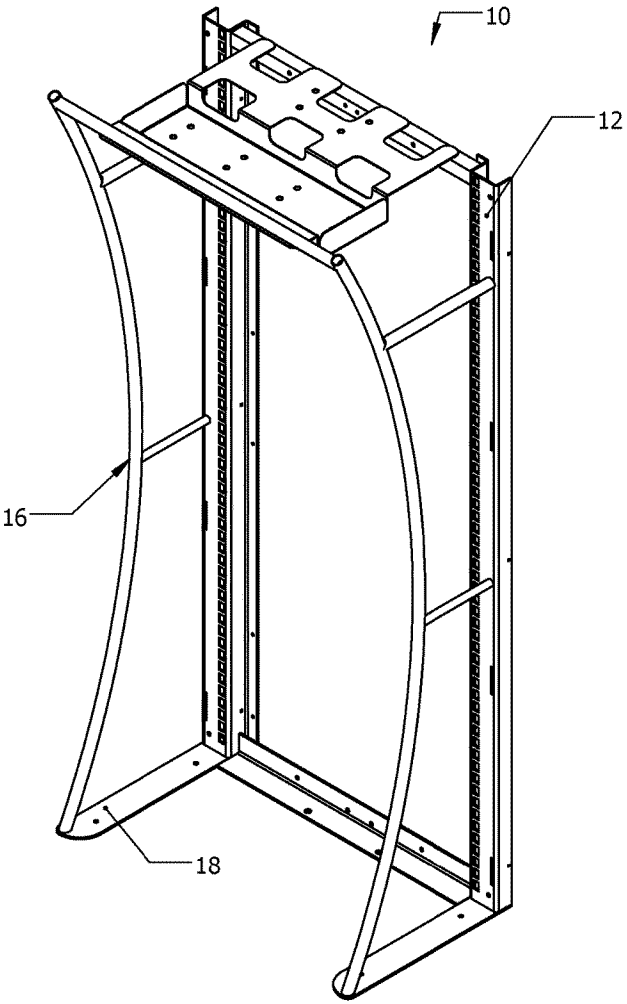
FIG. 1
(CONVENTIONAL)

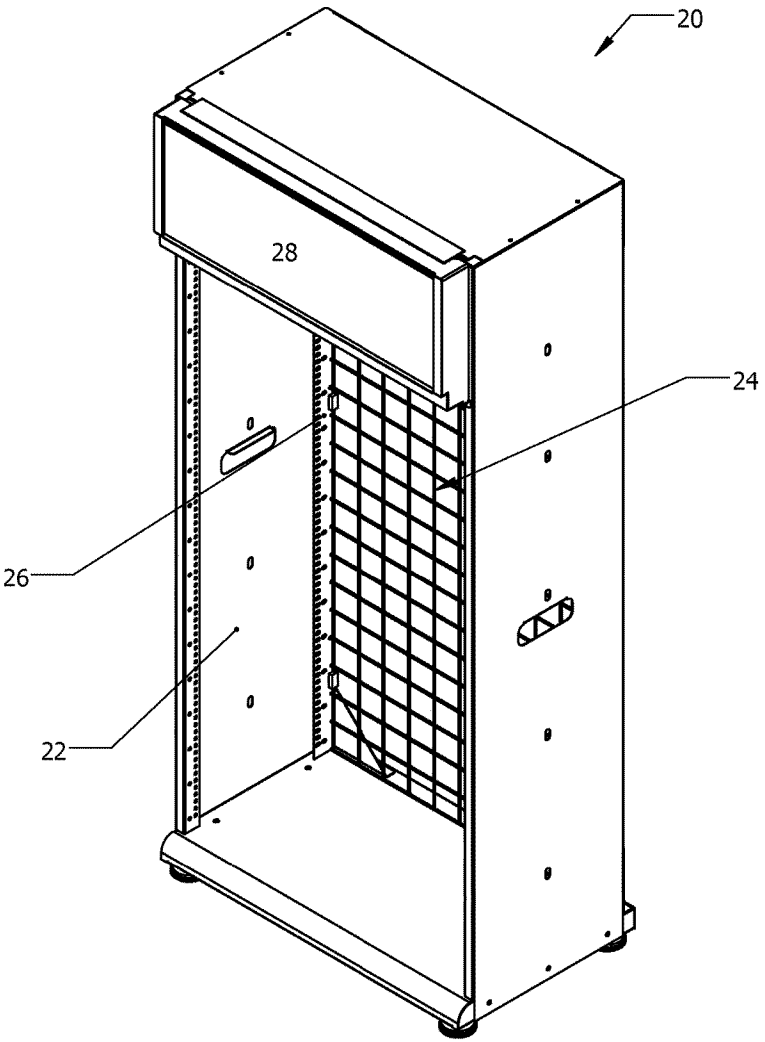
FIG. 2
(CONVENTIONAL)

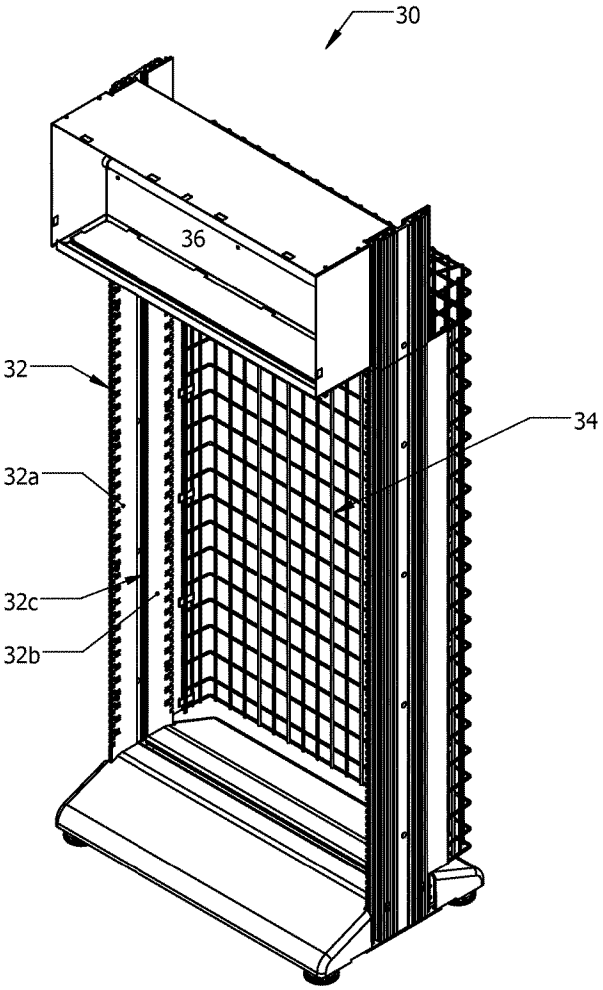
FIG. 3
(CONVENTIONAL)

SECTION A-A

SECTION A-A

| | | Dimension "A" | Dimension "B" | Dimension "C" | Dimension "D" |
|---|---|---|---|---|---|
| Fixture 1 (Bracket 200c) | 2' | 21.688 | 0.668 | 0.250 | 0.250 |
| | 3' | 32.625 | | | |
| | 4' | * | | | |
| Fixture 2 (Bracket 200b) | 2' | 23.625 | 0.750 | 0.250 | 0.375 |
| | 3' | * | | | |
| | 4' | * | | | |
| Fixture 3 (Bracket 200b) | 2' | 23.625 | 0.750 | 0.250 | 0.375 |
| | 3' | 35.625 | | | |
| | 4' | 47.625 | | | |
| Fixture 4 (Bracket 200a) | 2' | 23.833 | 0.870 | 0.380 | 0.167 |
| | 3' | 35.833 | | | |
| | 4' | 48.833 | | | |
| Fixture 5 (Bracket 200) | 2' | 21.195 | 0.620 | 0.255 | 0.430 |
| | 3' | 35.570 | | | |
| | 4' | 44.300 | | | |
| Fixture 6 (Bracket 200f) | 2' | * | 0.470 | 0.250 | 0.210 |
| | 3' | 34.438 | | | |
| | 4' | 46.750 | | | |
| Fixture 7 (Bracket 200b) | 2' | 21.500 | 0.750 | 0.250 | 0.375 |
| | 3' | 32.875 | | | |
| | 4' | 44.375 | | | |
| Fixture 8 (Bracket 200) | 2' | 21.262 | 0.620 | 0.255 | 0.430 |
| | 3' | 32.627 | | | |
| | 4' | 44.314 | | | |
| Fixture 9 (Bracket 200b) | 2' | * | 0.750 | 0.250 | 0.375 |
| | 3' | 32.777 | | | |
| | 4' | 44.402 | | | |
| DIMENSIONS IN INCHES | | | | | |

ADAPTIVE MERCHANDISING PLATFORM (AMP) MOUNTING SYSTEM AND METHOD OF INSTALLING THEREOF

PRIORITY STATEMENT

This application is a divisional of U.S. application Ser. No. 15/367,919, filed on Dec. 2, 2016, the entire contents of which is incorporated by reference in its entirety.

BACKGROUND OF THE INVENTION

Field of the Invention

Example embodiments relate generally to a merchandising platform for displaying and vending consumer products, such as adult tobacco products. Example embodiments also include a method of using the merchandising platform.

Related Art

Consumer product fixtures, such as merchandizing fixtures for e-vaping products, often are designed to only display standard-sized shelves in fixed and regimented locations on a front of the fixture. The fixed and limited shelving locations for the standard-sized shelves subsequently limits an ability to display and vend consumer products that may be a different width, depth and/or vertical height, as compared to standard-sized consumer products. That is to say, the fixtures often lack flexibility in conveniently accommodating variable-sized shelves and non-standard-sized consumer products.

Expensive and/or time-consuming retrofitting of product fixtures is generally required to install non-standard-sized shelves capable of displaying non-standard-sized products. Furthermore, the lack of flexibility of product fixtures often subsequently creates wasted display-space, which may reduce an overall amount of displayed products, and may reduce aggregate consumer product sales numbers. Furthermore, a sheer number of different standard consumer-product fixture types (which totals approximately 13 different fixture types that are offered within most U.S. stores) creates additional challenges, as each standard fixture type presents unique challenges that add to a complexity in providing a means to quickly vertically and horizontally adjust shelving locations, and utilize variable shelving sizes, in order to display non-standard-sized products while maximizing a number of displayed items able to be maintained within a limited vending space.

FIG. 1 illustrates a conventional consumer product display 10, with a conventional fixture (backbone), for displaying and vending consumer products. The display 10 may include columns 12 (i.e., a conventional "backbone") capable of supporting shelving. The display 10 may also include a front support 16 connected to a base 18 that allows the display to be free-standing.

FIG. 2 illustrates another conventional consumer product display 20, with a conventional fixture (backbone), for displaying and vending consumer products. The display 20 may include a display panel (header) 28 for product information and advertising. The display may also include a rear grid 24 and columns 22 (i.e., a conventional "backbone") capable of supporting shelving.

FIG. 3 illustrates another conventional consumer product display 30, with a conventional fixture (backbone), for displaying and vending consumer products. The display 30 may include a display panel (header) 36 for product information and advertising. The display may also include a rear grid 34 and columns 32 (i.e., a conventional "backbone") capable of supporting shelving. The columns 32 may include major inner surfaces 32*a/b*.

SUMMARY OF THE INVENTION

At least one example embodiment relates to a mounting system.

In an embodiment, the mounting system includes at least one first crossbar with a first end cavity and a second end cavity; a first support bracket insertable into the first end cavity of the first crossbar, the first support bracket including a first engaging structure; a second support bracket insertable into the second end cavity of the first crossbar, the second support bracket including a second engaging structure, the first and second engaging structures configured to attach to respective first and second columns of a consumer product display; and more than one vertical upright connectable to the at least one first crossbar, the more than one vertical upright including a third engaging structure.

In an embodiment, the mounting system further includes at least one second crossbar, the at least one second crossbar connectable to the more than one vertical upright using a fourth engaging structure, wherein each of the more than one vertical uprights includes a first end and a second end that is respectively connectable to the at least one first crossbar and the at least one second crossbar.

In an embodiment, each of the support brackets includes, a major body with a first surface and a second surface, a horizontal shaft extending from the first surface of the major body, the horizontal shaft being insertable into the respective first and second end cavities of the first crossbar, the respective first and second engaging structures extending from the major body.

In an embodiment, the major body of each of the support brackets has a triangular shape, the first and second engaging structures extending from the second surface of the major body, the first and second surfaces of the major body being opposing surfaces, the first and second engaging structures respectively including a first plurality of teeth and a second plurality of teeth, the first plurality of teeth having an identical configuration as compared to the second plurality of teeth.

In an embodiment, each of the first and second plurality of teeth include, a series of top teeth, each of the top teeth having a vertical projection on a distal end of a horizontal projection.

In an embodiment, a distance between points-of-contact of the first and second engaging structures is about equal, the distance being one of about 0.72 inches, 0.86 inches, 0.92 inches, 1.0 inches and 1.25 inches, the points-of-contact of the first and second engaging structures being lower surfaces of the first and second engaging structures that would directly contact bottom surfaces of front slots of the respective first and second columns of the consumer product display once the mounting system is connected to the consumer product display.

In an embodiment, an upper corner of each of the top teeth is rounded, and an outer distal corner of each of the vertical projections of each of the top teeth is beveled.

In an embodiment, each of the first and second plurality of teeth further include, a bottom-most tooth that is a horizontal protrusion, the bottom-most tooth being positioned below the top teeth, a distal end of the horizontal protrusion of the bottom-most tooth being rounded.

In an embodiment, the major body of each of the support brackets is triangular in shape, the first and second engaging structures extending from the first surface of the major body of each of the support brackets.

In an embodiment, the first and second engaging structures of each of the support brackets includes a vertical plate, the vertical plate including one or more bolt holes, the vertical plate being about perpendicular to a longitudinal length of the horizontal shaft of the major body.

In an embodiment, the vertical plate of each of the support brackets includes two bolt holes, an outer surface of the vertical plate includes a mounting stub extending from a lower portion of the outer surface, the mounting stub facing away from the major body.

In an embodiment, the vertical plate of each of the support brackets includes, a first proximal plate connected to the major body, a second intermediate plate connected to the first proximal plate and including two bolt holes, the second intermediate plate including a tapered distal end, a third distal plate connected to the tapered distal end of the second intermediate plate, the third distal plate including an upwardly projecting vertical extension, the first proximal plate, the second intermediate plate and the third distal plate being about parallel to each other, a first bend between the first proximal plate and the second intermediate plate, and a second bend between the second intermediate plate and the third distal plate, the first bend and the second bend each being inwardly-turning bends that respectively offset major surfaces of the second intermediate plate and the third distal plate relative to a major surface of the first proximal plate.

In an embodiment, each of the more than one vertical upright includes, at least one first upright segment, at least one second upright segment, at least one coupling configured to connect the at least one first upright segment to the at least one second upright segment, the coupling defining an inner cavity capable of accepting ends of the upright segments, the coupling having a first wall and a second wall that are outwardly-flared away from a backwall of the coupling, the first wall and the second wall having distal ends that each form a J-shaped surface for retaining ends of the upright segments.

In an embodiment, the mounting system further includes one or more connector-plates for each of the more than one vertical upright, each of the connector-plates being used to connect a lower end of the vertical upright to the at least one second crossbar, each of the connector-plates further including, a side plate connected along a side-edge of the connector-plate, the side plate projecting away from a front surface of the connector-plate and being about perpendicular to the connector-plate, a hinge positioned on a distal end of the side plate, a first J-shaped hook and a second J-shaped hook on either side of the hinge, the J-shaped hooks projecting away from the connector-plate, an interior surface of J-shaped hooks each being configured to insert into one of a series of notches defined by the lower end of the vertical upright, and an angled-tab projecting away, at an angle, from a rear surface of the connector-plate, the angled-tab having a major surface that is mushroom-shaped, the angled-tab being configured to insert into a respective slot running along a portion of a length of the at least one second crossbar.

In an embodiment, the mounting system further includes modularized shelving configured to connect to the more than one vertical uprights, the shelving including, at least one baseplate connectable to the more than one vertical upright, the at least baseplate including, a fifth and a sixth engaging structure on ends of the baseplate and capable of inserting into vertical slots defined by a front surface of the more than one vertical upright, the vertical slots being the third engaging structure, the fifth and sixth engaging structures each including one or more teeth including a top-most teeth, each of the one or more teeth having a surface that is mushroom-shaped, the top-most tooth also including a vertically-extending triangular-shaped extension projecting from the mushroom-shaped surface of the top-most tooth, a gusset-indention defined along at least a portion of a longitudinal length of the baseplate, at least one shelf connectable to the at least one baseplate, the at least one shelf including, one or more protractable blades, each of the protractable blades including a vertical hook connectable to a top portion of the baseplate, the protractable blades configured to extend and retract the vertical hook from a first side of the at least one shelf, a rear bracket extending from a bottom portion of the first side of shelf, the rear bracket having an upper surface conformed to a bottom portion of the baseplate, more than one horizontally adjustable track on an upper surface of the shelf, one or more locking mechanisms on a side surface of the shelf, each locking mechanism capable of connecting the shelf to additional shelves, and at least one tray configured to be supported by the at least one shelf, the at least one tray including a seventh engaging structure on a bottom portion of the tray capable of connecting to the more than one horizontally adjustable track of the at least one shelf.

At least another example embodiment relates to a method of installing a mounting system.

In an embodiment, the method includes connecting a top portion of more than one vertical upright to a first crossbar; connecting a lower portion of the more than one vertical upright to a second crossbar; inserting a first projection of a first support bracket into a first cavity of a first end of the first crossbar, the first support bracket including a first engaging structure; inserting a second projection of a second support bracket into a second cavity of a second end of the first crossbar, the second support bracket including a second engaging structure; attaching the first and second engaging structures to respective first and second columns of a consumer product display; and connecting at least one shelf to the more than one vertical upright using a third engaging structure on the vertical uprights.

In an embodiment, the first and second engaging structures of the respective first and second support brackets are respectively a first series of teeth and a second series of teeth, the attaching of the first and second engaging structures to respective first and second columns of the consumer product display including, inserting the first and second series of teeth into respective first and second slots of the respective first and second columns of the consumer product display, the first and second slots facing a front of the consumer product display.

In an embodiment, first and second engaging structures of the respective first and second support brackets are respectively a first and a second vertical plate, each of the first and second vertical plates including at least one bolt hole and a mounting stub, the attaching of the first and second engaging structures to respective first and second columns of the consumer product display including, inserting the respective mounting stubs into one of a first and second series of mounting holes of the respective first and second columns of the consumer product display, the first and second series of mounting holes of the respective first and second columns facing each other, bolting the first and second vertical plates to the respective first and second columns of the consumer product display using the at least one bolt holes, fashioning a first and second lower bracket to a lower portion of the respective first and second columns of the consumer product display by, contacting side plates of the respective first and second lower brackets to an inner surface of the respective first and second columns, bolting the side plates of the respective first and second lower brackets to the respective first and second columns using respective vertical slots defined by each of the side plates, contacting horizontal blades of the respective first and second lower brackets to a rear surface of the second crossbar, and aligning horizontal slots, defined by the respective horizontal blades, to respective first and second holes in the second crossbar, and bolting the horizontal blades to the second crossbar using horizontal slots and the first and second holes in the second crossbar.

In an embodiment, first and second engaging structures of the respective first and second support brackets are respectively a first and a second vertical plate, each of the first and second vertical plates including, a first proximal plate directly attached to the respective first and second support brackets, a second intermediate plate directly connected to the first proximal plate, the second intermediate plate defining at least a first hole and a tapered end, a third distal plate directly connected to the second intermediate plate, the third distal plate defining at least a second hole and an upwardly projecting vertical extension, the first proximal plate, the second intermediate plate and the third distal plate being about parallel to each other, a first bend between the first proximal plate and the second intermediate plate, and a second bend between the second intermediate plate and the third distal plate, the first bend and the second bend each being inwardly-turning bends that respectively offset major surfaces of the second intermediate plate and the third distal plate relative to a major surface of the first proximal plate, the attaching the first and second engaging structures to respective first and second columns of a consumer product display including, inserting an upright bracket into a groove running along a longitudinal length of the respective first and second vertical uprights of the consumer product display, a proximal end of the upright bracket including a lip capable of stably supporting the upright bracket within the groove, the upright bracket including at least one stop extending from a surface of the upright bracket, contacting an outer surface of the second intermediate plate to an outer surface of the respective first and second vertical uprights of the consumer product display, inserting the at least one stop of the upright bracket into the second hole in the third distal plate in order to stabilize the third distal plate, bolting the second intermediate plate to the outer surface of the respective first and second vertical uprights of the consumer product display using first hole in the second intermediate plate, the method further including, attaching the second crossbar to a lower portion of the consumer product display by performing the following steps on ends of the second crossbar, contacting a side blade of a lower bracket against the outer surface of the respective first and second vertical uprights, insert an inwardly projecting toe of a distal end of the lower blade into the groove of the respective first and second vertical uprights, wrapping a proximal end of the lower bracket around a respective end of the second crossbar so that a horizontal blade of the lower bracket contacts a front surface of the second crossbar, the horizontal blade of the lower bracket being about perpendicular to the side blade of the lower bracket, and bolting the horizontal blade to the second crossbar.

In an embodiment, the method further includes assembling the more than one vertical upright by, coupling at least one upright segment to at least one second upright segment using one or more connectors, the third engaging structure on the vertical uprights being vertical slots; and connecting the lower portion of the more than one vertical upright to the second crossbar by, inserting an angled-tab of a connector plate into a horizontal slot of the second crossbar, twisting the connector plate and then fitting a hinge of the connector plate over a side edge of the lower portion of the more than one vertical upright to the second crossbar so that a first and a second J-shaped hooks, each positioned on sides of the hinge, fit into respective notches defined by the lower end of the vertical upright.

BRIEF DESCRIPTION OF THE DRAWINGS

The above and other features and advantages of example embodiments will become more apparent by describing in detail, example embodiments with reference to the attached drawings. The accompanying drawings are intended to depict example embodiments and should not be interpreted to limit the intended scope of the claims. The accompanying drawings are not to be considered as drawn to scale unless explicitly noted.

FIG. 1 illustrates a conventional consumer product display, with a conventional fixture (backbone), for displaying and vending consumer products;

FIG. 2 illustrates another conventional consumer product display, with a conventional fixture (backbone), for displaying and vending consumer products;

FIG. 3 illustrates another conventional consumer product display, with a conventional fixture (backbone), for displaying and vending consumer products;

FIG. 22 illustrates dimensional information for various conventional fixtures (backbones) of consumer product displays that the mounting system is capable of connecting to;

DETAILED DESCRIPTION

Figure 4:
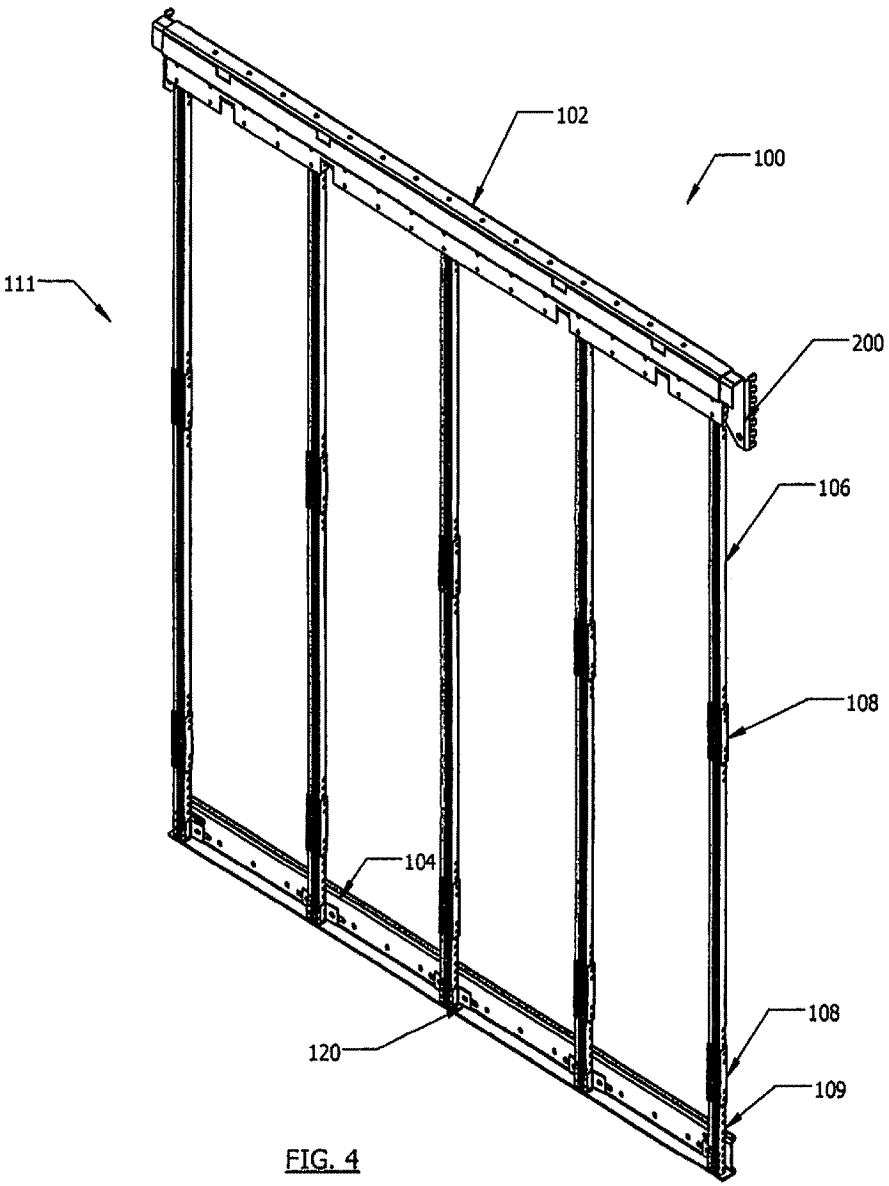
FIG. 4 illustrates a perspective-view of a mounting system used to connect to a consumer product display, in accordance with an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

FIG. 4 illustrates a perspective-view of a mounting system 100 used to connect to a consumer product display (as shown for instance in FIGS. 1-3, described above), in accordance with an example embodiment. The mounting system 100 may include at least one upper crossbar 102, and at least one lower crossbar 104. More or less crossbars may be included in the system 100. The system 100 may also include at least two vertical uprights 111. The vertical uprights 111 may have a flexibility to be longer or shorter, based on a number and a length of vertical upright segments 106 used to form the uprights 111. As an example, the uprights 111 may include one or more full-sized upright segments 106 that may be connected via couplings (connectors) 108. The uprights 111 may also include shorter vertical segments 109. As shown in FIG. 4, the lower portion of the vertical uprights 111 may be connected to the lower crossbar 104 via connector plates 120.

A flexibility of the mounting system 100 includes the ability to substitute different length crossbars 102/104 within the system 100, in order to adjust an overall width of the system 100, depending on a width of the conventional consumer product display 10/20/30. Therefore, widths of the crossbars 102 may be, for instance, about 22.525 inches, 34.00 inches, or 44.775 inches, and widths of the crossbars 104 may be, for instance, about 22.500 inches, 33.130 inches, or 44.640 inches. Due to a further flexibility of the system 100, an overall number of vertical uprights 111 may also be adjusted, depending on the particular needs derived by various configurations of the conventional consumer product displays 10/20/30.

Figure 5:
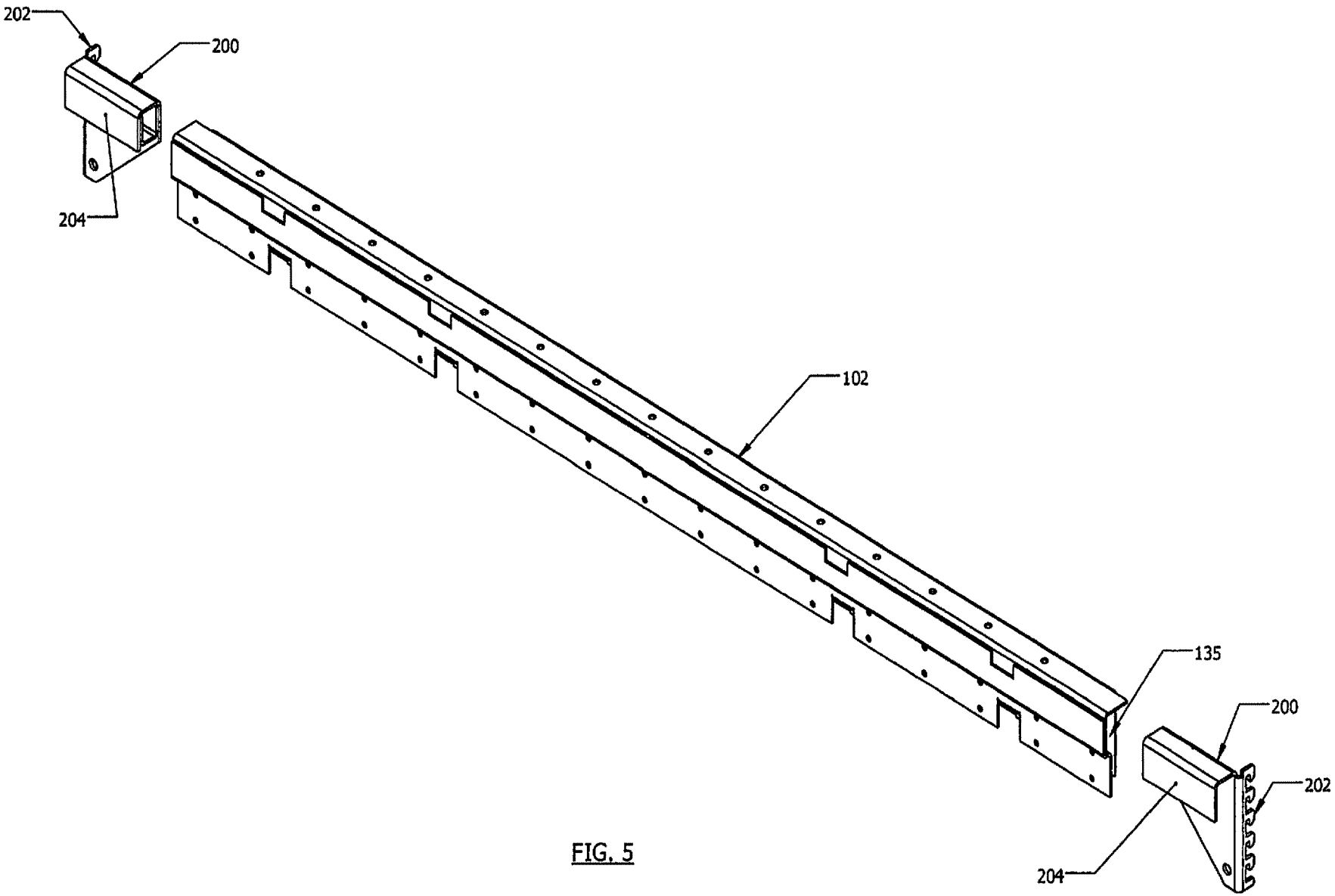
FIG. 5 illustrates a perspective view of an upper crossbar of the mounting system of FIG. 4, in accordance with an example embodiment.

FIG. 5 illustrates a perspective view of an upper crossbar 102 of the mounting system 100 of FIG. 4, in accordance with an example embodiment. The crossbar 102 may include a recess (cavity) 135 on ends of the crossbar 102. A shaft (projection) 204 of an upper support brackets 200 may be capable of being inserted into the cavities 135 on the ends of the crossbar 102. The support brackets may include an engaging structure, such as teeth 202, on a rear side of the brackets 200.

Figure 6:
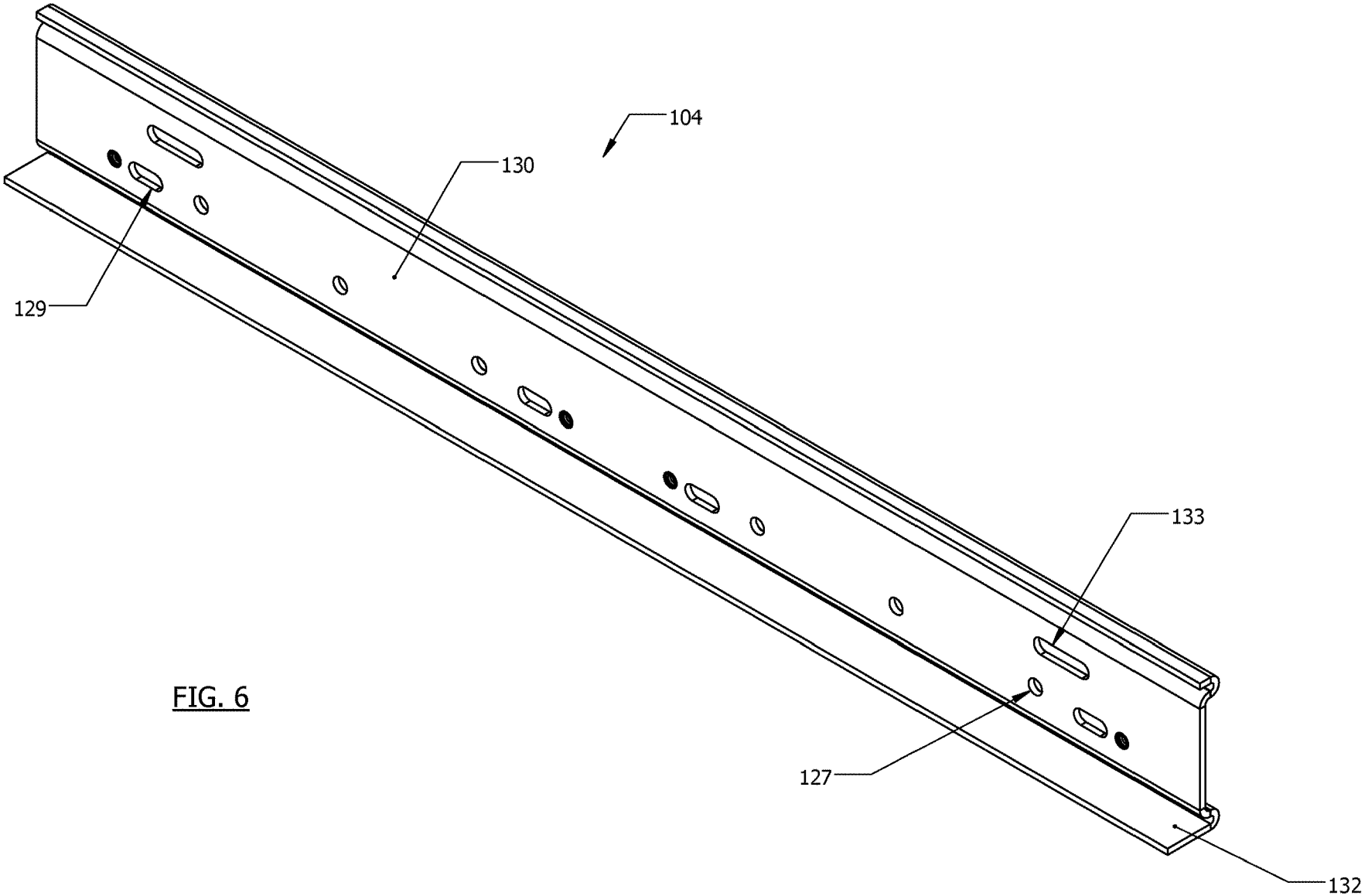
FIG. 6 illustrates a perspective view of a lower crossbar of the mounting system of FIG. 2, in accordance with an example embodiment.

FIG. 6 illustrates a perspective view of a lower crossbar 104 of the mounting system 100 of FIG. 2, in accordance with an example embodiment. The lower crossbar 104 may include a backwall that defines large horizontal slots 133, smaller horizontal slots 129 and/or mounting holes 127. The crossbar 104 may also include a bottom wall 132 connected to the backwall 130.

Figure 7:
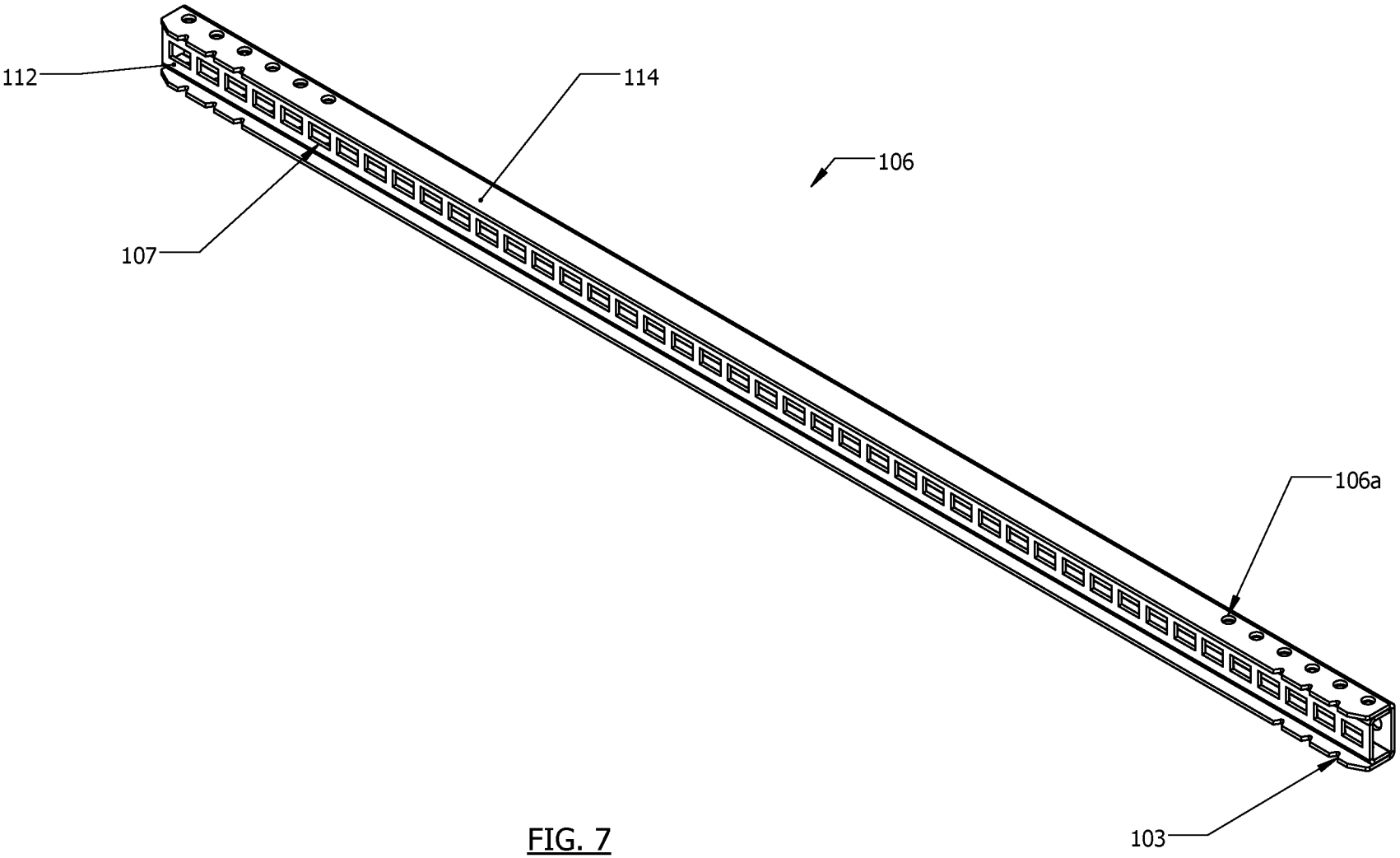
FIG. 7 illustrates a perspective view of a vertical upright segment of the mounting system of FIG. 2, in accordance with an example embodiment.

FIG. 7 illustrates a perspective view of a vertical upright segment 106 of the mounting system 100 of FIG. 2, in accordance with an example embodiment. The segment 106 may include vertical slots 107 on a front surface 112 of the segment 106. The sidewalls of the segment 106 may include bolt holes 106*a*. Ends of the segment may include notches 103, that may for instance be triangular-shaped notches 103.

Figure 8:
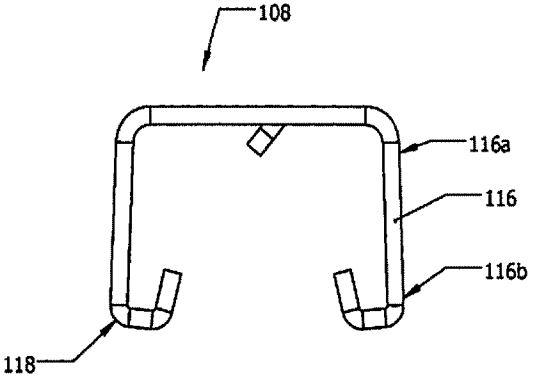
FIG. 8 illustrates a cross-sectional (overhead) view of a coupling of the mounting system of FIG. 2, in accordance with an example embodiment.

FIG. 8 illustrates a cross-sectional (overhead) view of a connector 108 of the mounting system 100 of FIG. 2, in accordance with an example embodiment. The connector 108 may include sidewalls 116, where the sidewalls 116 may be "outwardly flared" (i.e., distal ends 116*b* of the sidewalls 116 are wider apart than the proximal ends 116*a* of the walls 116). The distal ends 116*b* of the sidewalls 116 may include a J-shaped lip 118 for retaining upright segments 106 (see FIG. 10, for instance).

Figure 9:
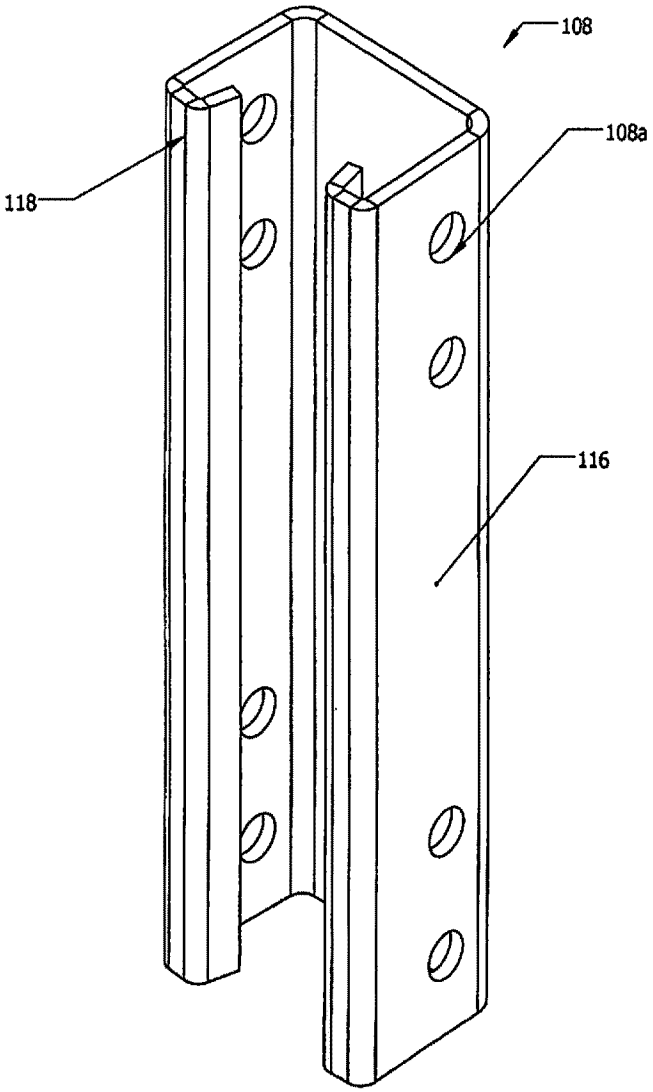
FIG. 9 illustrates a perspective view of the coupling of FIG. 8, in accordance with an example embodiment.

FIG. 9 illustrates a perspective view of the connector 108 of FIG. 8, in accordance with an example embodiment. Bolt holes 108*a* may be included on the sidewalls 116 of the connector 108. The bolt holes 108*a* may align with bolt holes 106*a* on upright segments 106 in order to use the connector 108 to form an overall vertical upright 111 (also see FIG. 10).

Figure 10:
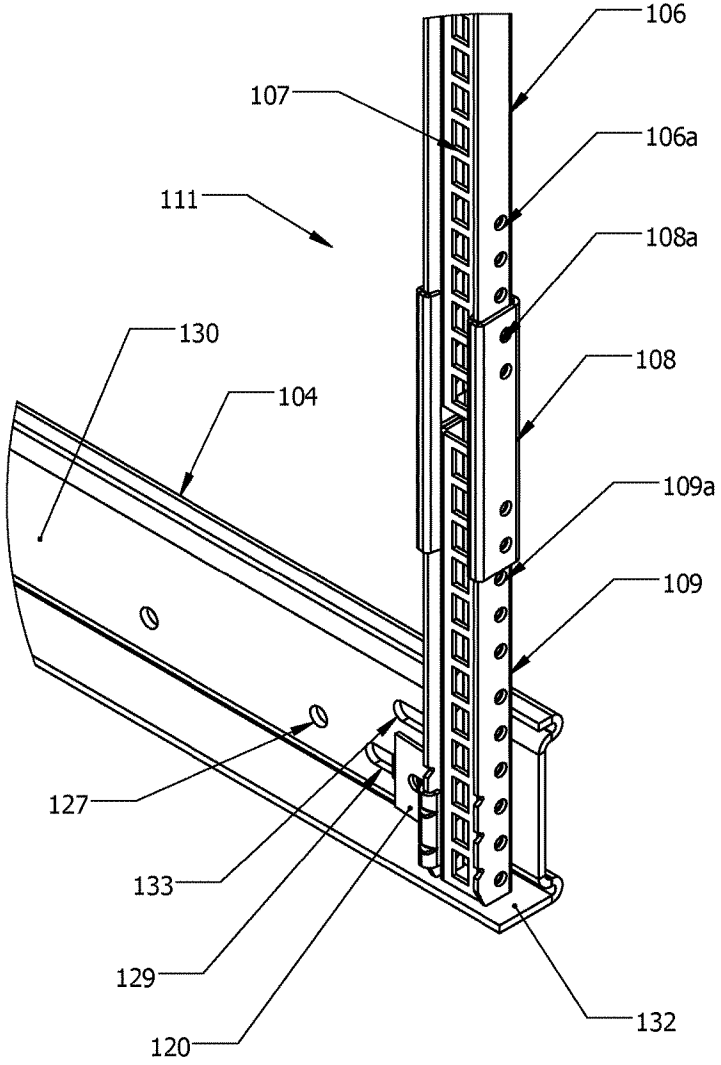
FIG. 10 illustrates a lower portion of a vertical upright connected to a lower crossbar, in accordance with an example embodiment.

FIG. 10 illustrates a lower portion of a vertical upright 111 connected to a lower crossbar 104, in accordance with an example embodiment. A distal end of a segment 109 of the upright 111 may rest and be supported by the bottom wall of the lower crossbar 104. A connector plate 120 may be used to connect the lower portion of upright 111 to the lower crossbar 104 (where the fashioning of the connector plate 120 is shown in better detail in FIGS. 18B and 18C).

Figure 11B:
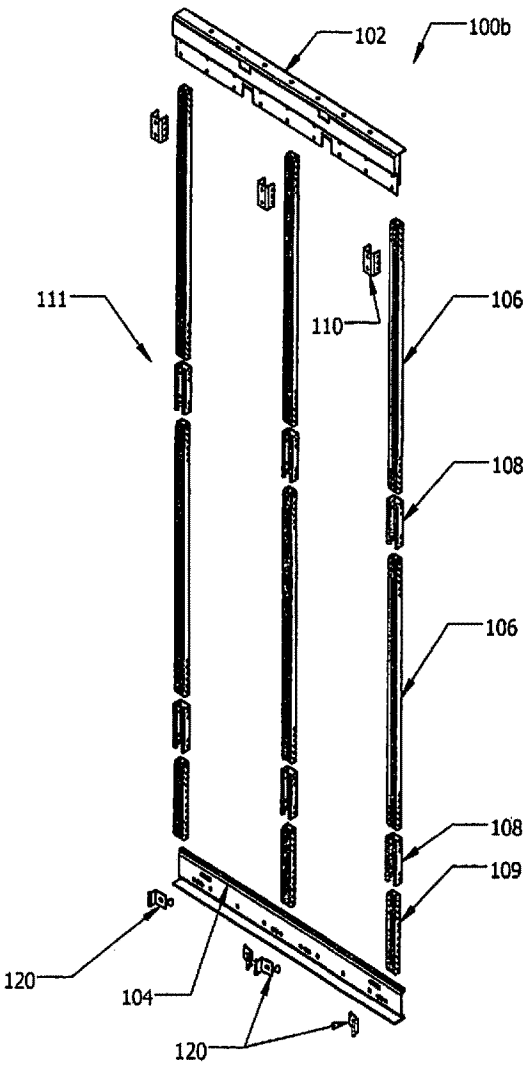
FIG. 11B illustrates another mounting system configuration, in accordance with an example embodiment.
Figure 11A:
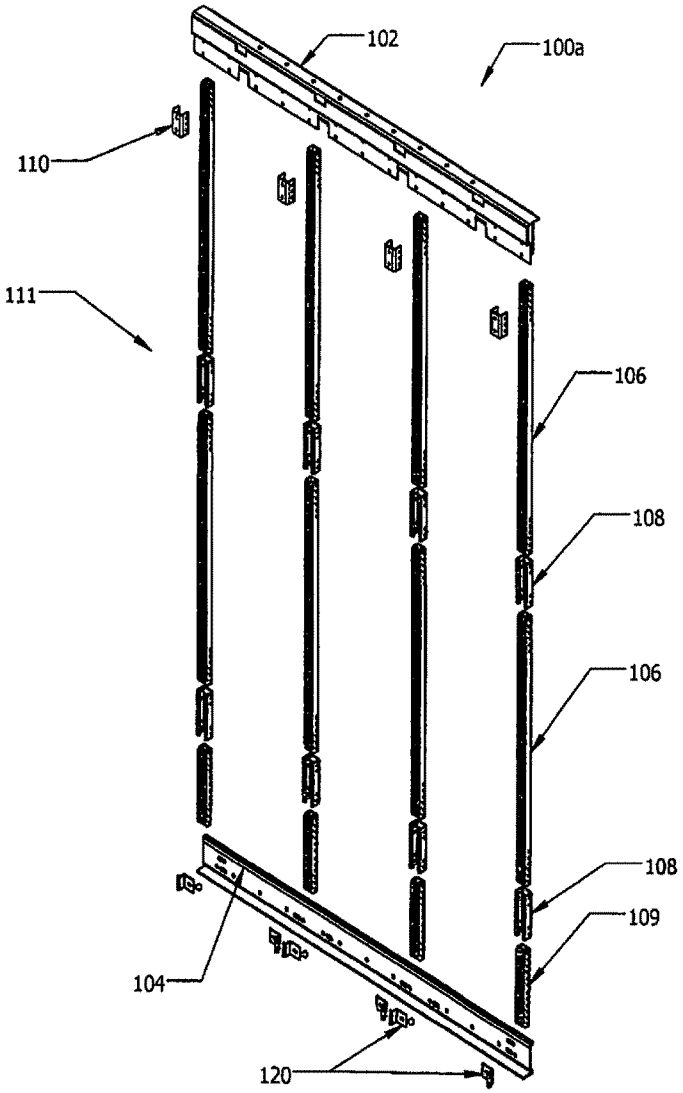
FIG. 11A illustrates another mounting system configuration, in accordance with an example embodiment.

FIG. 11A illustrates another (exploded view of a) mounting system 100*a* configuration, in accordance with an example embodiment. This configuration includes less vertical uprights 111, as compared to the system 100 of FIG. 4. It is noted that additional crossbar 102/104 widths, and more or less vertical uprights 111, may be included in alternative embodiments of the systems 100/100*a* shown in FIGS. 4 and 11A. In this exploded view, small-connectors 110 are also shown, where these small-connectors 110 may be used to connect the vertical uprights 111 to the upper crossbar of the system 100*a* (where a use of the small-connectors 110 is shown in better detail in FIGS. 18E, 18F and 18G).

FIG. 11B illustrates another (exploded view of a) mounting system 100*b* configuration, in accordance with an example embodiment. In this system 100*b*, only three vertical uprights 111 are included, although it should be understood that, due to the flexibility of the systems 100/100*a*/100*b* shown in FIGS. 4 and 11A/B, more or less vertical uprights 111, and various crossbar 102/104 widths, may be implemented and used.

Figure 12B:
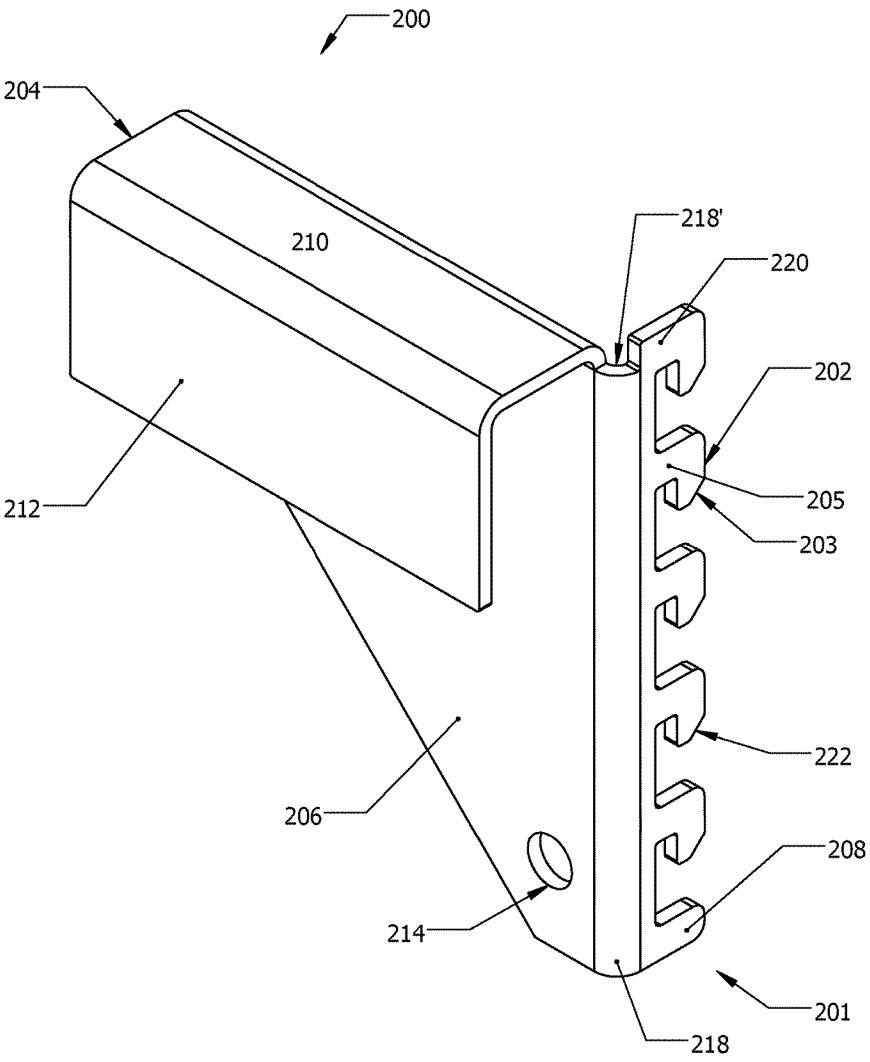
FIG. 12B illustrates another perspective view of the upper support bracket of FIG. 12A, in accordance with an example embodiment.
Figure 12A:
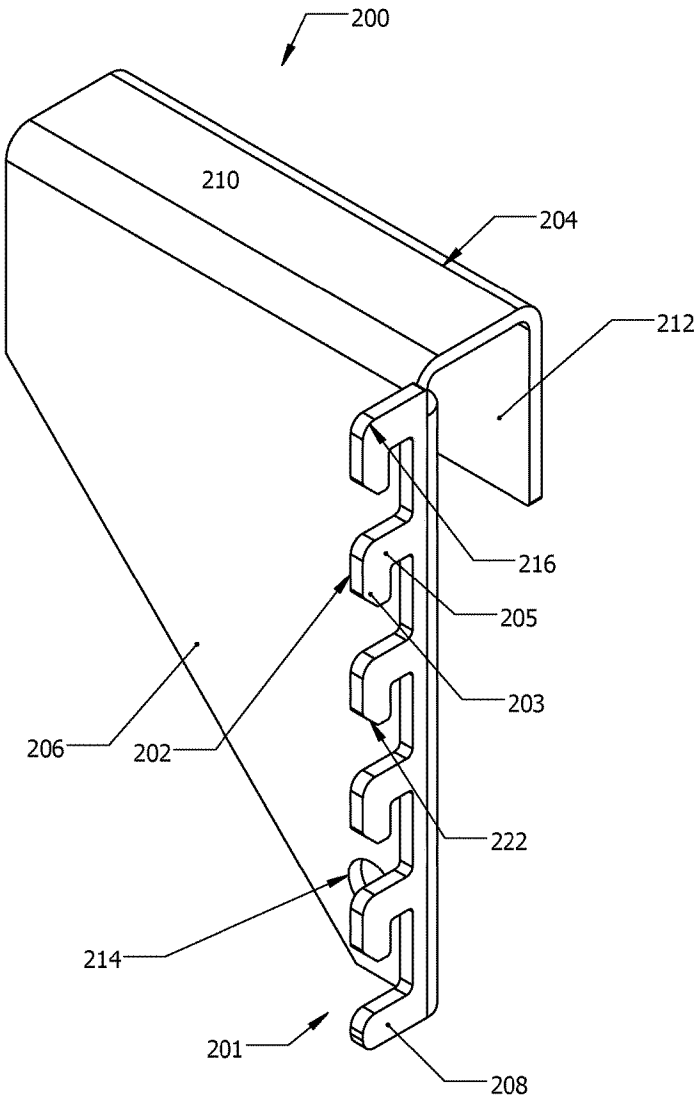
FIG. 12A illustrates a perspective view of an upper support bracket of a mounting system, in accordance with an example embodiment.

FIG. 12A illustrates a perspective view of an upper support bracket 200 of a mounting system 100, in accordance with an example embodiment. The bracket 200 may include a horizontally-oriented shaft 204 that may be formed on a rear surface of the bracket 200. In particular, the horizontal shaft 204 may be formed from an upper surface 210 and a back surface 212 that may be connected to a rear surface of a major body 206 of the bracket 200. The major body 206 may be a somewhat triangular in shape, in order to reduce an amount of required materials for the bracket 200, while also maximizing an overall strength of the bracket 200. The major body 206 may include a paint hang hole 214 for purposes of conveniently manufacturing the bracket 200.

An engaging structure 201 may be positioned on a front surface of the major body 206. For instance, the engaging structure 201 may be a set of teeth 202 projecting from the front surface of the major body 206. In an embodiment, the engaging structure 201 may include a series of six teeth 202/208, where the bottom-most tooth 208 may be a horizontal projection, and the remaining teeth 202 may include horizontal projections 205 with a downward-facing vertical projection 202 on a distal end of the horizontal projection 205. An upper corner 216 of the teeth 202/208 may have a rounded edge. The vertical projection 203 of the five top-most teeth 202 may also have a beveled outer-edge 222.

FIG. 12B illustrates another perspective view of the upper support bracket 200 of FIG. 12A, in accordance with an example embodiment. The bracket 200 may include a rounded edge 218 between the major body 206 and the engaging structure 201. A top-most surface 218' of the rounded edge 218 may have a lower elevation than an upper surface 210 of the horizontal shaft 204 and an upper surface of the top-most tooth 220.

It should be understood that the bracket 200 in FIG. 12B is identical to the bracket 200 in FIG. 12A, other than the fact that these brackets 200 are mirror images of each other (as the brackets 200 are to be inserted on opposite ends of crossbar 102). However, for purposes of this document, the mirror-image brackets 200 of FIG. 12A/B are generally referred to as the same bracket (just as the brackets 200*a*, 200*b*, 200*c*, etc., in each of FIGS. 13A/B, 14A/B, 15A/B also depict mirror-image brackets).

Figure 13B:
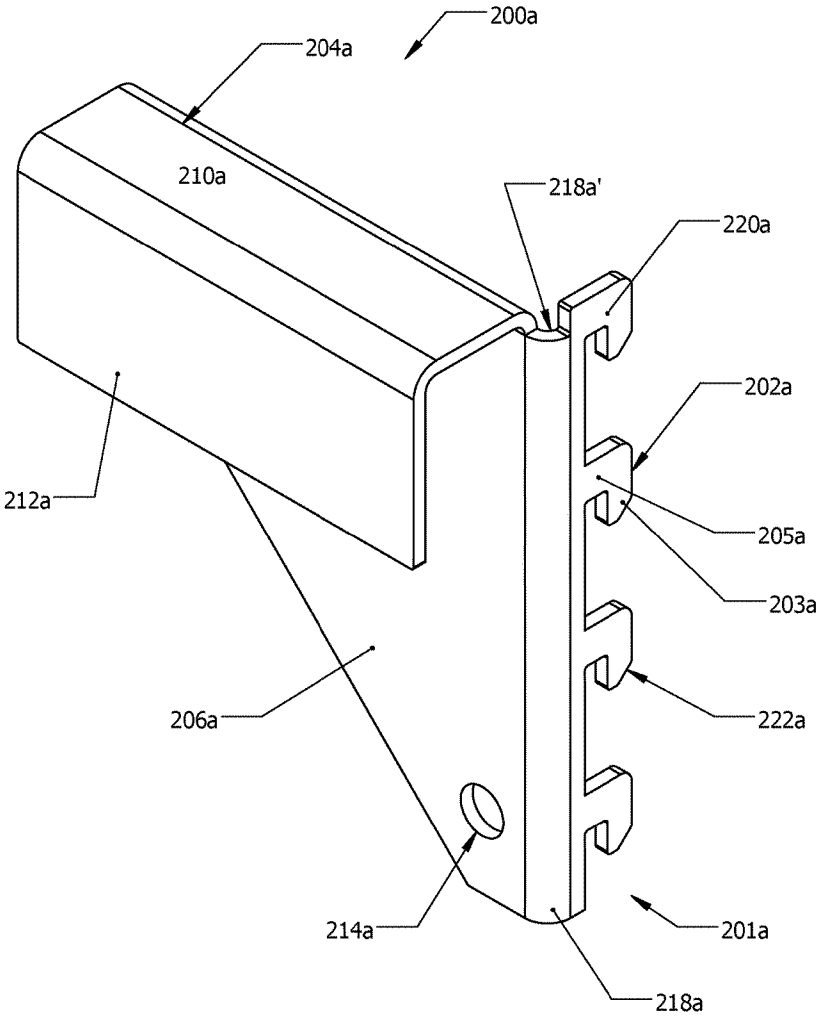
FIG. 13B illustrates another perspective view of the upper support bracket of FIG. 13A, in accordance with an example embodiment.
Figure 13A:
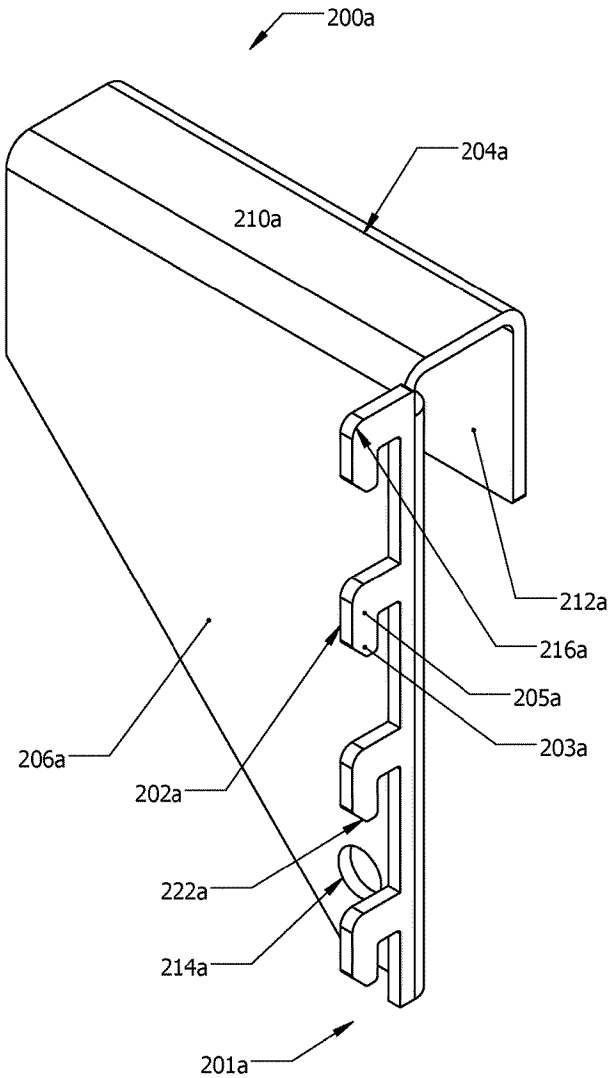
FIG. 13A illustrates a perspective view of an upper support bracket of a mounting system, in accordance with an example embodiment.

FIG. 13A illustrates a perspective view of an upper support bracket 200*a* of a mounting system 100, in accordance with an example embodiment. The bracket 200*a* may include a horizontally-oriented shaft 204*a* that may be formed on a rear surface of the bracket 200*a*. In particular, the horizontal shaft 204*a* may be formed from an upper surface 210*a* and a back surface 212*a* that may be connected to a rear surface of a major body 206*a* of the bracket 200*a*. The major body 206*a* may be a somewhat triangular in shape, in order to reduce an amount of required materials for the bracket 200*a*, while also maximizing an overall strength of the bracket 200*a*. The major body 206*a* may include a paint hang hole 214*a* for purposes of conveniently manufacturing the bracket 200*a*.

An engaging structure 201*a* may be positioned on a front surface of the major body 206*a*. For instance, the engaging structure 201*a* may be a set of teeth 202*a* projecting from the front surface of the major body 206*a*. In an embodiment, the engaging structure 201*a* may include a series of four teeth 202*a*, where each tooth 202*a* may be formed from a horizontal projections 205*a* with a downward-facing vertical projection 202*a* on a distal end of the horizontal projection 205*a*. An upper corner 216*a* of the teeth 202*a* may have a rounded edge. The vertical projection 203*a* of the teeth 202 may also have a beveled outer-edge 222*a*.

FIG. 13B illustrates another perspective view of the upper support bracket 200*a* of FIG. 13A, in accordance with an example embodiment. The bracket 200*a* may include a rounded edge 218*a* between the major body 206*a* and the engaging structure 201*a*. A top-most surface 218*a*' of the rounded edge 218*a* may have a lower elevation than an upper surface 210*a* of the horizontal shaft 204*a* and an upper surface of the top-most tooth 220*a*.

Figure 14B:
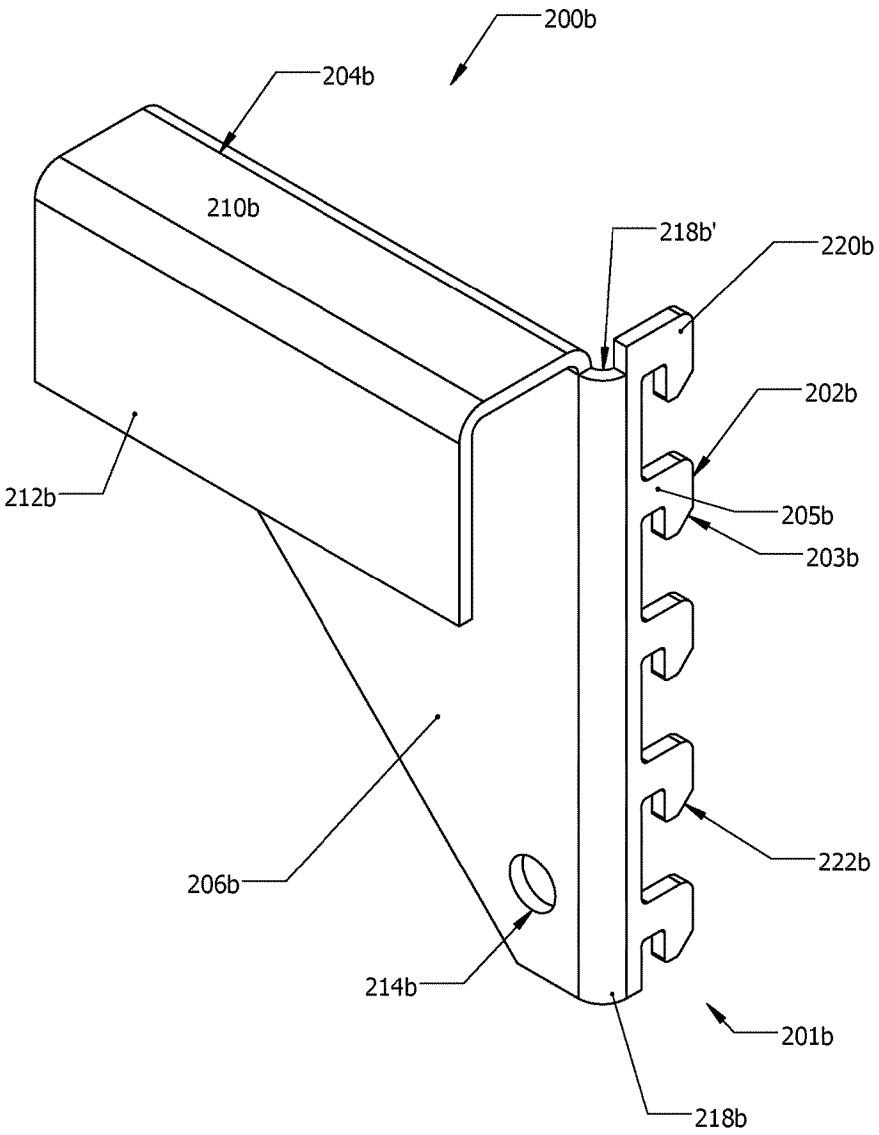
FIG. 14B illustrates another perspective view of the upper support bracket of FIG. 14A, in accordance with an example embodiment.
Figure 14A:
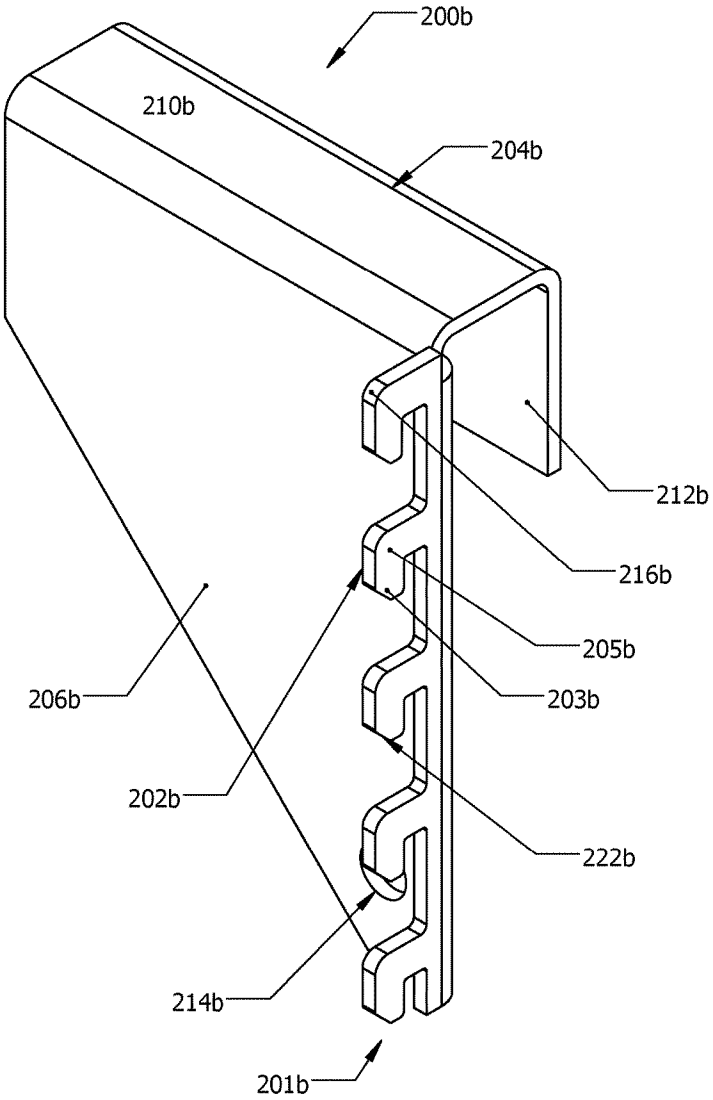
FIG. 14A illustrates a perspective view of an upper support bracket of a mounting system, in accordance with an example embodiment.

FIG. 14A illustrates a perspective view of an upper support bracket 200*b* of a mounting system 100, in accordance with an example embodiment. The bracket 200*b* may include a horizontally-oriented shaft 204*b* that may be formed on a rear surface of the bracket 200*b*. In particular, the horizontal shaft 204*b* may be formed from an upper surface 210*b* and a back surface 212*b* that may be connected to a rear surface of a major body 206*b* of the bracket 200*b*. The major body 206*b* may be a somewhat triangular in shape, in order to reduce an amount of required materials for the bracket 200*b*, while also maximizing an overall strength of the bracket 200*b*. The major body 206*b* may include a paint hang hole 214*b* for purposes of conveniently manufacturing the bracket 200*b*.

An engaging structure 201*b* may be positioned on a front surface of the major body 206*b*. For instance, the engaging structure 201*b* may be a set of teeth 202*b* projecting from the front surface of the major body 206*b*. In an embodiment, the engaging structure 201*b* may include a series of five teeth 202*b*, where each tooth 202*b* may be formed from a horizontal projections 205*b* with a downward-facing vertical projection 202*b* on a distal end of the horizontal projection 205*b*. An upper corner 216*b* of the teeth 202*b* may have a rounded edge. The vertical projection 203*b* of the teeth 202*b* may also have a beveled outer-edge 222*b*.

FIG. 14B illustrates another perspective view of the upper support bracket 200*b* of FIG. 14A, in accordance with an example embodiment. The bracket 200*b* may include a rounded edge 218*b* between the major body 206*b* and the engaging structure 201*b*. A top-most surface 218*b*' of the rounded edge 218*b* may have a lower elevation than an upper surface 210*b* of the horizontal shaft 204*b* and an upper surface of the top-most tooth 220*b*.

Figure 15B:
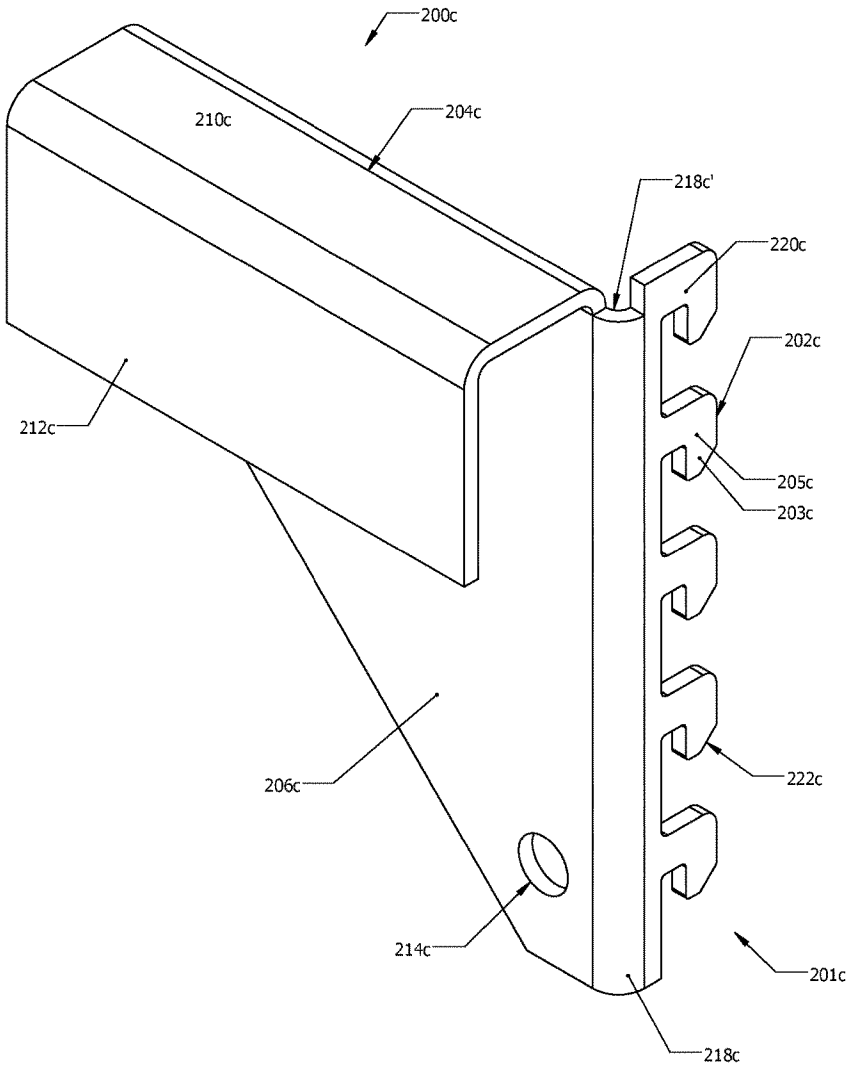
FIG. 15B illustrates another perspective view of the upper support bracket of FIG. 15A, in accordance with an example embodiment.
Figure 15A:
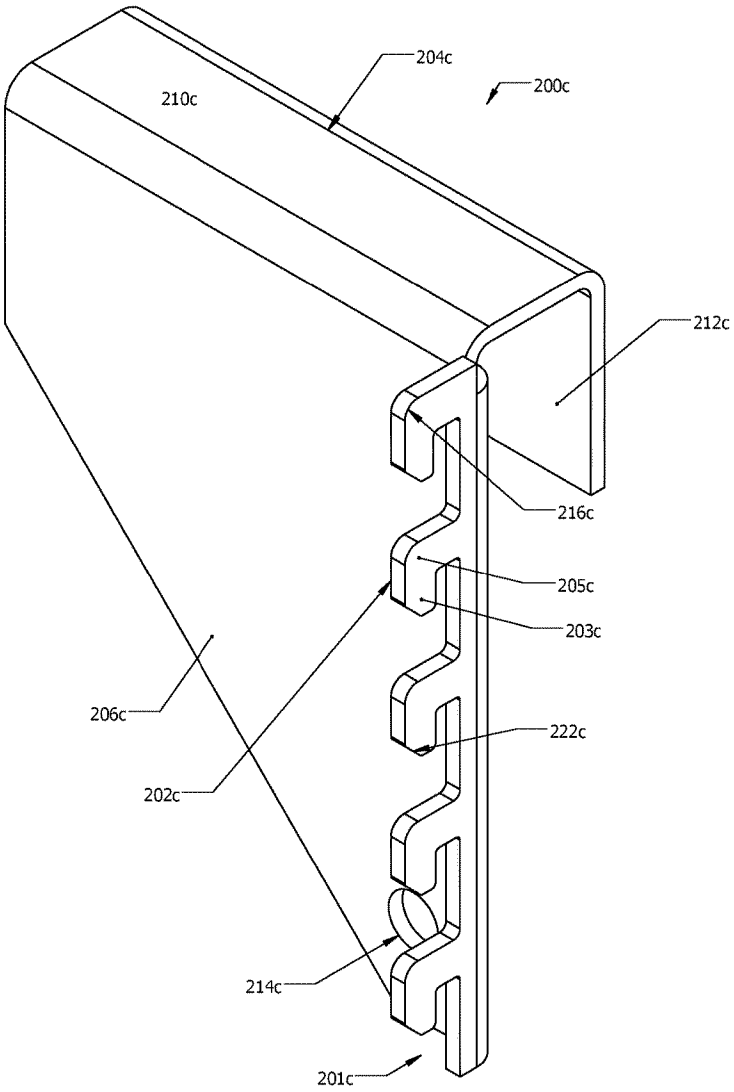
FIG. 15A illustrates a perspective view of an upper support bracket of a mounting system, in accordance with an example embodiment.

FIG. 15A illustrates a perspective view of an upper support bracket 200*c* of a mounting system 100, in accordance with an example embodiment. The bracket 200*c* may include a horizontally-oriented shaft 204*c* that may be formed on a rear surface of the bracket 200*c*. In particular, the horizontal shaft 204*c* may be formed from an upper surface 210*c* and a back surface 212*c* that may be connected to a rear surface of a major body 206*c* of the bracket 200*c*. The major body 206*c* may be a somewhat triangular in shape, in order to reduce an amount of required materials for the bracket 200*c*, while also maximizing an overall strength of the bracket 200*c*. The major body 206*c* may include a paint hang hole 214*c* for purposes of conveniently manufacturing the bracket 200*c*.

An engaging structure 201*c* may be positioned on a front surface of the major body 206*c*. For instance, the engaging structure 201*c* may be a set of teeth 202*c* projecting from the front surface of the major body 206*c*. In an embodiment, the engaging structure 201*c* may include a series of five teeth 202*c*, where each tooth 202*c* may be formed from a horizontal projections 205*c* with a downward-facing vertical projection 202*c* on a distal end of the horizontal projection 205*c*. An upper corner 216*c* of the teeth 202*c* may have a rounded edge. The vertical projection 203*c* of the teeth 202*c* may also have a beveled outer-edge 222*c*.

FIG. 15B illustrates another perspective view of the upper support bracket 200*c* of FIG. 15A, in accordance with an example embodiment. The bracket 200*c* may include a rounded edge 218*c* between the major body 206*c* and the engaging structure 201*c*. A top-most surface 218*c*' of the rounded edge 218*c* may have a lower elevation than an upper surface 210*c* of the horizontal shaft 204*c* and an upper surface of the top-most tooth 220*c*.

Figure 16B:
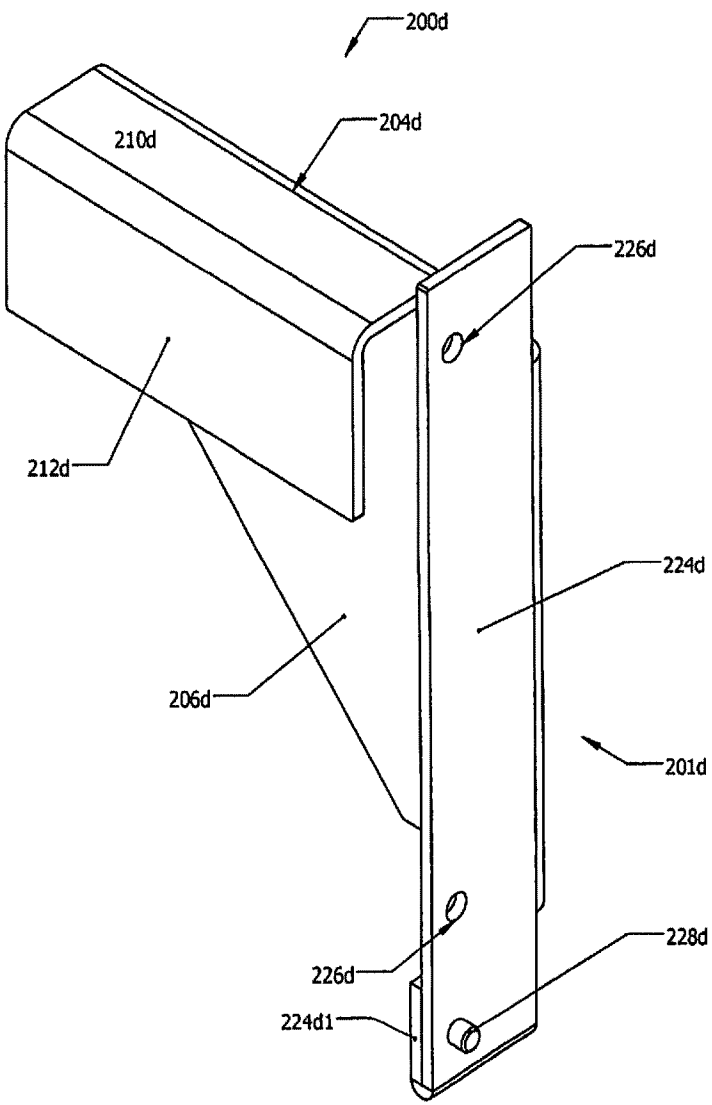
FIG. 16B illustrates another perspective view of the upper support bracket of FIG. 16A, in accordance with an example embodiment.
Figure 16A:
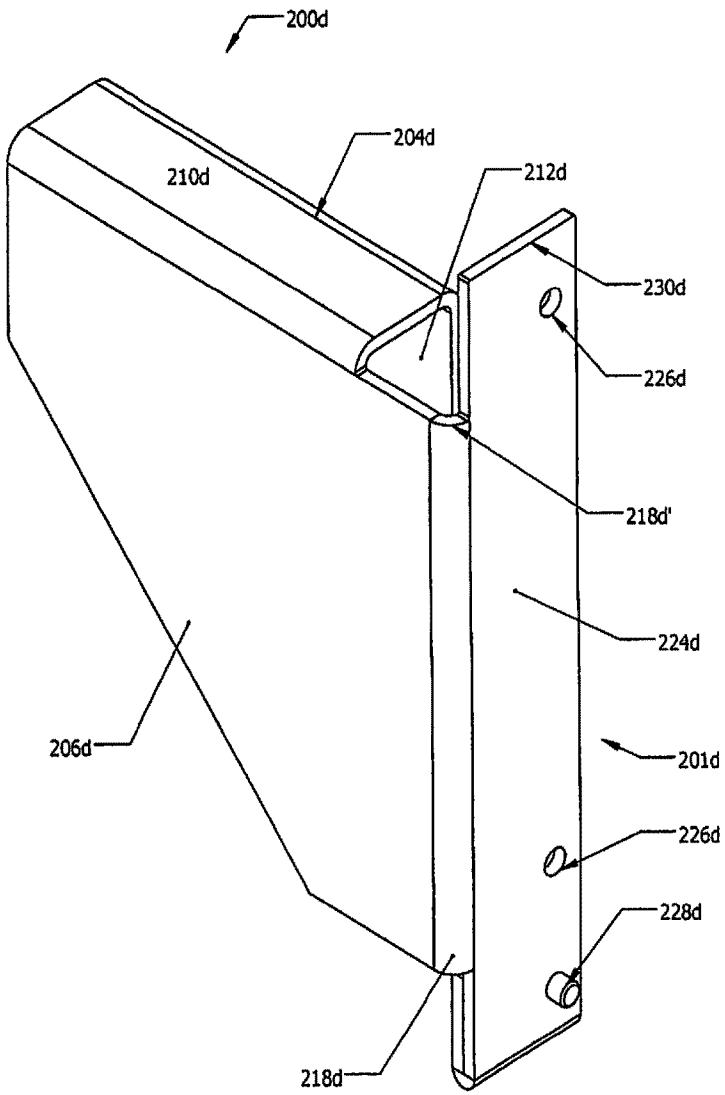
FIG. 16A illustrates a perspective view of an upper support bracket of a mounting system, in accordance with an example embodiment.

FIG. 16A illustrates a perspective view of an upper support bracket 200*d* of a mounting system 100, in accordance with an example embodiment. The bracket 200*d* may include a horizontally-oriented shaft 204*d* that may be formed on a rear surface of the bracket 200*d*. In particular, the horizontal shaft 204*d* may be formed from an upper surface 210*d* and a back surface 212*d* that may be connected to a rear surface of a major body 206*d* of the bracket 200*d*. The major body 206*d* may be a somewhat triangular in shape, in order to reduce an amount of required materials for the bracket 200*d*, while also maximizing an overall strength of the bracket 200*d*.

An engaging structure 201*d* may be positioned on an end of the major body 206*d*. For instance, the engaging structure 201*d* may be a vertical plate 224*d* that may be positioned about perpendicular to the major body 206*d*. In an embodiment, the plate 224*d* may include one or more bolt holes 226*d*, and a mounting stub 228*d* near a bottom portion of the vertical plate 224*d*. The bracket 200*d* may include a rounded corner 218*d* between the major body 206*d* and the vertical plate 224*d*. An upper surface 218*d*' of the corner 218*d* may have a lower elevation than an upper surface 210*d* of the horizontal shaft 204*d* and an upper surface 230*d* of the vertical plate 224*d*.

FIG. 16B illustrates another perspective view of the upper support bracket 200*d* of FIG. 16A, in accordance with an example embodiment. In an embodiment, a lower portion of the vertical plate 224*d* of the bracket 200*d* may include an overlapping layer 224*d*1 of the plate 224*d* that may be folded over onto a rear-side of the plate 224*d*.

Figure 16C:
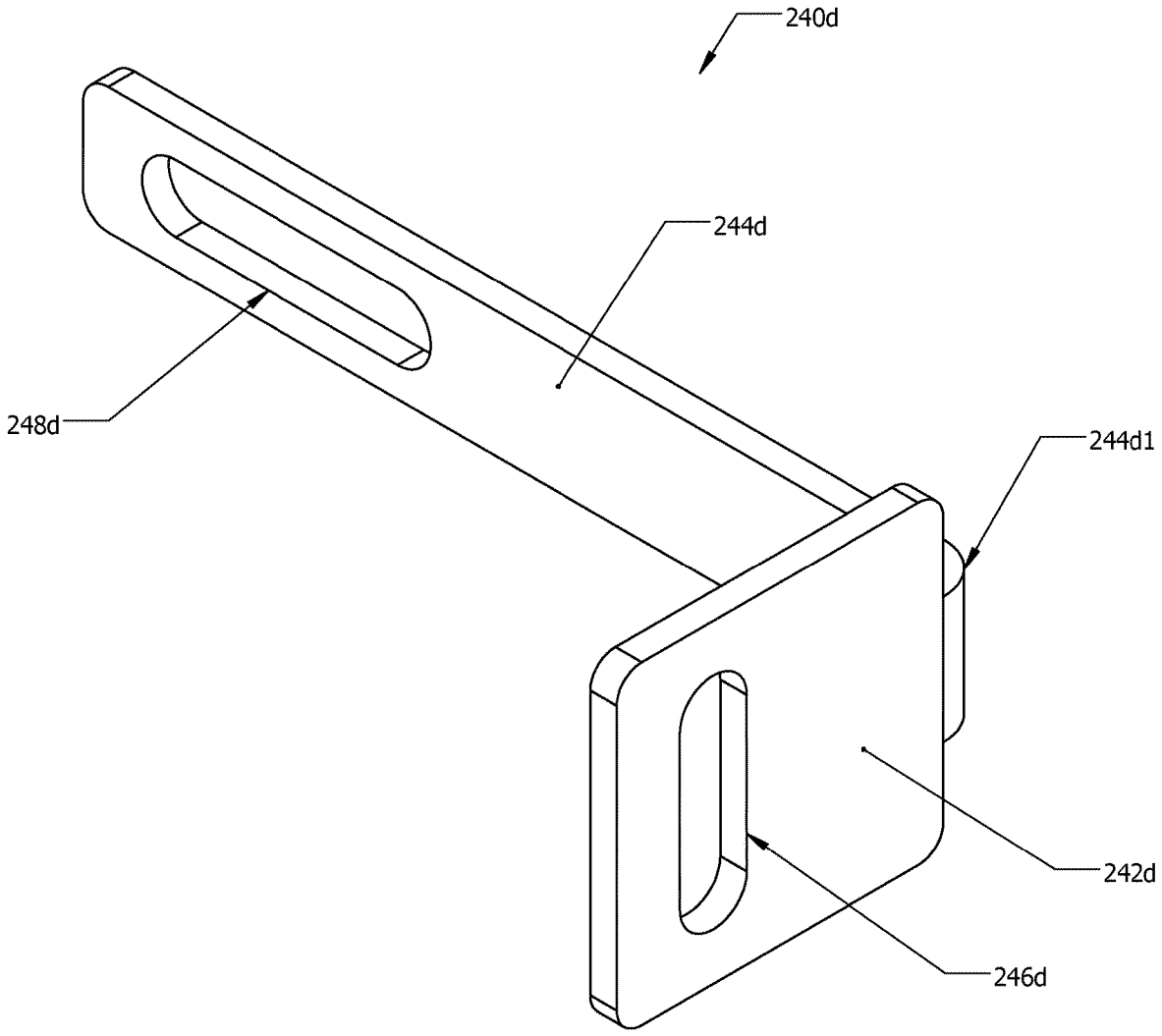
FIG. 16C illustrates a perspective view of a lower bracket associated with the upper bracket of FIG. 16A, in accordance with an example embodiment.

FIG. 16C illustrates a perspective view of a lower bracket 240*d* associated with the upper bracket 200*d* of FIG. 16A, in accordance with an example embodiment. The lower bracket 240*d* may include a horizontal blade 244*d* that may define a vertical slot 248*d* running along a portion of a longitudinal length of the horizontal blade 244*d*. A distal end of the horizontal blade 244*d* may include a bend 244*d*1, where a side plate 242*d* may be connected to distal end of the horizontal blade 244*d*. The side plate 246*d* may be about perpendicular to the horizontal blade 244*d*. The side plate 246*d* may define a vertical slot 246*d*.

Figure 17B:
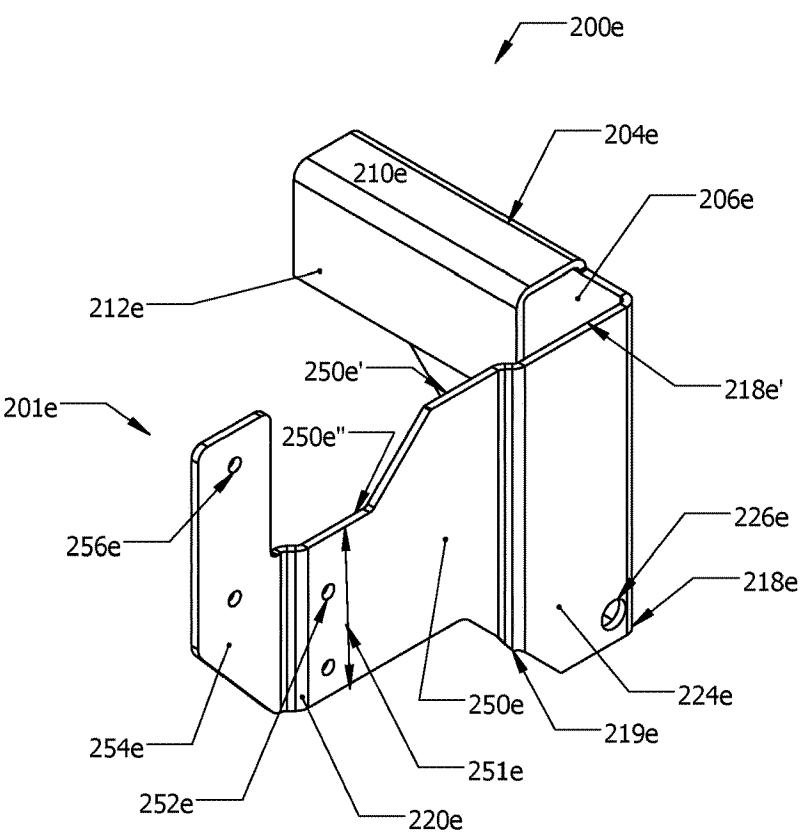
FIG. 17B illustrates another perspective view of an upper support bracket, in accordance with an example embodiment.
Figure 17A:
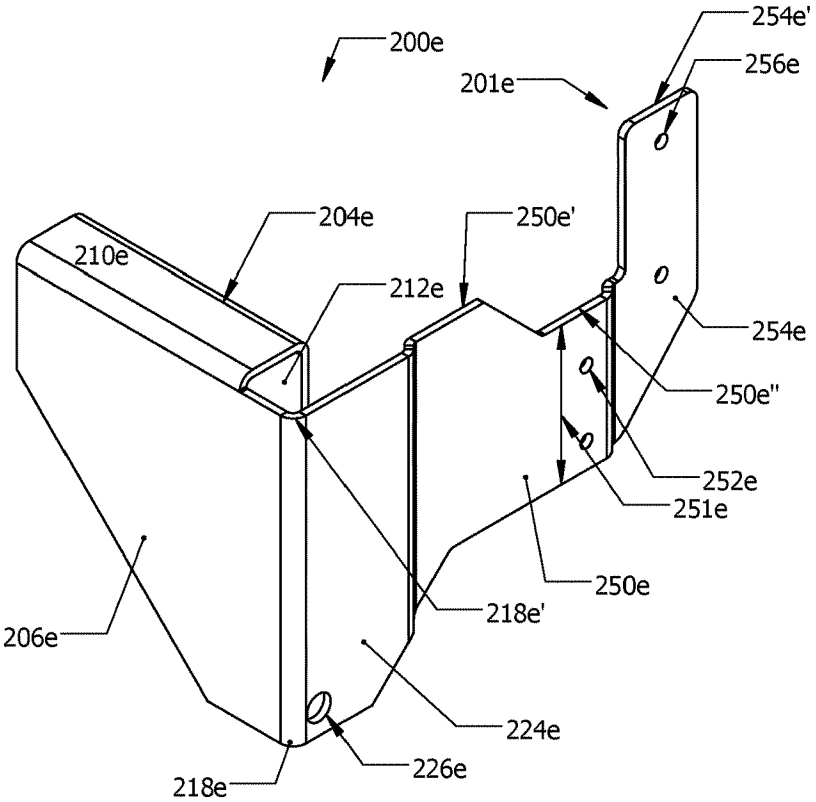
FIG. 17A illustrates a perspective view of an upper support bracket of a mounting system, in accordance with an example embodiment.

FIG. 17A illustrates a perspective view of an upper support bracket 200*e* of a mounting system 100, in accordance with an example embodiment. The bracket 200*e* may include a horizontally-oriented shaft 204*e* that may be formed on a rear surface of the bracket 200*e*. In particular, the horizontal shaft 204*e* may be formed from an upper surface 210*e* and a back surface 212*e* that may be connected to a rear surface of a major body 206*e* of the bracket 200*e*. The major body 206*e* may be a somewhat triangular in shape, in order to reduce an amount of required materials for the bracket 200*e*, while also maximizing an overall strength of the bracket 200*e*.

An engaging structure 201*e* may be positioned on an end of the major body 206*e*. In an embodiment, the engaging structure 201*e* may be a set of plates 224*e*/250*e*/254*e* that may include: a proximal plate 224*e*, an intermediate plate 250*e* and a distal plate 254*e*. Each of the plates 224*e*/250*e*/254*e* may have major surfaces that are about parallel to each other. The proximal plate 224*e* may be directly connected to the major body 206*e*, and the plate 224*e* may be about perpendicular to the major body 206*e*. The proximal plate 224*e* may include a paint hang hole 226*e* that may help in manufacturing the bracket 200*e*. The intermediate plate 250*e* may be directly connected to the proximal plate 224*e*, where the intermediate plate 250*e* may include a tapered distal end 251*e*, where the distal end 251*e* may be directly connected to the distal plate 254*e*. In an embodiment, an upper surface 250*e*" of the tapered distal end 250*e* of the intermediate plate 250*e* may have a lower elevation than the upper surface 250*e* of the remainder of the intermediate plate 250*e* and an upper surface of the proximal plate 218*e*'. The intermediate plate 250*e* may include bolt holes 252*e* positioned near the distal end 251*e* of the intermediate plate 250*e*. The distal plate 254*e* may be an upwardly-projecting vertical plate that may include bolt holes 256*e*, where an upper surface 254*e*' of the distal plate 254*e* may have a higher elevation than the remaining bracket 200*e* structure.

FIG. 17B illustrates another perspective view of the upper support bracket of FIG. 17A, in accordance with an example embodiment. In an embodiment, bends 219*e*/220*e* may separate the plates 224*e*/250*e*/254*e* of the engaging structure 201*e* of the bracket 200*e*. In particular, an inwardly-turning bend 219*e* may be positioned between the proximal plate 224*e* and the intermediate plate 250*e*, and another inwardly-turning bend 220*e* may be positioned between the intermediate plate 250*e* and the distal plate 254*e* (where these bends 219*e*/220*e* are shown in better detail in FIGS. 17C/D).

Figure 17D:
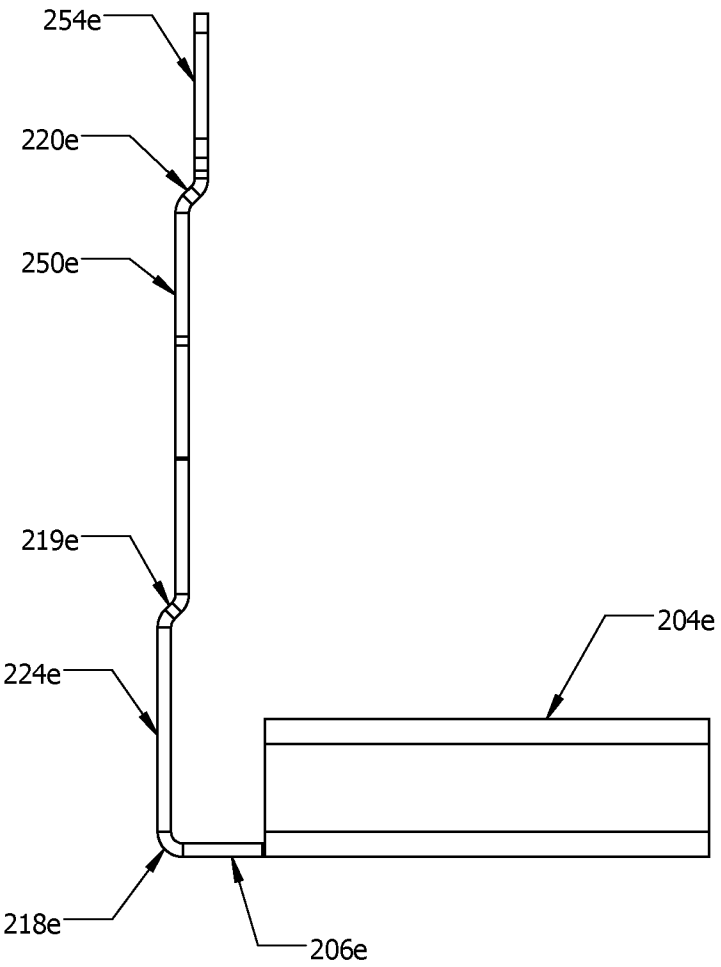
FIG. 17D illustrates an overhead view of the upper support bracket of FIG. 17B, in accordance with an example embodiment.
Figure 17C:
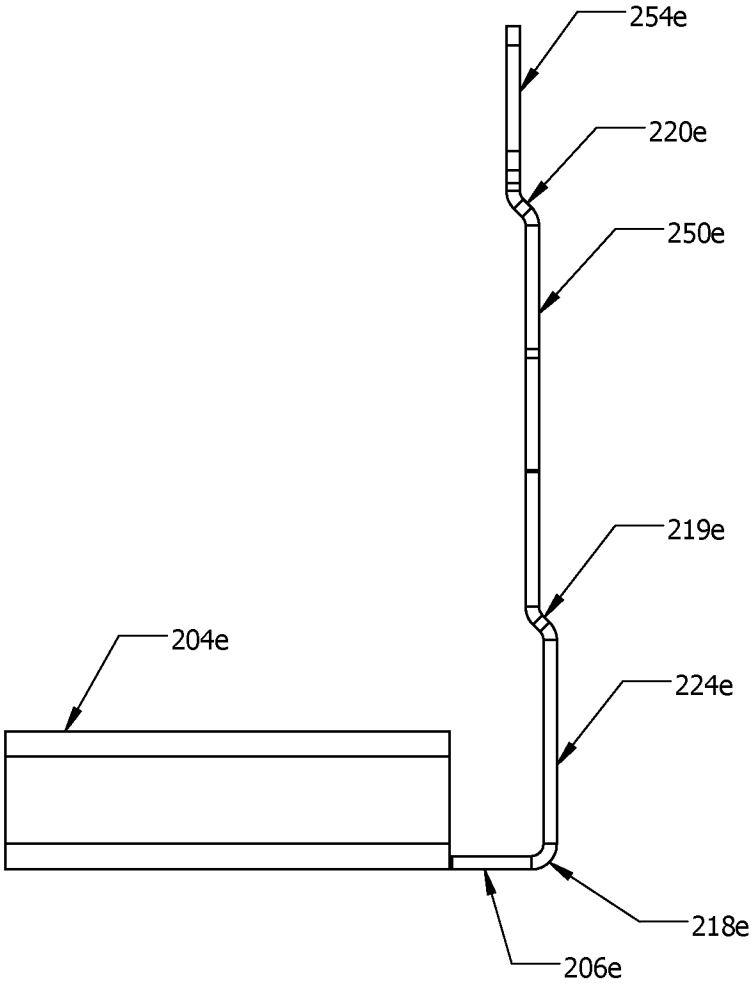
FIG. 17C illustrates an overhead view of the upper support bracket of FIG. 17A, in accordance with an example embodiment.

FIG. 17C illustrates an overhead view of the upper support bracket 200*e* of FIG. 17A, in accordance with an example embodiment. In this view, the inwardly-turning bends 219*e*/220*e* can be shown in better detail. Specifically, the bend 219*e* allows the intermediate plate 250*e* to remain about parallel with the proximal plate 224*e*, while the intermediate plate 250*e* is somewhat "offset" (i.e., set closer to the major body 206*e* of the bracket 200*e*). Likewise, the bend 220*e* allows the distal plate 254*e* to remain about parallel with the intermediate plate 250*e*, while the distal plate 254*e* is somewhat "offset" (i.e., set closer to the major body 206*e* of the bracket 200*e*).

FIG. 17D illustrates an overhead view of the upper support bracket 200*e* of FIG. 17B, in accordance with an example embodiment. In this view, the inwardly-turning bends 219*e*/220*e* can be shown in better detail. Specifically, the bend 219*e* allows the intermediate plate 250*e* to remain about parallel with the proximal plate 224*e*, while the intermediate plate 250*e* is somewhat "offset" (i.e., set closer to the major body 206*e* of the bracket 200*e*). Likewise, the bend 220*e* allows the distal plate 254*e* to remain about parallel with the intermediate plate 250*e*, while the distal plate 254*e* is somewhat "offset" (i.e., set closer to the major body 206*e* of the bracket 200*e*).

Figure 17F:
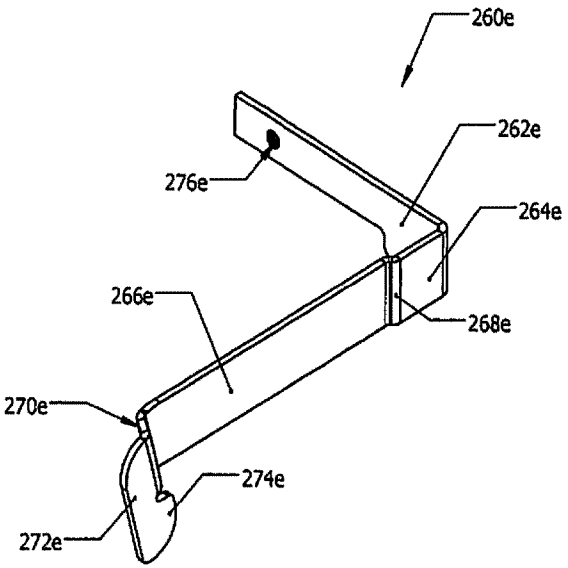
FIG. 17F illustrates a perspective view of a lower bracket associated with the upper bracket of FIG. 17B, in accordance with an example embodiment.
Figure 17E:
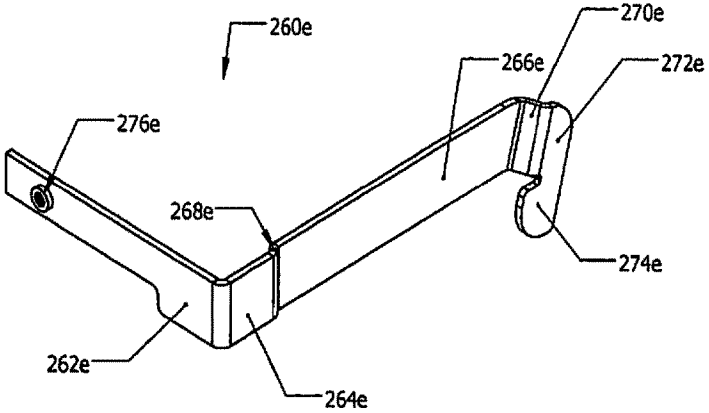
FIG. 17E illustrates a perspective view of a lower bracket associated with the upper bracket of FIG. 17A, in accordance with an example embodiment.

FIG. 17E illustrates a perspective view of a lower bracket 260*e* associated with the upper bracket 200*e* of FIG. 17A, in accordance with an example embodiment. The lower bracket 260*e* may include a horizontal blade 262*e* with a bolt hole 276*e* near a first end of the blade 262*e*. The horizontal blade 262*e* may include a side plate 264*e* connected to a second end of the blade 262*e*, where the side plate 264*e* may be about perpendicular to the horizontal blade 262*e*. A side blade 266*e* may be connected to the side plate 264*e*, where an inwardly-turning bend 268*e* may connect the side blade 264*e* to the side plate 264*e*. A downwardly-projecting distal end piece 272*e* may be connected to a distal end of the side blade 266*e*, where an outwardly-turning bend 270*e* may connect the downwardly-projecting distal end 272*e* to the side blade 266*e*. The downwardly-projecting distal end 272*e* may include an inwardly-projecting toe 274*e* may be positioned on a distal end of the downwardly-projecting distal end piece 272*e*.

FIG. 17F illustrates a perspective view of a lower bracket 260*e*, in accordance with an example embodiment. In this view, the inwardly-turning bend 268*e* and the outwardly-turning bend 270*e* can be seen in better detail.

Figure 17G:
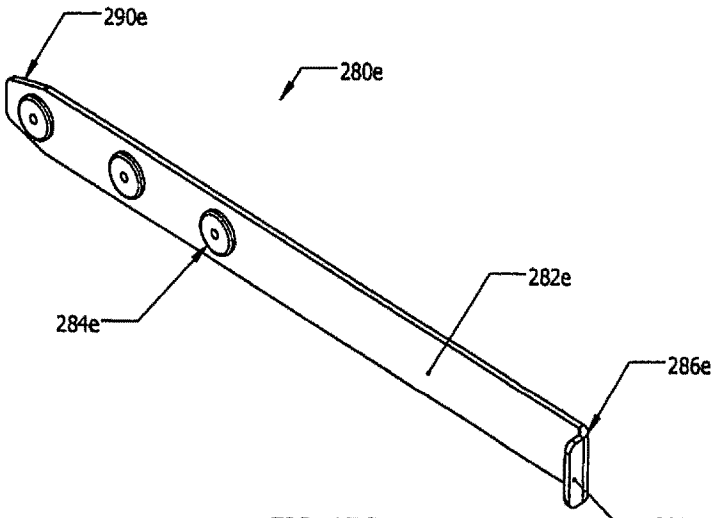
FIG. 17G illustrates a perspective view of an upright bracket associated with the upper bracket of FIG. 17A, in accordance with an example embodiment.

FIG. 17G illustrates a perspective view of an upright bracket 280*e* associated with the upper bracket 200*e* of FIG. 17A, in accordance with an example embodiment. The upright bracket 280*e* may include a blade 282*e* with a tapered proximal end 290*e*, and one or more stops 284*e* projecting from a front surface of the blade 282*e*. The blade 282*e* may also include a lip 288*e* on a distal end of the blade 282*e*, where a rounded bend 286*e* may separate the lip 288*e* from the blade 282*e*.

Figure 18A:
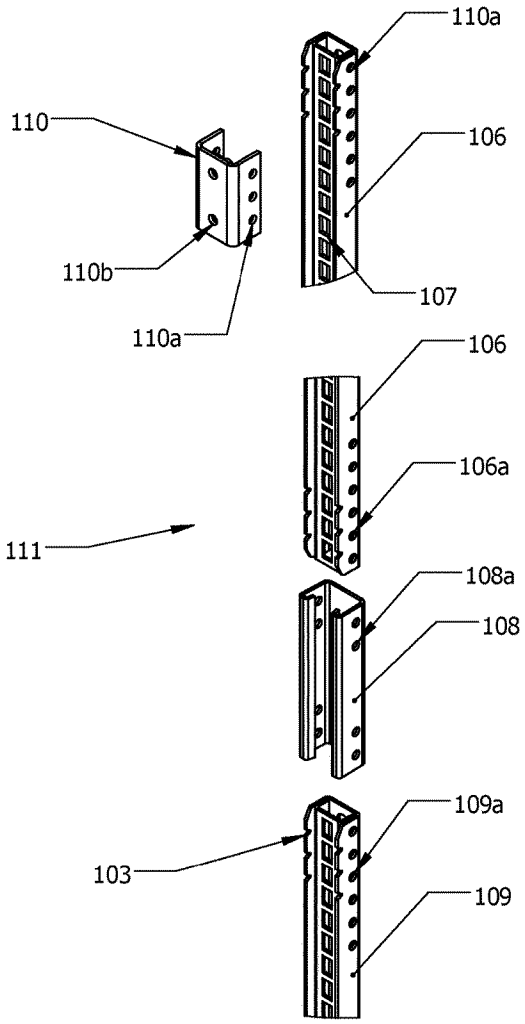
FIG. 18A illustrates components of a vertical upright for a mounting system, in accordance with an example embodiment.

FIG. 18A illustrates components of a vertical upright 111 for a mounting system 100, in accordance with an example embodiment. The upright 111 may include one or more upright segments 106/109 of varying lengths. A coupling (connector) 108 can be used to connect the segments 106/109 (where coupling 108 is shown in better detail in FIGS. 8 and 9). Bolt holes 106*a*/109*a* may be included on the upright segments 106/109, and bolt holes 108*a* may also be included on the coupling 108, in order to connect the segments 106/109. Notches 103 may be included on the ends of the upright segments 106/109. A short-length connector 110 (with bolts holes 110*a* and mounting holes 110*b*) may also be used to connect an upper portion of the vertical upright to the upper crossbar 102 (shown in better detail in FIGS. 18D and 18E).

Figure 18C:
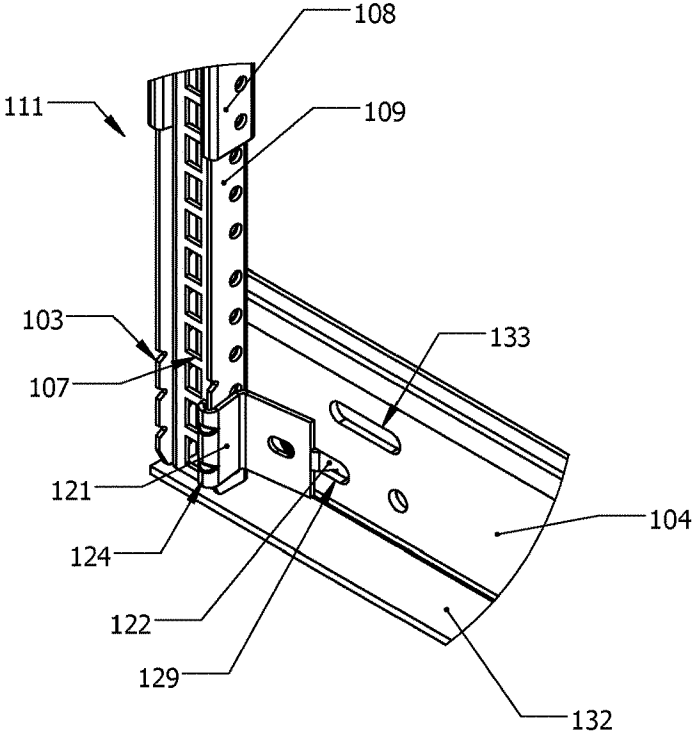
FIG. 18C illustrates the connecting of the lower portion of the vertical upright to the lower crossbar of a mounting system, in accordance with an example embodiment.
Figure 18B:
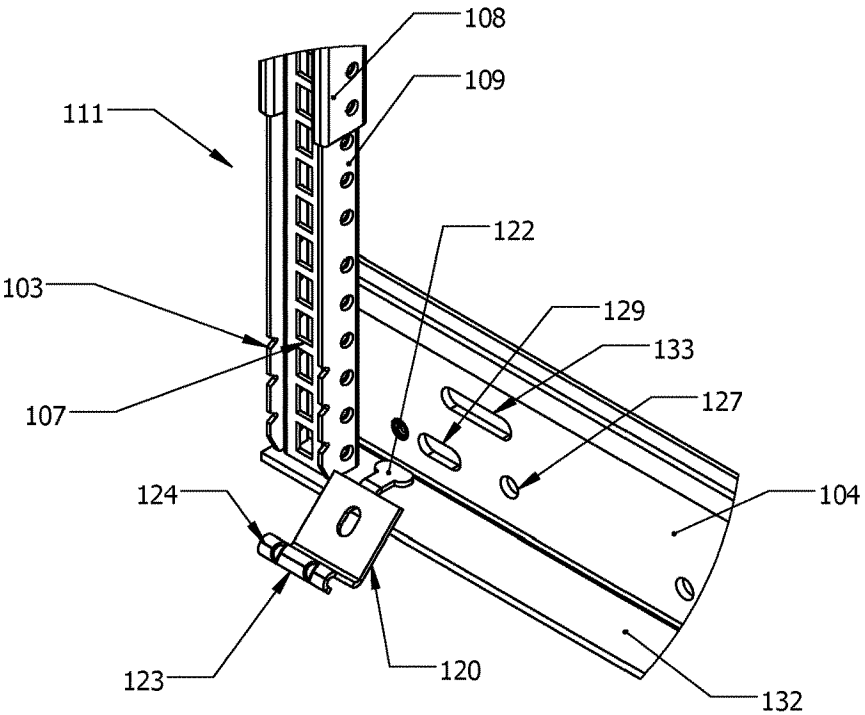
FIG. 18B illustrates the connecting of a lower portion of a vertical upright to a lower crossbar of a mounting system, in accordance with an example embodiment.

FIG. 18B illustrates the connecting of a lower portion of a vertical upright 111 to a lower crossbar 104 of a mounting system 100, in accordance with an example embodiment. The upright 111 may be connected to the crossbar 104 by a lower segment 109 of the upright 111 being positioned to rest on the bottom wall 132 of the crossbar. An end (i.e., angled tab 122 with a "mushroom" shaped profile) of a connector-plate 120 may be inserted into a slot 129 of the crossbar 104.

FIG. 18C illustrates the connecting of the lower portion of the vertical upright 111 to the lower crossbar 104 of a mounting system 100, in accordance with an example embodiment. Once the angled tab 122 of the connector-plate 120 is inserted into the slot 129, the connector plate 120 may be turned (approximately 90 degrees) so that a hinge 123 and J-shaped hooks 124 may face a corner edge 109*b* of the lower upright segment 109. In particular, the hinge 123 may be fitted over the corner edge 109*b* of the segment 109, so that an inner edge of the J-shaped hooks 124 (that may be positioned on either side of hinge 123) may be fitted into the notches 103 that are on the edge 109*b* of the lower segment 109. In this regard, the connector-plate 120 may firmly affix the upright segment 109 to the crossbar 104, in order to stabilize the weight-bearing upright 111 after the mounting system 100 is installed on a consumer product display 10.

Figure 18E:
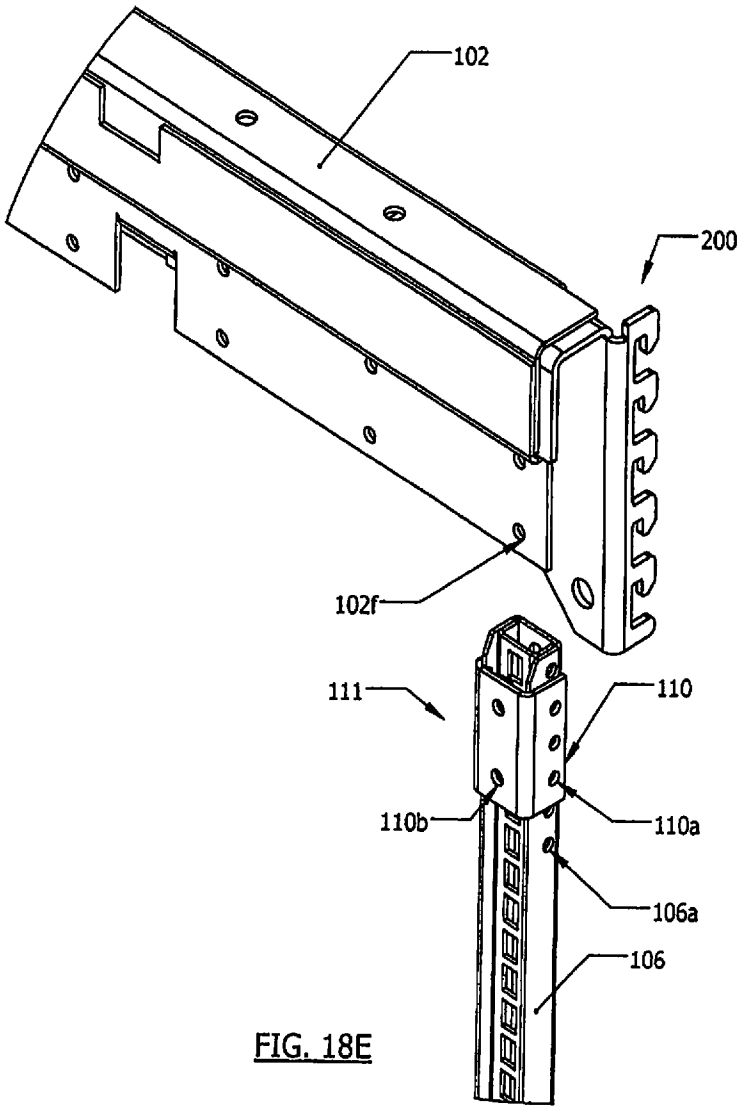
FIG. 18E illustrates a top portion of a vertical upright being connected to an upper crossbar, in accordance with an example embodiment.
Figure 18D:
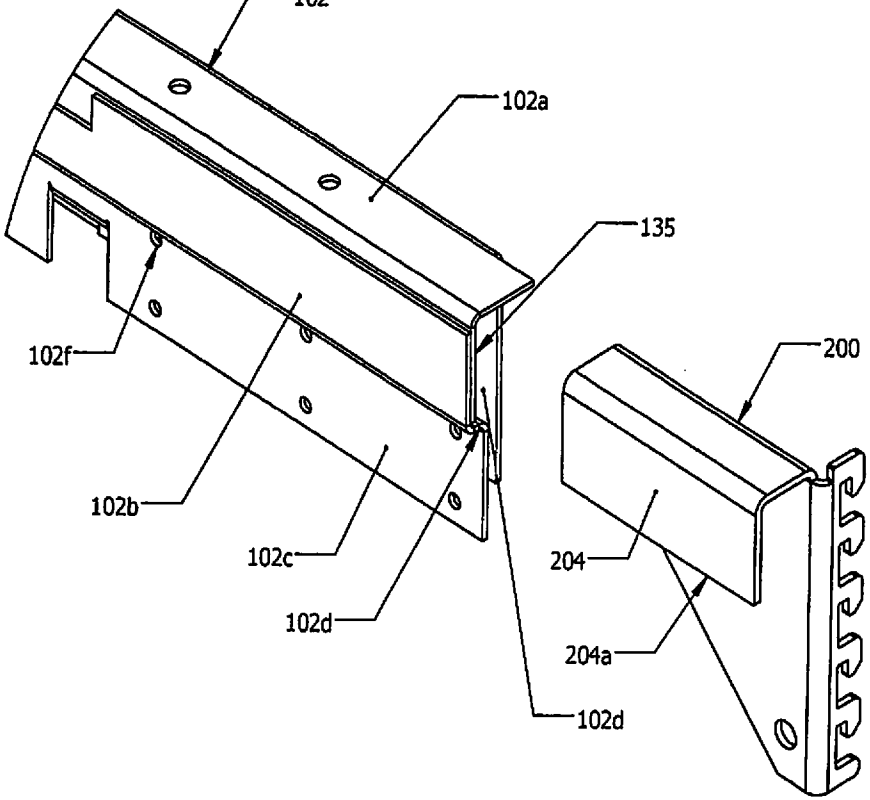
FIG. 18D illustrates a perspective view of a support bracket being connected to an upper crossbar of a mounting system, in accordance with an example embodiment.

FIG. 18D illustrates a perspective view of a support bracket 200 being connected to an upper crossbar 102 of a mounting system 100, in accordance with an example embodiment. An end of the crossbar 102 may include a cavity 135 that may be conformed to an outer surface of the horizontal shaft 204 of the support bracket 200. In an embodiment, the cavity 135 may be partially defined by a step 102*d* on an inner surface of the front surface 102*b* of the crossbar 102, where a distal free edge 204*a* of the horizontal shaft 204 may be supported by the step 102*d* once the horizontal shaft 204 of the support bracket 200 is inserted into the crossbar 102. In another embodiment, pairs of mounting holes 102*f* may be included on a lower surface 102*c* of the crossbar 102.

FIG. 18E illustrates a top portion of a vertical upright 111 being connected to the upper crossbar 102, in accordance with an example embodiment. In this view, once the support bracket 200 is inserted into the cavity 135 in an end of the crossbar 102, a short-length connector 110 may be fitted to a top of vertical upright segment 106, where bolts or other structure may be used to hold the connector 110 to the segment 106 using bolt holes 110*a*/106*a*. The connector 110 may then be connected to the crossbar 102 (shown in FIG. 18F) using mounting holes 110*b*/102*f*, where bolts or other suitable structure may be used to firmly affix the upright segment 106 to the crossbar 102.

Figure 18G:
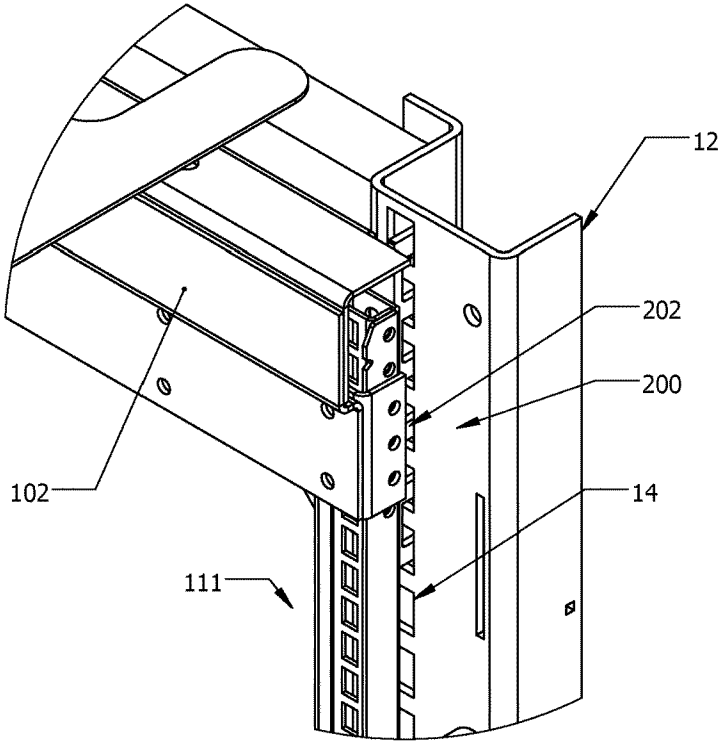
FIG. 18G illustrates the upper crossbar connected to the column of a consumer product display, in accordance with an example embodiment.
Figure 18F:
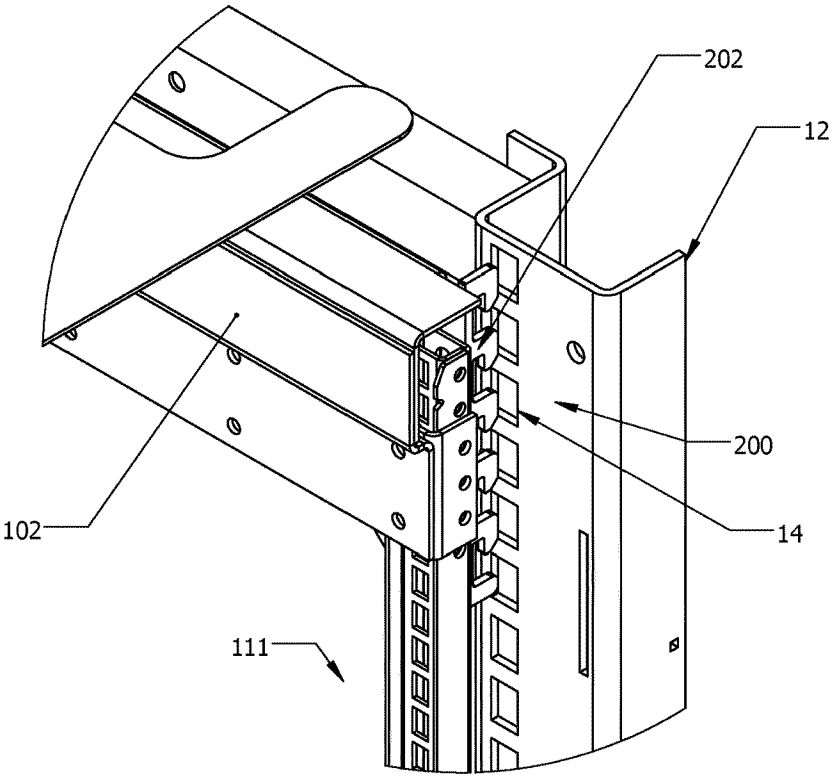
FIG. 18F illustrates an upper crossbar being connected to a column of a consumer product display using a support bracket, in accordance with an example embodiment.

FIG. 18F illustrates the upper crossbar 102 being connected to a column 12 of a consumer product display 10 using a support bracket 200, in accordance with an example embodiment. In particular, the engaging structure (teeth 202) of the support bracket 200 may mate with vertical (front) slots 14 in the column 12 in order to attach the crossbar 102 and the vertical upright 111 to the column 12 of the consumer product display 10.

It is important to note that, due to unique size requirements for any number of types of consumer product displays (where displays 10/20/30 are some examples), the support brackets (i.e., any of brackets 200, 200*a*, 200*b*, 200*c*, 200*d*, 200*e* and 200*f* described herein) may fulfill a role of adjusting for width-tolerances in the overall mounting systems (i.e., for any of mounting systems 100, 100*a* and 100*b*, as an example). As an example, support bracket 200 may make width-adjustments to the effective overall length of a crossbar 102 (where different length crossbars 102 may be utilized within a mounting system 100), by allowing the support bracket 200 to be inserted either fully, partially, or semi-partially into the cavity 135 at an end of the crossbar 102, in order to fine-tune the effective length of the crossbar 102/support bracket 200 and thereby accommodate a great variety of consumer product display 10 sizes. In this sense, it should be understood that support bracket 200 is capable of horizontally-sliding within the cavity 135 of the crossbar 102, even once the mounting system 100 is installed on a consumer product display 10, in order to ensure that the mounting system 100 is able to perfectly connect to any size of consumer product display 10.

FIG. 18G illustrates the upper crossbar 102 of FIG. 18F after it is connected to the column 12 of the consumer product display 10, in accordance with an example embodiment. In this view, the teeth 202 of the support bracket 200 have been inserted into the slots 14 of the column, such that the crossbar 102 and vertical upright 111 are connected to the column 12.

Figure 18I:
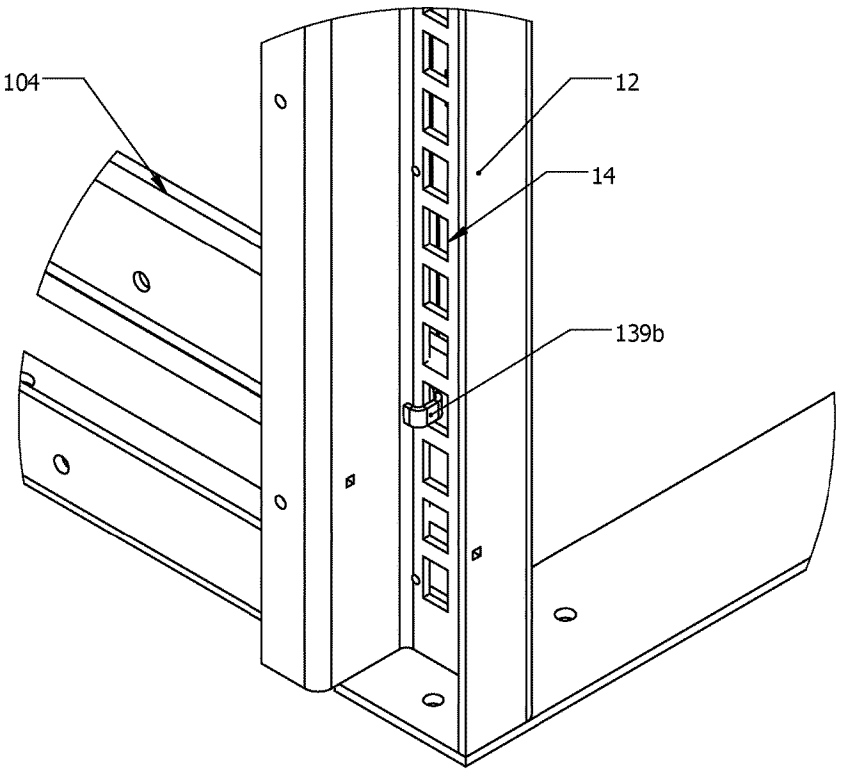
FIG. 18I illustrates the lower crossbar of the mounting system connected to the column of the consumer product display, in accordance with an example embodiment.
Figure 18J:
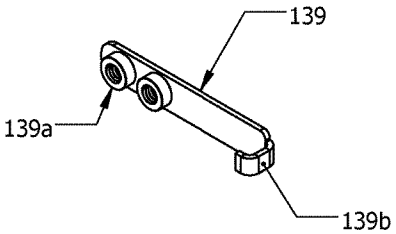
FIG. 18J illustrates a perspective view of a J-shaped bracket, in accordance with an example embodiment.
Figure 18H:
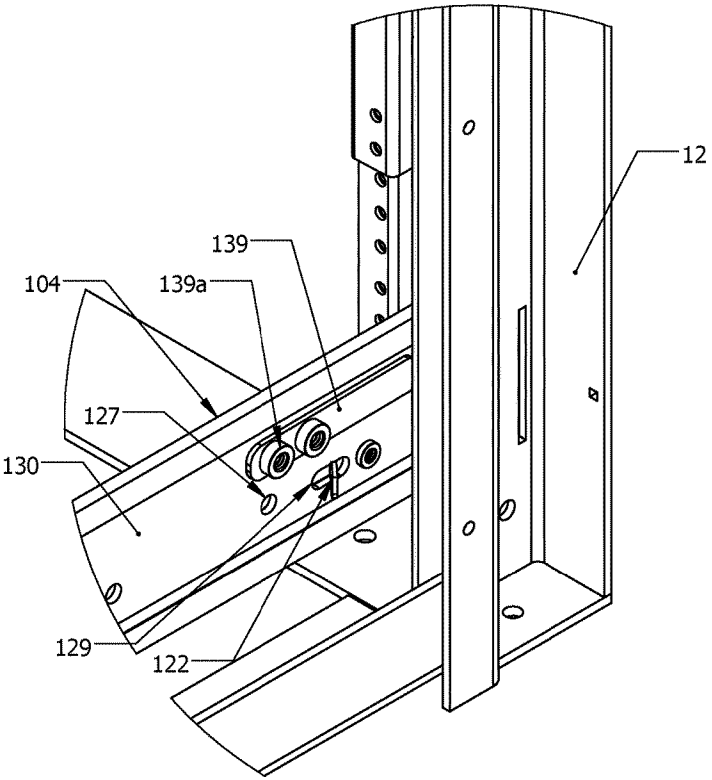
FIG. 18H illustrates a lower crossbar of a mounting system being connected to a column of a consumer product display, in accordance with an example embodiment.

FIG. 18H illustrates a crossbar 104 of a mounting system 100 being connected to a column 12 of a consumer product display 10, in accordance with an example embodiment. In this view, the tab 122 of the connector-plate 120 is being retained in the slot 129, the upright segment 109 is resting on the bottom wall 132 of the crossbar 104, and the crossbars 102/104 and vertical uprights 111 are capable of distributing a weight-load onto the existing columns 12 of the consumer product display 10 (by virtue of the crossbar 102/upright 111 being connected to the column 12 in FIG. 18G, and the lower end of the upright 111 being connected to the lower crossbar 104 in FIG. 18H).

A J-shaped bracket 139 (also see FIG. 18J) may also be attached to the crossbar 104, in order to secure the crossbar 104 to the column 12. In an embodiment, a surface of the J-shaped bracket 139 may be pressed against a backwall of the crossbar 104, where bolt holes 139*a* may be aligned with slot 133 (see FIG. 6) of the crossbar 104 to bolt the bracket 139 to the crossbar 104.

FIG. 18I illustrates a crossbar 104 of a mounting system 100 being connected to a column 12 of a consumer product display 10, in accordance with an example embodiment. In an embodiment, a hook-end 139*b* of a J-shaped bracket 139 (see FIG. 18J) may be fitted into a slot 14 of the column 12, in order to horizontally stabilize the crossbar 104.

FIG. 18J illustrates a perspective view of a J-shaped bracket 139, in accordance with an example embodiment. An installation of this bracket 139 is shown in FIGS. 18H and 18I, described above.

Figure 18K:
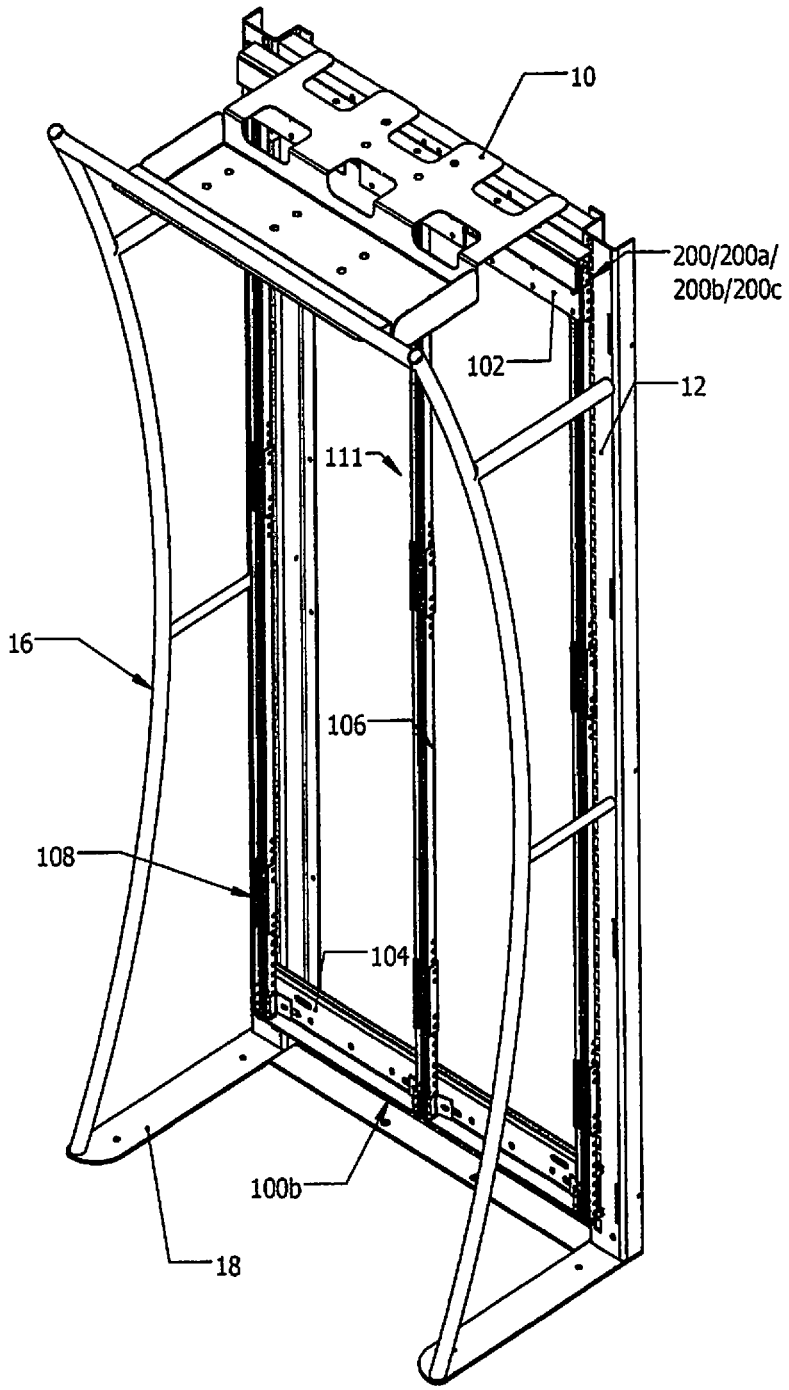
FIG. 18K illustrates a perspective view of a mounting system installed on a consumer product display, in accordance with an example embodiment.

FIG. 18K illustrates a perspective view of the mounting system 100 installed on the consumer product display 10, in accordance with an example embodiment. As stated above, in this configuration, the crossbars 102/104 and vertical uprights 111 are capable of distributing a weight-load onto the existing columns 12 of the consumer product display 10 (by virtue of the crossbar 102/upright 111 being connected to the column 12, as shown in better detail in FIG. 18G, and the lower end of the upright 111 being connected to the lower crossbar 104, as shown in better detail in FIG. 18H).

It should be understood that, while support bracket 200 has referenced throughout this document, including the many example embodiments described above, it should be understood that support brackets 200*a*/200*b*/200*c*/200*f* are also able to substitute for support bracket 200 (depending on the specific consumer product display 10/20/30 that the mounting system 100 may be tying into), as these brackets 200/200*a*/200*b*/200*c*/200*f* are intended to be used on consumer product displays 10 that have columns 12 with vertical slots 14 facing a front of the display 10.

Figure 19A:
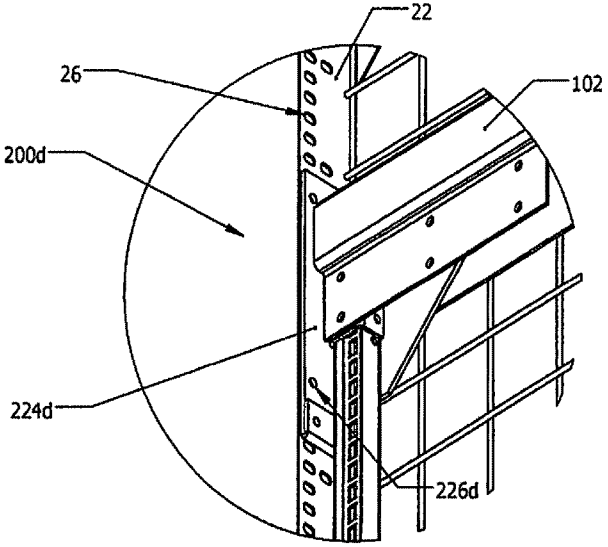
FIG. 19A illustrates an upper crossbar being installed on a consumer product display using a support bracket, in accordance with an example embodiment.

FIG. 19A illustrates an upper crossbar 102 being installed on a consumer product display 20 using a support bracket 200*d* (see FIG. 16A), in accordance with an example embodiment. This support bracket 200*d* may mate with columns 22 of a consumer product display 20 that have bolt holes 26 on a side of the display 20 (for example, see the display 20 of FIG. 19D, where the columns 22 face each other). The mounting stub 228*d* (FIG. 16A) on the vertical plate 224*d* of the bracket 200*d* may be inserted into one of the mounting holes 26 of the column 22, while bolts holes 226*d* on the vertical plate 224*d* may be used to bolt the plate 224*d* to the column 22 using the bolt holes 26.

Figure 19C:
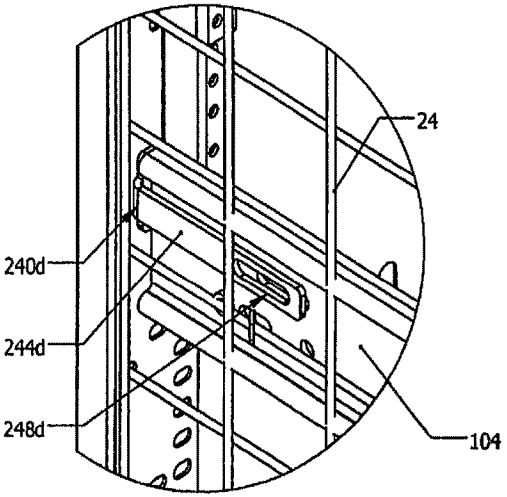
FIG. 19C illustrates another perspective of the lower crossbar of FIG. 19B after it is installed on the consumer product display, in accordance with an example embodiment.
Figure 19B:
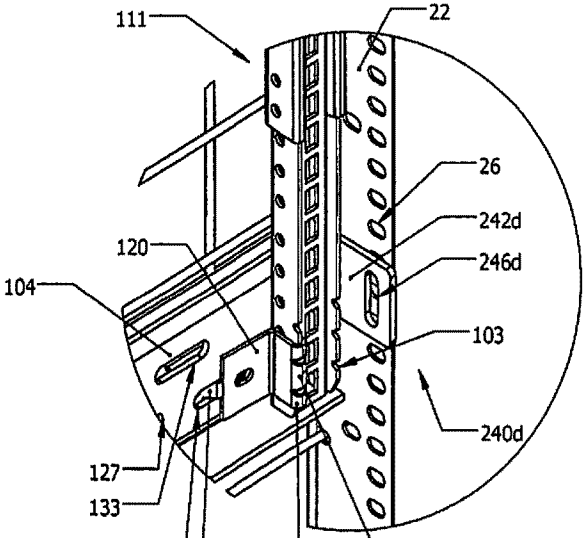
FIG. 19B illustrates a lower crossbar being installed on a consumer product display, in accordance with an example embodiment.

FIG. 19B illustrates a lower crossbar 104 being installed on the consumer product display 20, in accordance with an example embodiment. Similar to FIGS. 18B and 18C, a connector-plate 120 may be used to hold the lower portion of the vertical upright 111 to the crossbar 104, where tab 122 is seated in slot 129 and hinge 132 is fitted over the edge of the upright 111 such that a portion of the J-shaped hooks 124 is fitted into slots 103.

Also shown in FIG. 19B, the lower bracket 240*d* (FIG. 16C) may be used to stabilize the crossbar 104 on the column 22. Specifically, The side plate 242*d* of the lower bracket 240*d* may be pressed against column 22 so that bolts may be fitted through slot 246*d* and bolt holes 26 to firmly affix the side plate 242*d* on the column 22.

FIG. 19C illustrates another perspective of the lower crossbar 104 of FIG. 19B after it is installed on the consumer product display 20, in accordance with an example embodiment. Notice that the horizontal blade 244*d* of the lower bracket 240*d* may be pressed against a rear surface of the cross 104, so that bolts may be fitted through slot 248*d*, and slot 130 of the crossbar 104, in order to firmly affix the lower bracket 240*d* onto the rear of the crossbar 104.

Figure 19D:
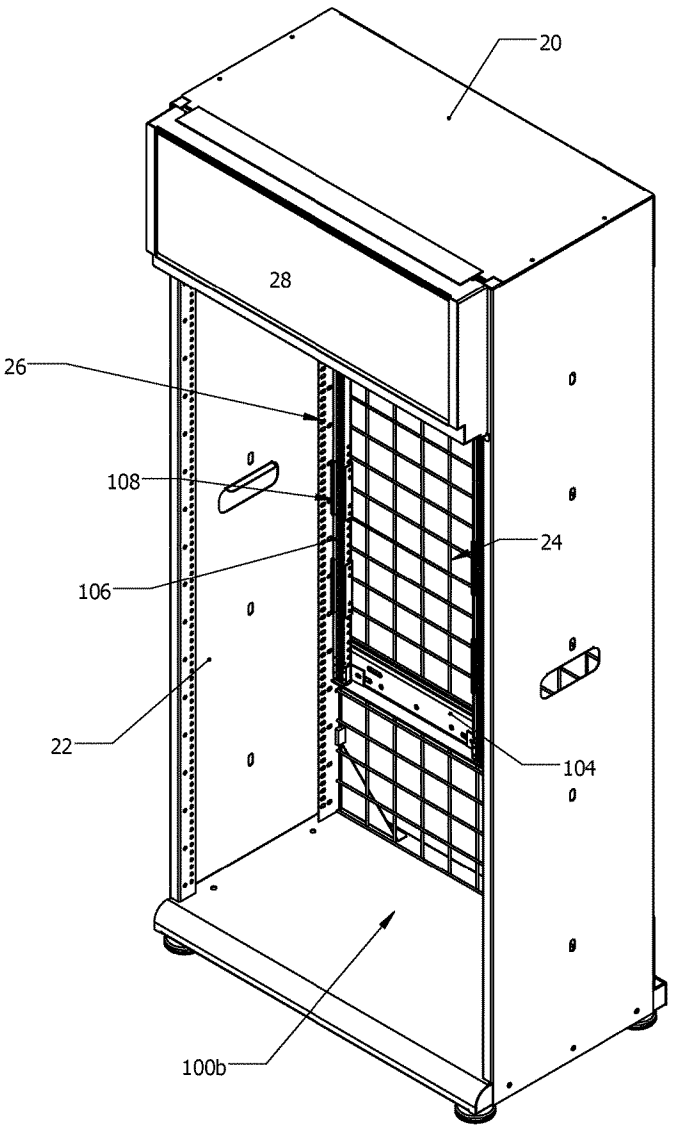
FIG. 19D illustrates a mounting system installed on a consumer product display, in accordance with an example embodiment.

FIG. 19D illustrates the mounting system 100*b* installed on a consumer product display 20, in accordance with an example embodiment. By virtue of the upper crossbar 102 being connected to the column 22 (shown in better detail in FIG. 19A), and the lower crossbar 104 also being connected to the column 22 (shown in better detail in FIG. 19B/C), the mounting system 100*b* in capable of distributing a weight-load onto the existing columns 22 of the display 20.

Figure 20B:
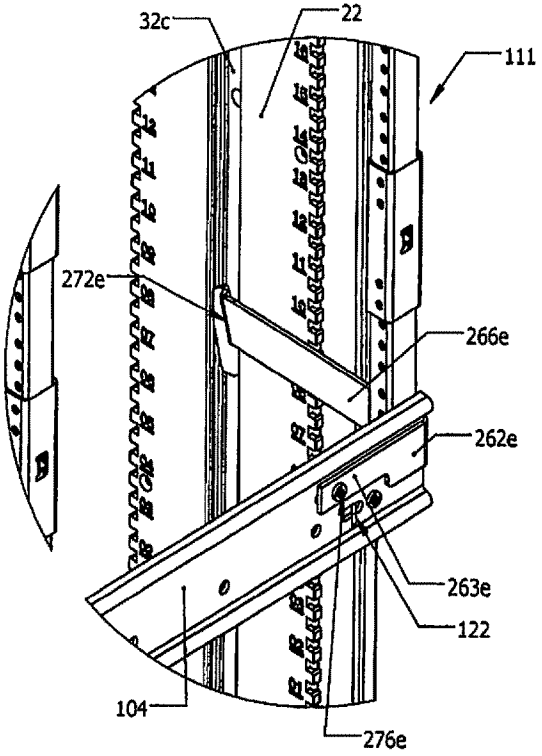
FIG. 20B illustrates a lower crossbar being installed on a consumer product display, in accordance with an example embodiment.
Figure 20A:
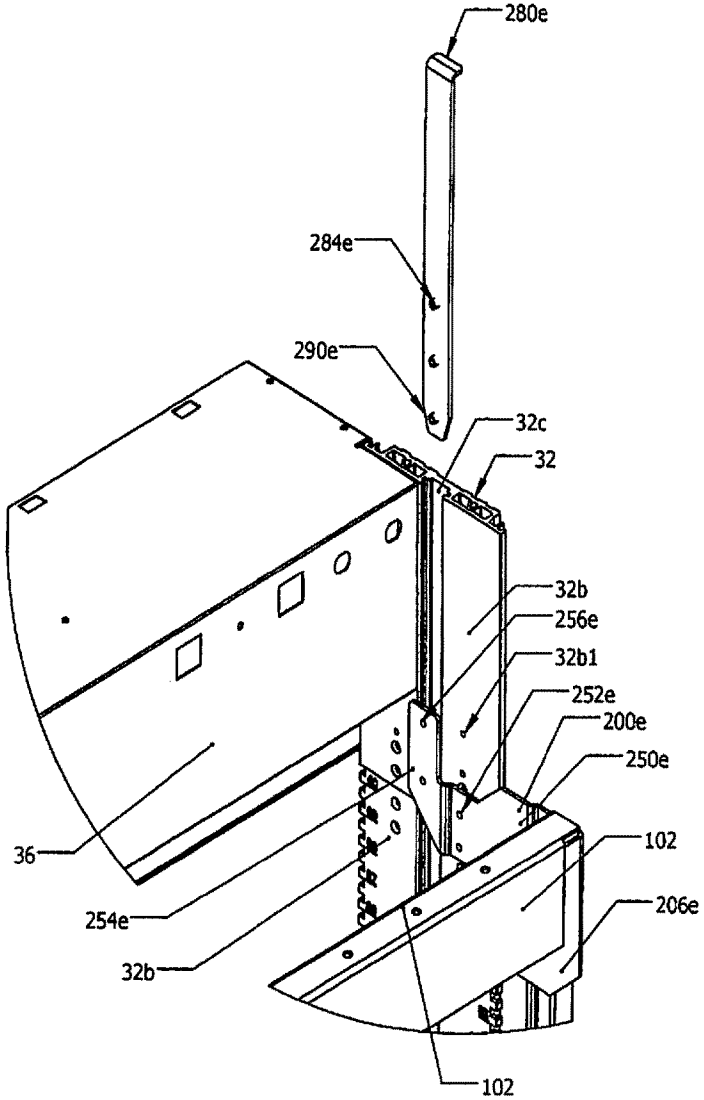
FIG. 20A illustrates an upper crossbar being installed on a consumer product display using a support bracket, in accordance with an example embodiment.

FIG. 20A illustrates an upper crossbar 102 being installed on a consumer product display 30 using a support bracket 200*e* (see FIG. 17A), in accordance with an example embodiment. This support bracket 200*e* is intended to fit displays 30 where columns 32 of the display 30 face each other (see FIG. 20C), and where the column 32 includes a central track (groove) 32*c* running along at least a portion of a longitudinal length of the column 32. The intermediate plate 250*e* may be pressed against the inner major surface 32*a* of the column 32, allowing bolt holes 252*e* of the intermediate plate 250*e* to be aligned with bolt holes 32*b*1 on the column 32, so that the intermediate plate 250*e* may be bolted to the column 32. The upwardly-projecting distal plate 254*e* of the bracket 200*e* may then be fitted into the groove 32*c*. Upright support bracket 280*e* may be fitted, from the top of display 30, into the groove 32*c* so that the one or more stops 284*e* on the distal tapered end 290*e* of the upright support bracket 280*e* may be aligned with mounting holes 256*e* on the distal plate 254*e* in order to hang the upper crossbar 102 at a desired elevation within display 30.

FIG. 20B illustrates a lower crossbar 104 being installed on the consumer product display 30, in accordance with an example embodiment. Similar to FIGS. 18B, 18C and 19B, a connector plate 120 may be used to hold the lower portion of the upright 111 to the crossbar 104 (see tab 122 inserted into slot 129). The horizontal blade 262*e* may be pressed against a rear surface of crossbar 104, and bolt hole 276*e* may be aligned with slot 133 in order to bolt the lower bracket 260*e* to the crossbar 104. The side blade 266*e* of the lower bracket 260*e* may be pressed against a side of column 22, allowing the toe 274*e* of the lower bracket 260*e* to fit into groove 32*c* to provide added horizontal support for the lower portion of the mounting system 100*b*.

Figure 20C:
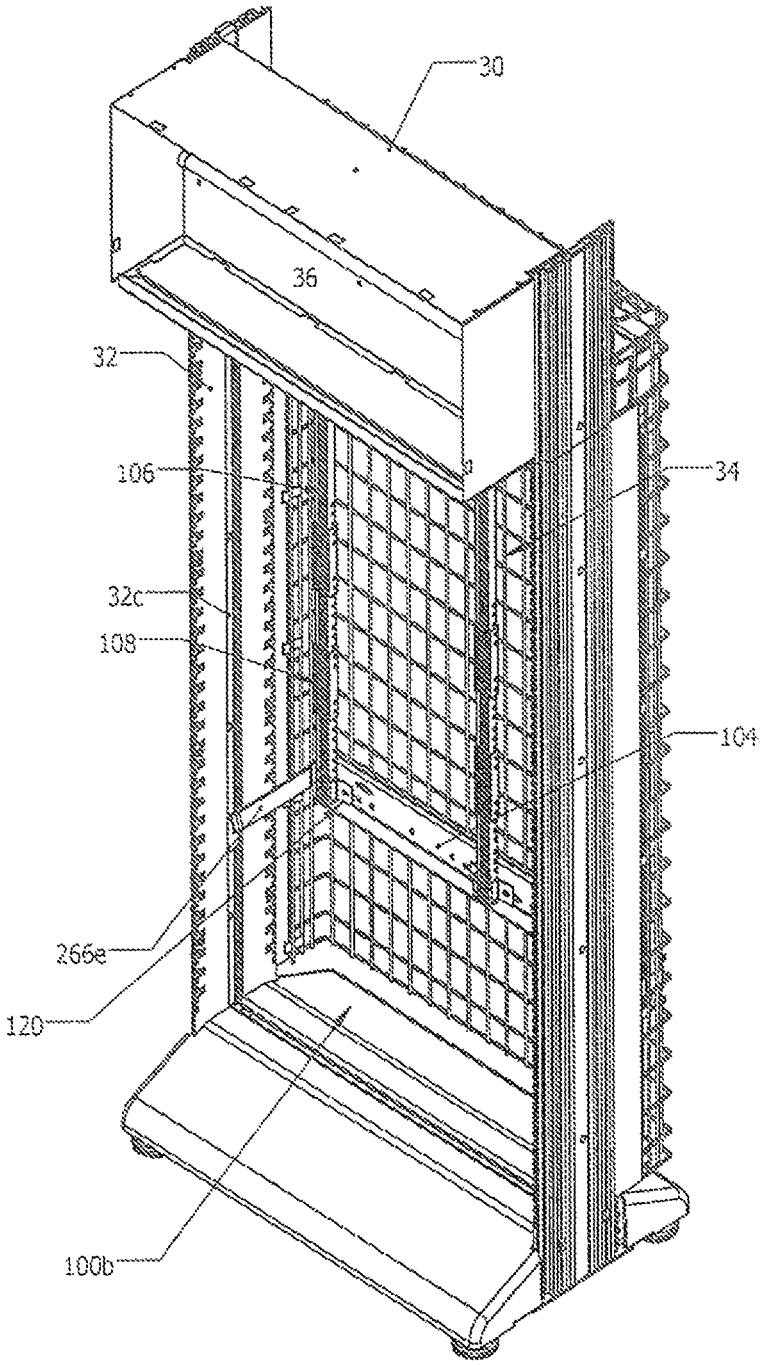
FIG. 20C illustrates a mounting system installed on a consumer product display, in accordance with an example embodiment.

FIG. 20C illustrates the mounting system 100*b* installed on the consumer product display 30, in accordance with an example embodiment. By virtue of the upper crossbar 102 being connected to the column 32 (shown in better detail in FIG. 20A), and the lower crossbar being connected to the column 32 (shown in better detail in FIG. 20B), the mounting system 100*b* may distribute a weight-load to the existing columns 32 of the display 30 while in use.

Figure 21B:
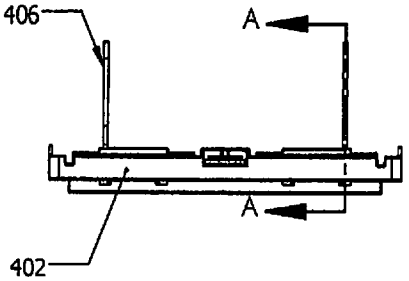
FIG. 21B illustrates a front view of the shelf of FIG. 21A, in accordance with an example embodiment.
Figure 21D:
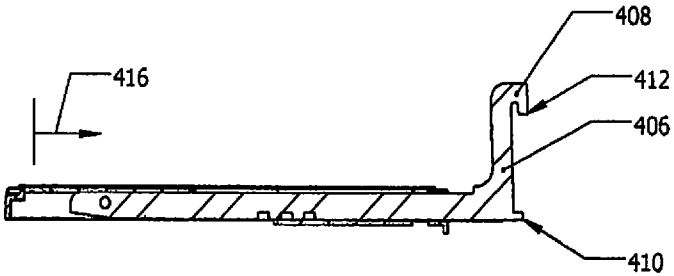
FIG. 21D illustrates a cross-sectional view of the shelf of FIG. 21B, in accordance with an example embodiment.
Figure 21A:
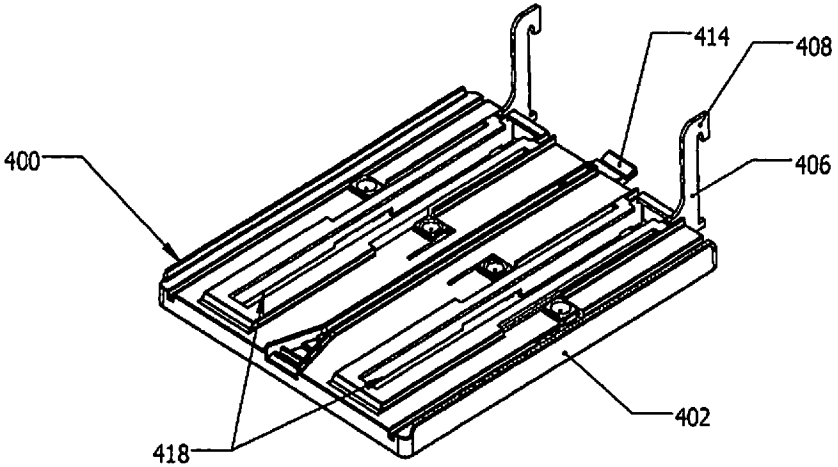
FIG. 21A illustrates a perspective view of a shelf of a mounting system, in accordance with an example embodiment.

FIG. 21A illustrates a perspective view of a shelf 400 of a mounting system 100, in accordance with an example embodiment. The shelf 400 may include base 402 capable of supporting a pair of horizontally-adjustable tracks 418. A rear-side of the shelf 400 may include one or more vertically projecting brackets 406, with an upper hook 408 on the top of each bracket 406. An extension 414 (shown in better detail in FIG. 21I) may be positioned near a lower/rear location of the shelf 400.

Figure 21C:
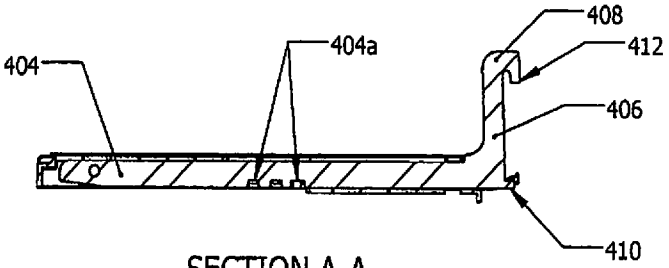
FIG. 21C illustrates a cross-sectional view of the shelf of FIG. 21B, in accordance with an example embodiment.

FIG. 21B illustrates a front view of the shelf 400 of FIG. 21A, in accordance with an example embodiment. FIGS. 21C and 21D (described below) are cross-sectional views of FIG. 21B that are taken from perspective A-A.

FIG. 21C illustrates a cross-sectional view of the shelf 400 of FIG. 21B, in accordance with an example embodiment. The bracket 406 may be positioned on an end of a protractable blade 404, where the protractable blade 404 may be capable of extending and retracting the bracket 406 from the base 402 of the shelf 400, in order to adjust a depth of the base 402 of the shelf 400 once the shelf 400 is mounted onto the mounting system 100 (as shown in FIG. 21M). Notches 404*a* on the blade 404 may mate with structure on the base 402 of the shelf 400 to lock the blade 404 into discrete positions. In the view of FIG. 21C, the blade 404 and bracket 406 are shown in a "retracted" configuration (where the bracket 406 is at a closest position to base 402, and therefore an effective depth of the shelf 400 is relatively shallow).

FIG. 21D illustrates a cross-sectional view of the shelf 400 of FIG. 21B, in accordance with an example embodiment. In this "extended" configuration, the blade 404 and bracket 406 is extended (in the bracket 406 movement direction 416) from the base 402 of the shelf 400, making the effective depth of the shelf 400 relatively deep (as compared to FIG. 21C).

Figure 21E:
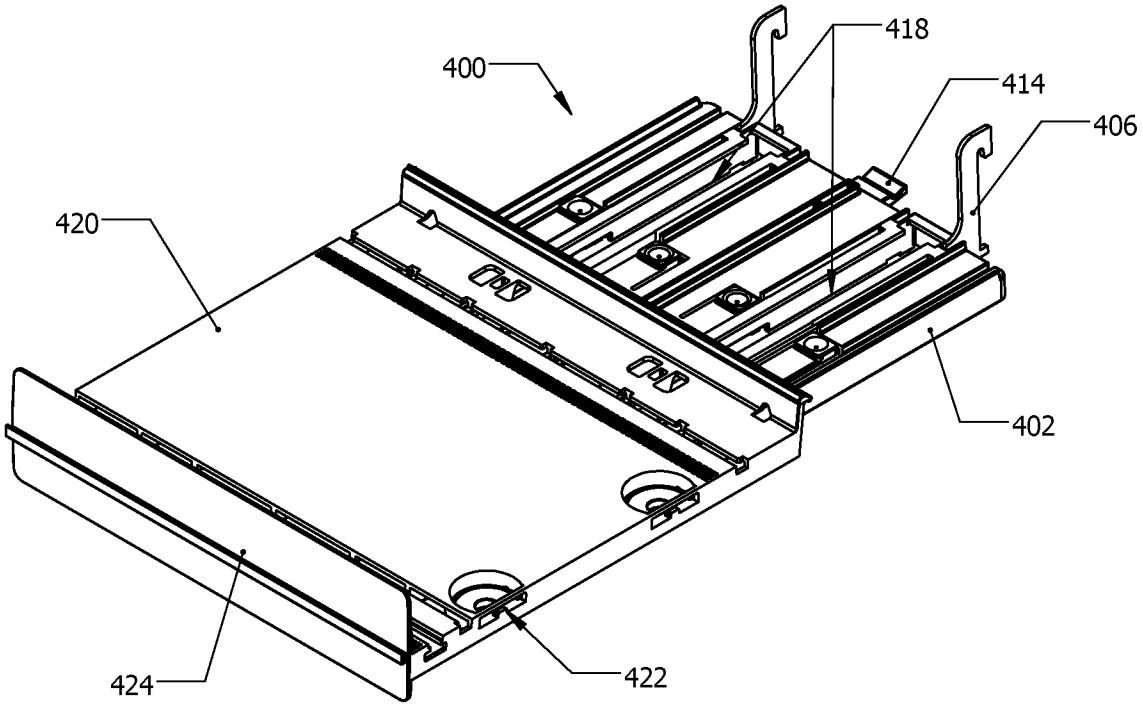
FIG. 21E illustrates a tray being connected to a top portion of the shelf of FIG. 21A, in accordance with an example embodiment.

FIG. 21E illustrates a tray 420 being connected to a top portion of the shelf 404 of FIG. 21A, in accordance with an example embodiment. The tray 420 may include a front lip 424 capable of keeping consumer products on the tray 420. The tray 420 may also include a locking mechanism 422 capable of locking the tray 420 to other trays positioned on a side of the tray 420 (as shown in FIGS. 21G and 21J).

It should be noted that the horizontally adjustable tracks 418 may each move horizontally, along an upper surface of the base 402 of the shelf 402, in order to adjust to a variable-width of different trays 420 that may be supported by the shelf 400.

Figure 21F:
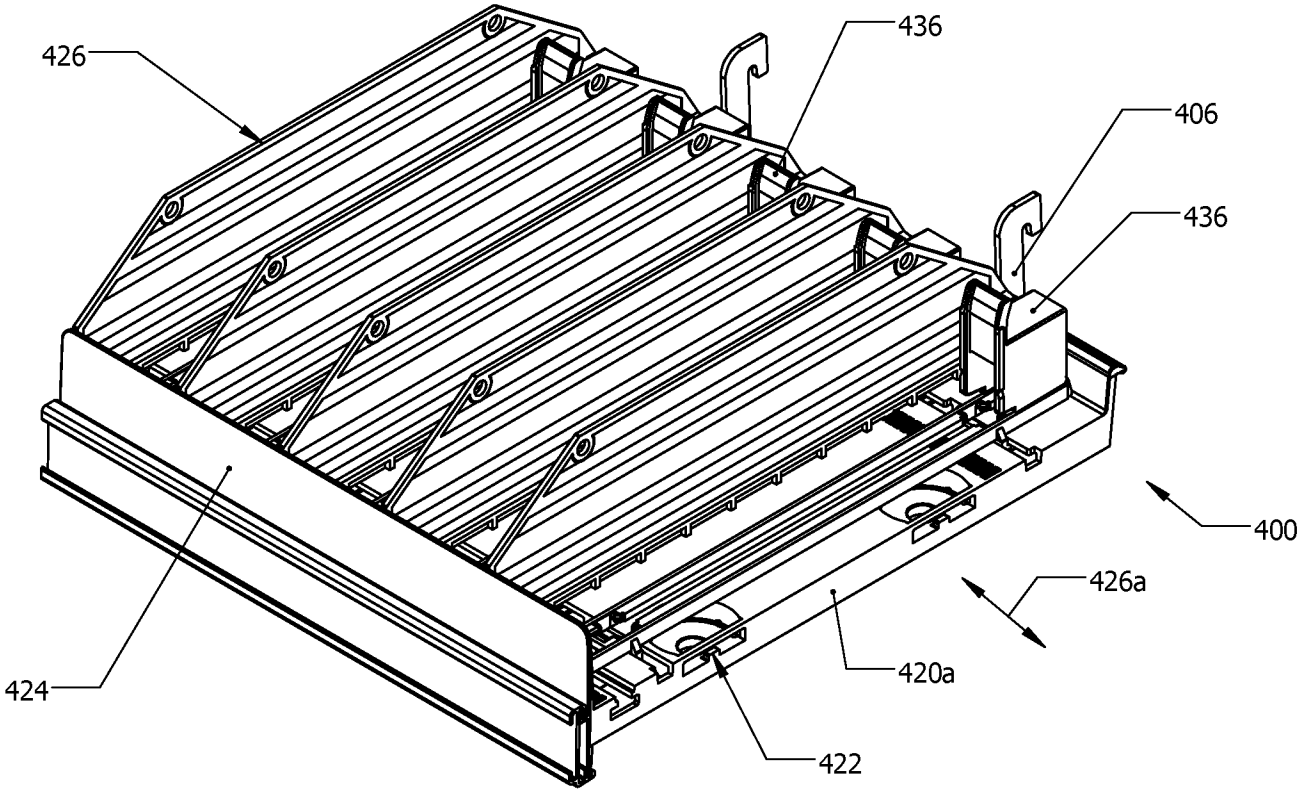
FIG. 21F illustrates another tray being connected to a shelf of a mounting system, in accordance with an example embodiment.

FIG. 21F illustrates another tray 420*a* with product dividers 426 being connected to a shelf 400 of a mounting system, in accordance with an example embodiment. A number of dividers 426, and a width between the dividers 426, may vary. The tray 420*a* may also include spring-loaded backstops 436 that may be capable of pushing consumer products that may be placed in the spaces between the dividers 426, for purposes of convenient vending.

Figure 21G:
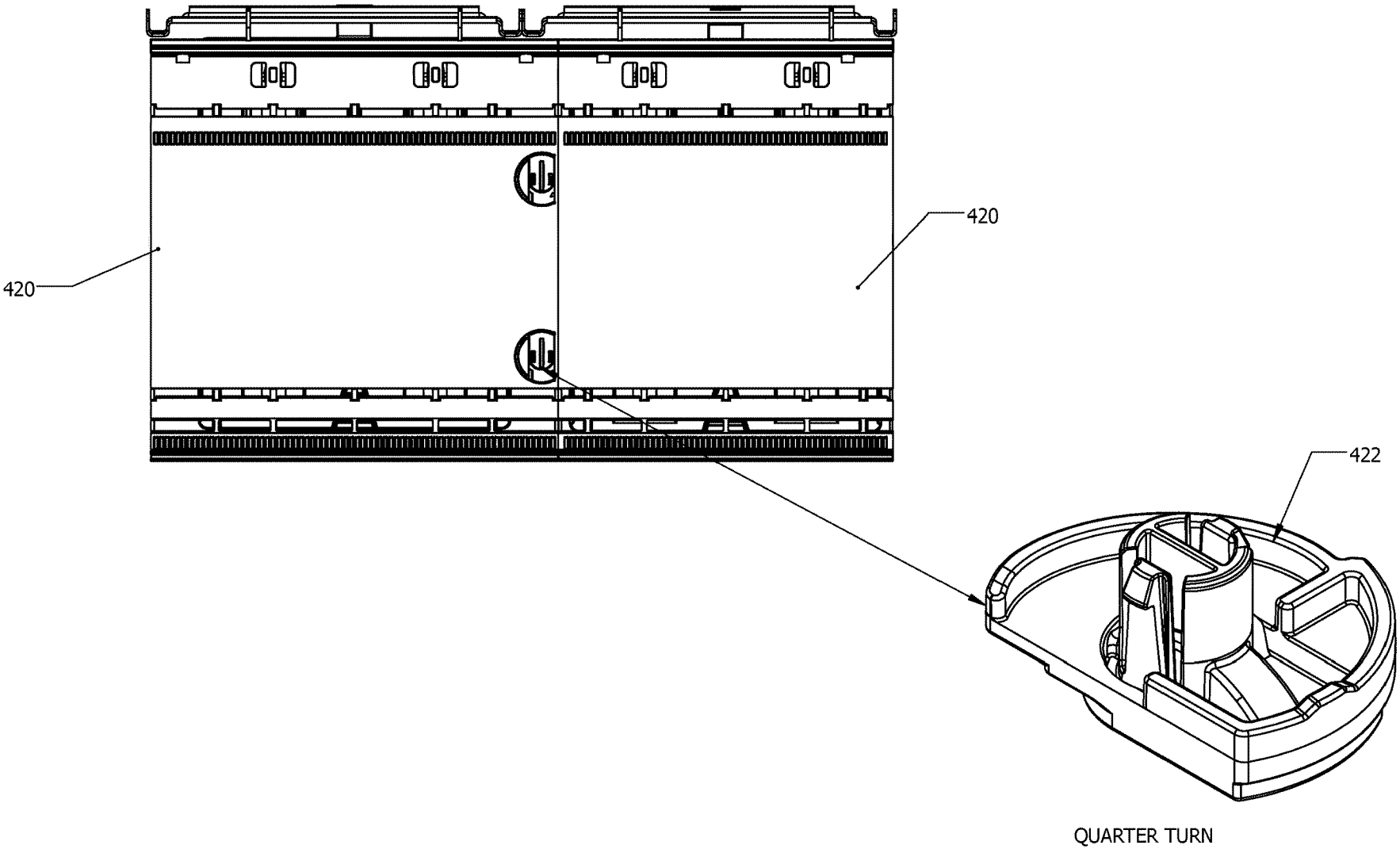
FIG. 21G illustrates two shelves being connected to each other, in accordance with an example embodiment.

FIG. 21G illustrates two shelves 420 being connected to each other via the locking mechanism 422, in accordance with an example embodiment. The locking mechanism 422 may lock the trays 420 together via a quarter-turn of the locking mechanism 422.

Figure 21I:
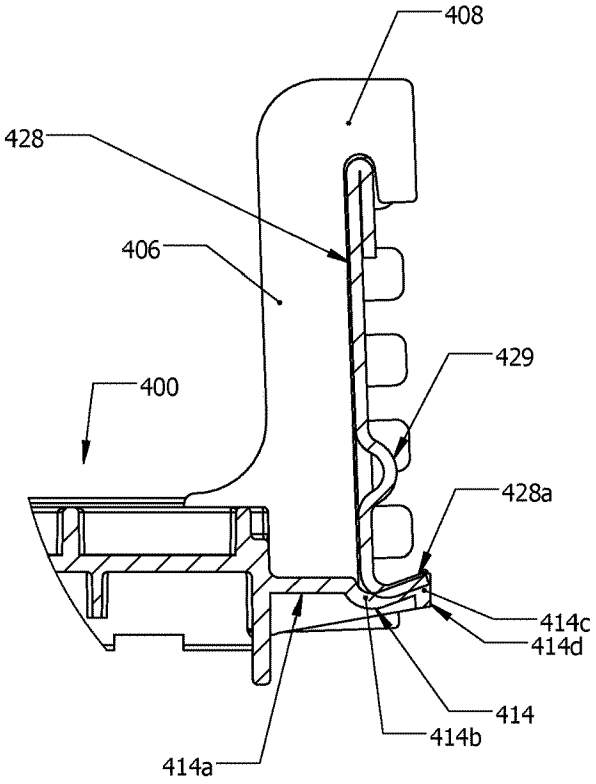
FIG. 21I illustrates a cross-sectional view of a back portion of the shelf of FIG. 21H being connected to the baseplate, in accordance with an example embodiment.
Figure 21H:
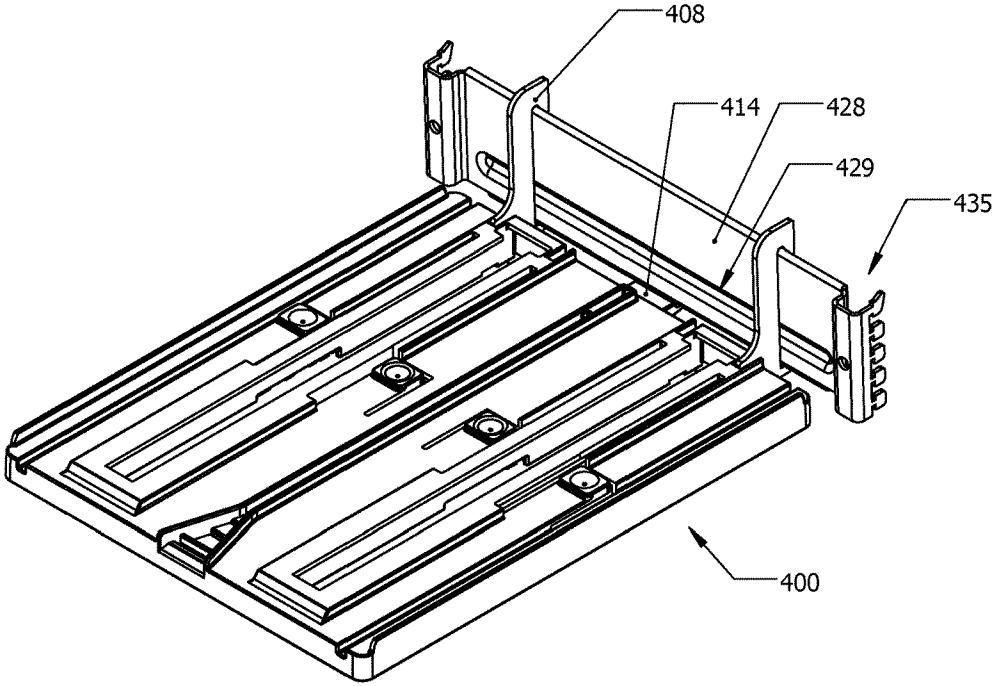
FIG. 21H illustrates a shelf connected to a baseplate of a mounting system, in accordance with an example embodiment.
Figure 21J:
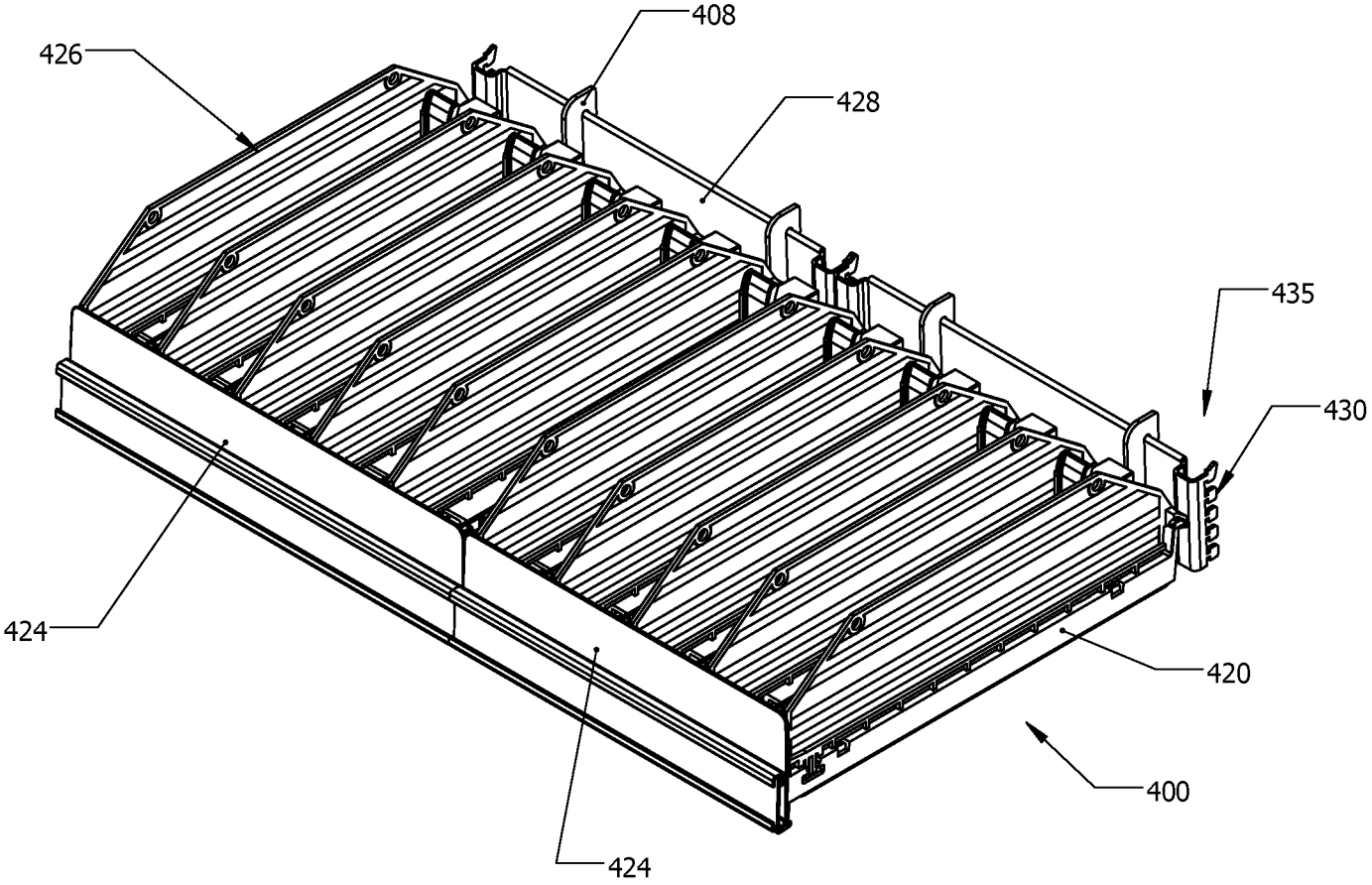
FIG. 21J illustrates two shelves, connected to each other, and connected to a baseplate of a mounting system, in accordance with an example embodiment.

FIG. 21H illustrates a shelf 400 connected to a baseplate 428 of a mounting system 100, in accordance with an example embodiment. The baseplate 428 may help connect the shelf 400, or a group of shelves 400, to the mounting system using an engaging structure 435 extending from a rear position of the baseplate 428. A portion of a surface of the baseplate 428, such as a lower portion of the baseplate 428, may include a gusset 429 (indention) that may add strength to the baseplate 428, due to a potentially significant weight-load that the shelf 400 and baseplate 428 may carry once the shelving of the mounting system 100 is fully loaded with consumer products (see FIG. 21I for a better view of the gusset 429).

FIG. 21I illustrates a cross-sectional view of a back portion of the shelf 400 of FIG. 21H being connected to the baseplate 428, in accordance with an example embodiment.

As shown in this view, the upper hook 408 of the bracket 406 may first fit over an upper end of the baseplate 428, and then the extension 414 may clip onto a lower surface 428*a* of the baseplate 428. In particular, the lower surface 428*a* of the baseplate 428 may be curved, in an upward direction, and the extension 414 may be conformed to this lower surface 428*a* of the baseplate 428. In an embodiment, the extension may include a straight horizontal-piece, a downward-curved piece 424*b*, an upward-sloped piece, and a vertically-projected piece that may collectively form the extension 414.

FIG. 21J illustrates two shelves 400, connected to each other, and connected to a pair of baseplates 428 of a mounting system 100, in accordance with an example embodiment. Due to the ability of the locking mechanism 422 (FIG. 21G) to lock the shelves 400 together, the shelves 400 and associated baseplates 428 may be connected to the mounting system 100 in sections, for quicker and more convenient installation of the shelving 400.

Figure 21K:
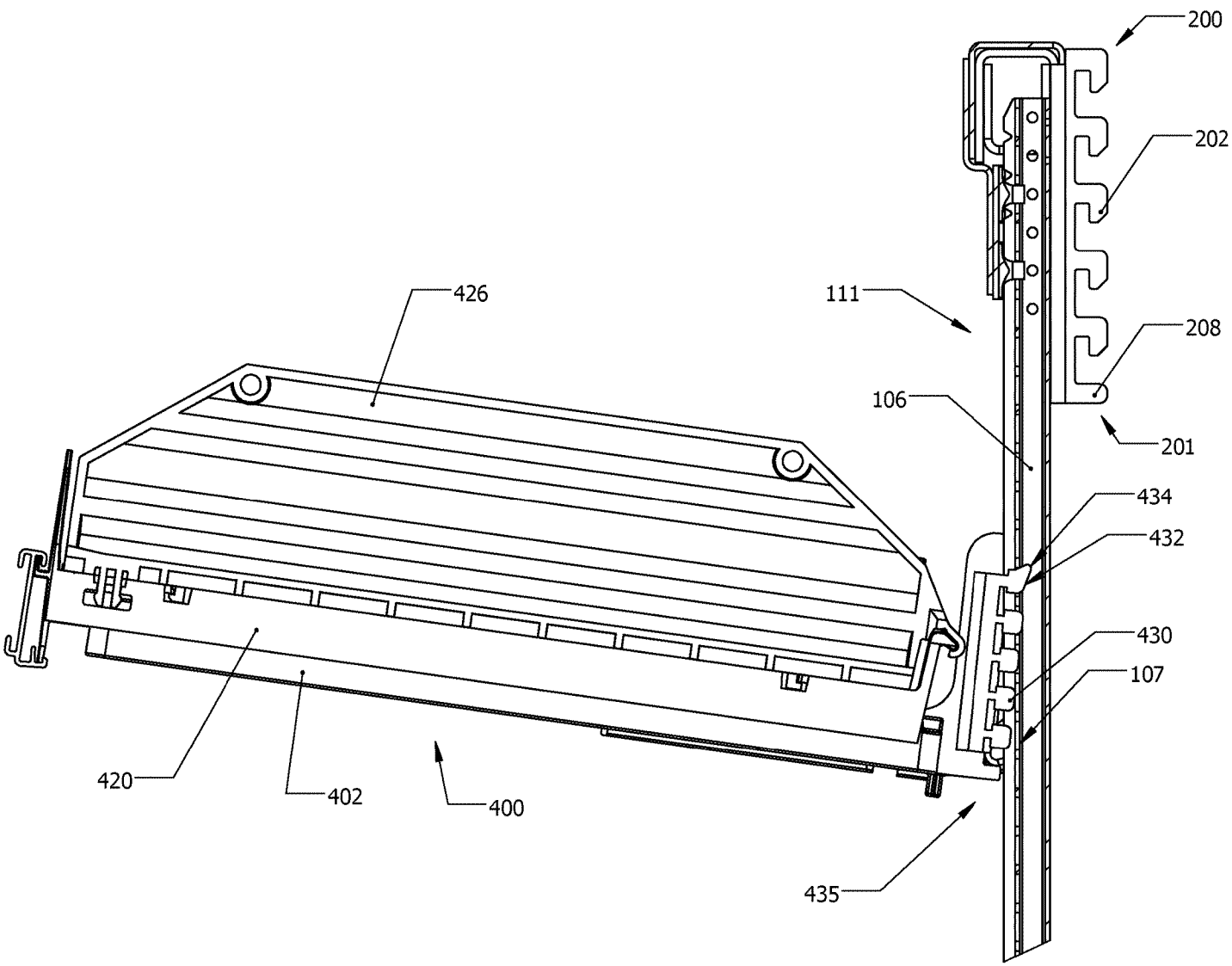
FIG. 21K illustrates a cross-sectional view of a shelf and tray being connected to a mounting system using a baseplate, in accordance with an example embodiment.

FIG. 21K illustrates a cross-sectional view of a shelf 400 and tray 420 being connected to a mounting system 100 using a baseplate 428, in accordance with an example embodiment. Specifically, the engaging structure 435 of the baseplate 428 may be used to mate with vertical slots 107 of a vertical upright 111 of the mounting system 100.

In an embodiment, the engaging structure 435 of the baseplate 428 may include a series of teeth 430, where a profile of the teeth 430 may have a mushroom-shape. A top-most tooth 432 of the engaging structure 435 may also have a mushroom-shaped profile, though a top corner of the top-most tooth 432 may include a vertically-extending triangular-shaped extension 434. This shape of the top-most tooth 434 may not only help guide the top of the engaging structure 435 into a slot 107 of the upright 111 (as the top-most tooth 432 may be the initial tooth of the engaging structure 435 that is set into one of the vertical slots 107 of the upright), but the vertically-extending triangular-shaped extension 434 of the tooth 432 may also act to retain the top-tooth 432, and allow the top-tooth 432 to pivot as the other lower teeth 430 may be pressed into other slots 107 on the upright 111. The shape of the top-most tooth 432 may be particularly helpful in the event that shelf 400 is pre-loaded (and, therefore heavy) with consumer products.

Figure 21L:
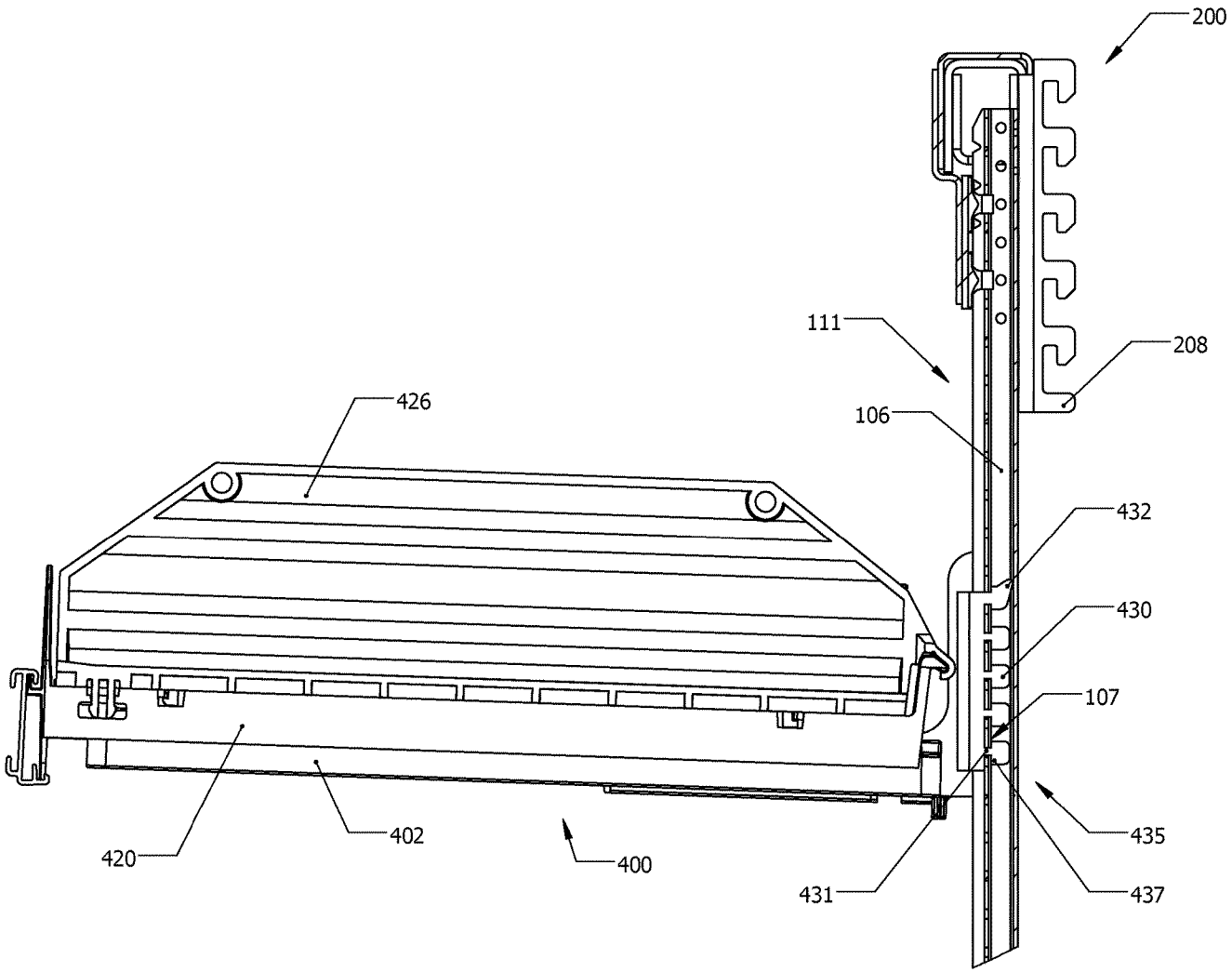
FIG. 21L illustrates a cross-sectional view of the shelf and tray of FIG. 21K that is connected to the mounting system using the baseplate, in accordance with an example embodiment.
Figure 21M:
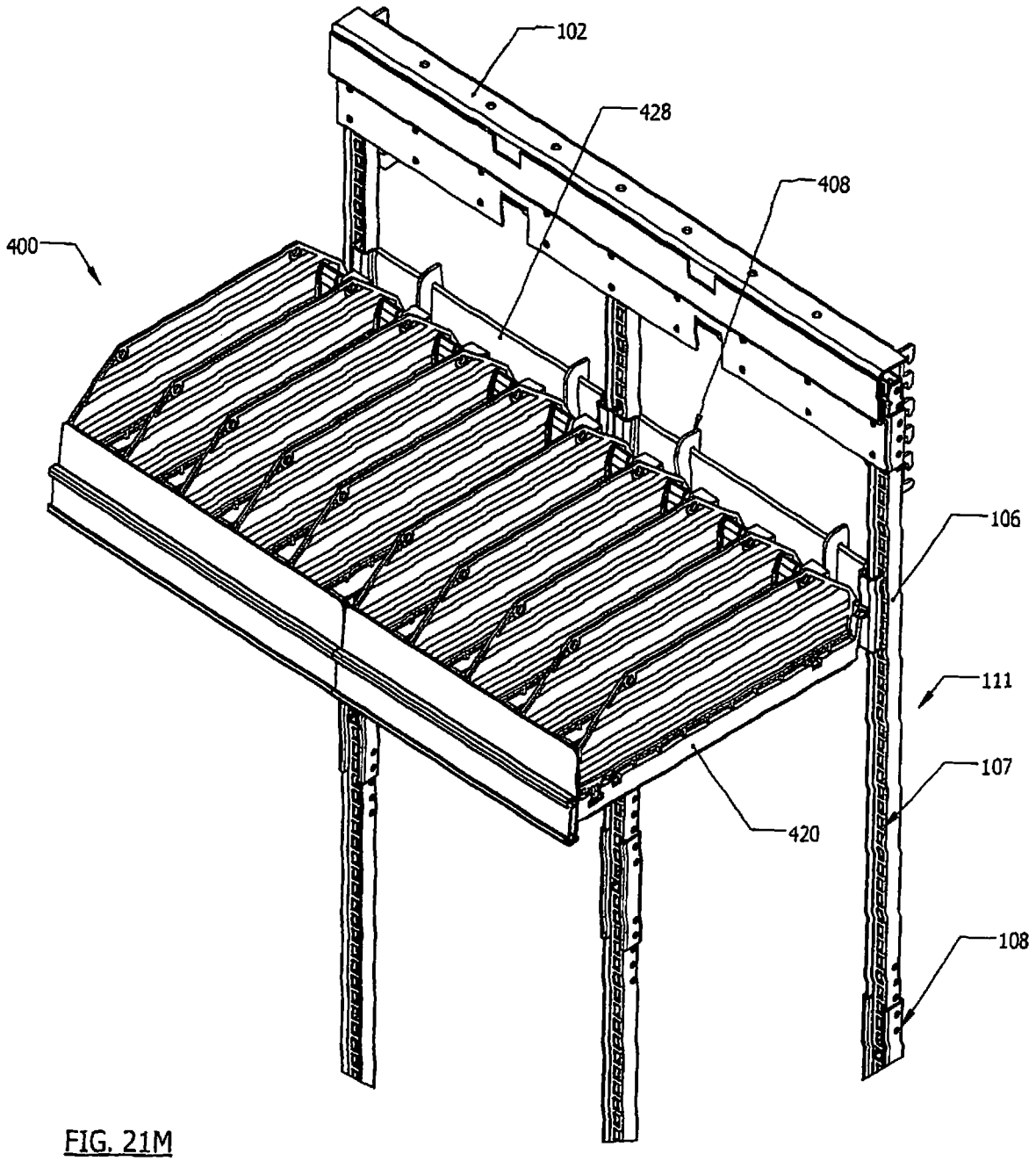
FIG. 21M a perspective view of the shelves of FIG. 21L that are connected to the mounting system using the baseplate, in accordance with an example embodiment.

FIG. 21L illustrates a cross-sectional view of the shelf 400 and tray 420 of FIG. 21K that is connected to the mounting system 100 using the baseplate 428, in accordance with an example embodiment. In this view, both the top-most tooth 432, and the other teeth 430 of the engaging structure 435, are retained in slots 107 of the vertical upright 111. Notice that, due to the mushroom-shaped profile of the teeth 430/432, a narrow stem 431 of the teeth 430/432 may rest on the bottom surfaces of the slots 107, while the wide-base 437 of the teeth 430/432 may securely hold the baseplate 428 on the upright 111.

FIG. 21M a perspective view of the shelves 400 of FIG. 21L that are connected to the mounting system 100 using the baseplate 428, in accordance with an example embodiment. In this view, the modularized-nature of the shelving 400 can be more easily understood, as multiple shelves 400 may be mounted in a convenient manner. Furthermore, due to the flexibility of the mounting system 100, a number of uprights 111 can be adjusted to variable-sized crossbars 102 to accommodate both a size of the consumer product display 10, as well as accommodating a width of various-sized shelves 400.

Figure 22:
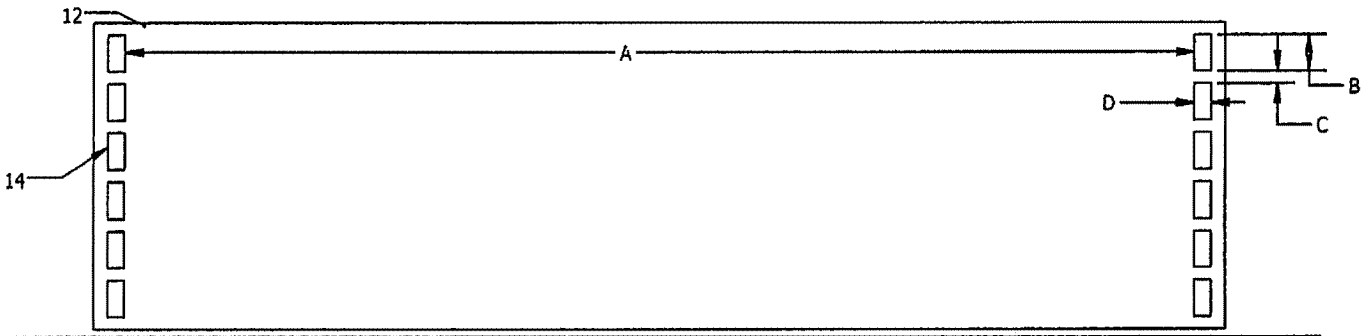

FIG. 22 illustrates dimensional information (listed in units of inches) for various conventional fixtures (backbones) of consumer product displays 10 that the mounting system 100 is capable of connecting to. It should be understood that this dimensional information is for displays 10 that have columns 12 with slots 14 that face a front of the display 10 (as shown for instance in FIG. 1). The left column in the table of FIG. 22 identifies example embodiment brackets (shown in FIGS. 12-17 and 23) that are capable of mating with the backbone fixtures (i.e., Fixture 1, Fixture 2, Fixture 3, etc.).

Figure 23B:
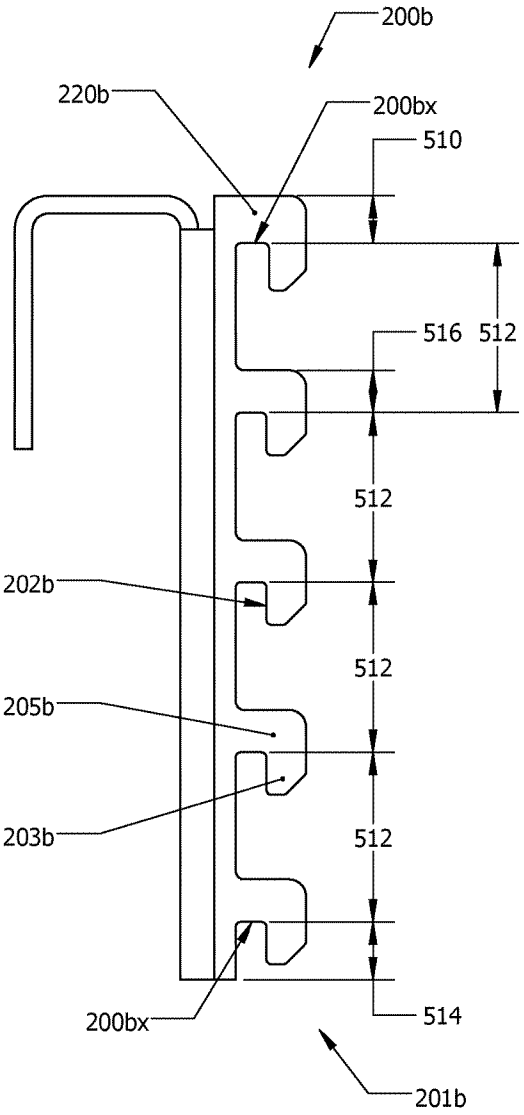
FIG. 23B illustrates a profile for another engaging structure for a support bracket, in accordance with an example embodiment.
Figure 23A:
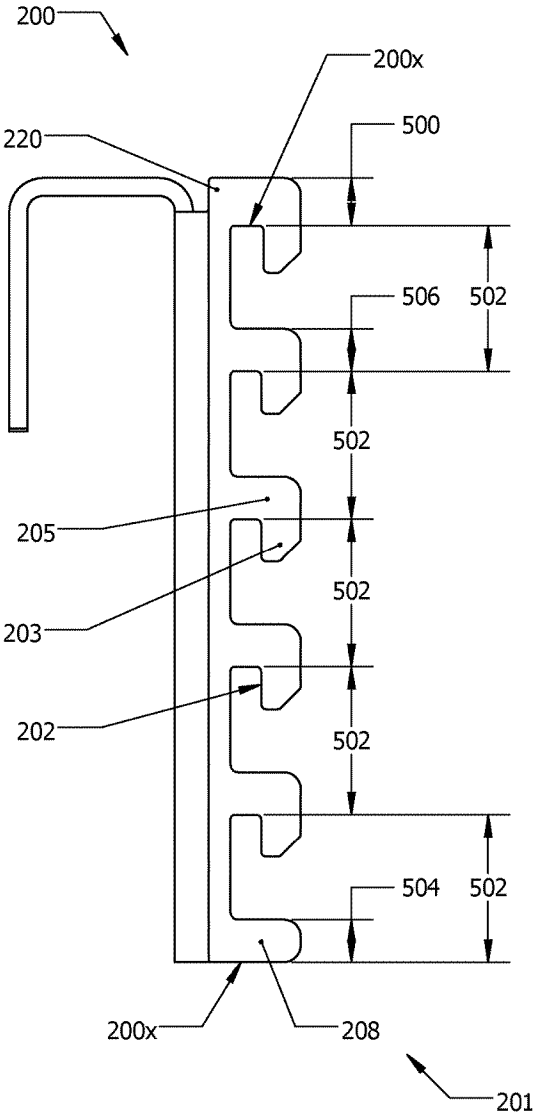
FIG. 23A illustrates a profile of an engaging structure for a support bracket, in accordance with an example embodiment.

FIG. 23A illustrates a profile of an engaging structure 201 for a support bracket 200, in accordance with an example embodiment. The engaging structure 201 may include five teeth 202 (referred to herein as "top teeth") and a horizontal projection 208, where spacing 502 between the teeth 202 and/or projection may be about equal. Specifically, the spacing 502 may be about 0.86 inches, where this spacing 502 may be a measure of a distance between "points-of-contact" 200*x* of the engaging structure 201. It should be understood that the "points-of-contact" 200*x* of the engaging structure 201 may correspond to the portions of the engaging structure 201 that will directly contact a bottom portion of the slots 14 of the column 12 of the display 10, once the support bracket 200 is installed on the column 12 and is at rest (for instance, a bottom surface of the horizontal projection 205 of the teeth 202, and a bottom surface of the projection 208, would be the "points-of-contact" 200*x* of the engaging structure 201).

Other example dimensional information for FIG. 23A includes a depth 500 of the top-most tooth that may be about 0.280 inches, a depth 506 of the remaining teeth 202 that may be about 0.25 inches, and a depth 504 of the horizontal projection 208 that may be about 0.25 inches. An overall height of the engaging structure 201, from a top of the top-most tooth 220 to a bottom surface of the horizontal projection 208, may be about 4.60 inches.

FIG. 23B illustrates a profile for another engaging structure 201*b* for a support bracket 200*b*, in accordance with an example embodiment. The engaging structure 201*b* may include five teeth 202 (referred to herein as "top teeth"), where spacing 512 between the teeth 202 and/or projection may be about equal. Specifically, the spacing 512 may be about 1.0 inches, where this spacing 512 may be a measure of a distance between the "points-of-contact" 200*bx* of the engaging structure 201*b*.

Other example dimensional information for FIG. 23B may include a depth 510 of the top-most tooth 220*b* that may be about 0.280 inches, a depth 516 of the remaining teeth 202*b* that may be about 0.25 inches, and a length 514 from the lowest point of contact to a bottom of the engaging structure 201*b* that may be about 0.34 inches. An overall height of the engaging structure 201*b* may be about 4.60 inches.

Figure 23D:
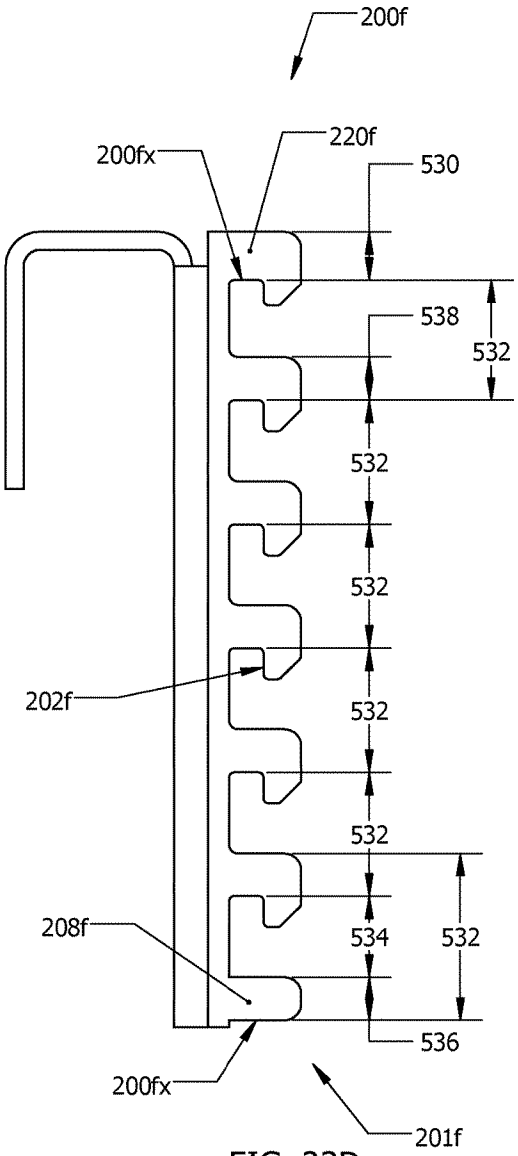
FIG. 23D illustrates a profile for another engaging structure for a support bracket, in accordance with an example embodiment.
Figure 23C:
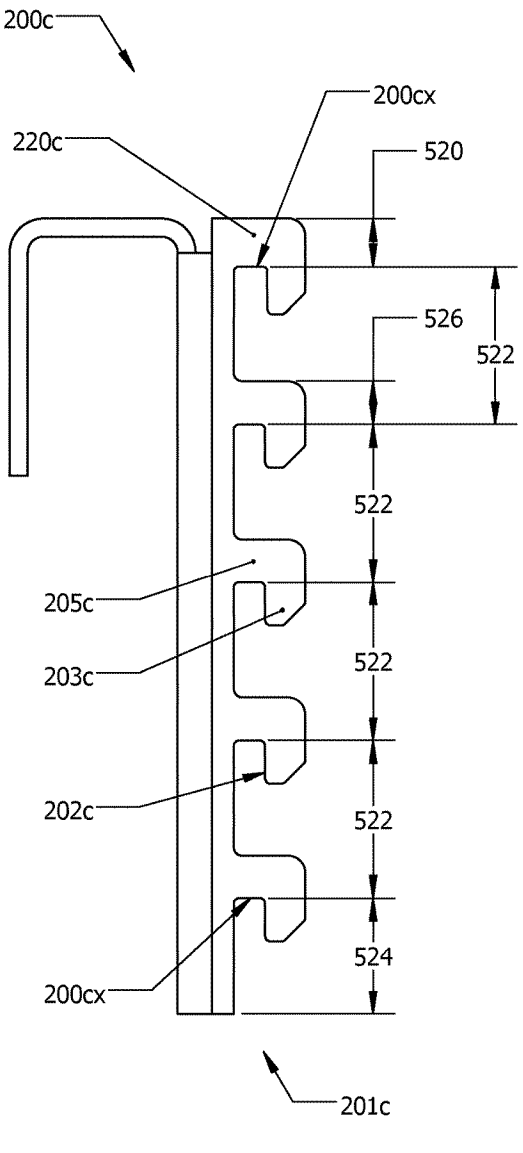
FIG. 23C illustrates a profile for another engaging structure for a support bracket, in accordance with an example embodiment.

FIG. 23C illustrates a profile for another engaging structure 201*c* for a support bracket 200*c*, in accordance with an example embodiment. The engaging structure 201*c* may include five teeth 202 (referred to herein as "top teeth"), where spacing 522 between the teeth 202*c* may be about equal. Specifically, the spacing 522 may be about 0.92 inches, where this spacing 522 may be a measure of a distance between the "points-of-contact" 200*cx* of the engaging structure 201*c*.

Other example dimensional information for FIG. 23C may include a depth 520 of the top-most tooth 220*c* that may be about 0.280 inches, a depth 526 of the remaining teeth 202*c* that may be about 0.25 inches, and a length 524 from the lowest point of contact 200*cx* to a bottom of the engaging structure 201*c* that may be about 0.67 inches. An overall height of the engaging structure 201*c* may be about 4.60 inches.

FIG. 23D illustrates a profile for another engaging structure 201*f* for a support bracket 200*f*, in accordance with an example embodiment. The engaging structure 201*f* may include six teeth 202*f* (referred to herein as "top teeth"), and a horizontal projection 208*f* at a lowest end of the engaging structure 201*f*, where spacing 532 between the teeth 202*f* and/or projection 208*f* may be about equal. Specifically, the spacing 532 may be about 0.72 inches, where this spacing 532 may be a measure of a distance between the "points-of-contact" 200*fx* of the engaging structure 201*c*.

Other example dimensional information for FIG. 23D may include a depth 530 of the top-most tooth 220*f* that may be about 0.280 inches, a depth 538 of the remaining teeth 202*f* that may be about 0.25 inches, and a depth 536 of the horizontal projection 208*f* may be about 0.25 inches. An overall height of the engaging structure 201*f* may be about 4.60 inches.

Figure 23E:
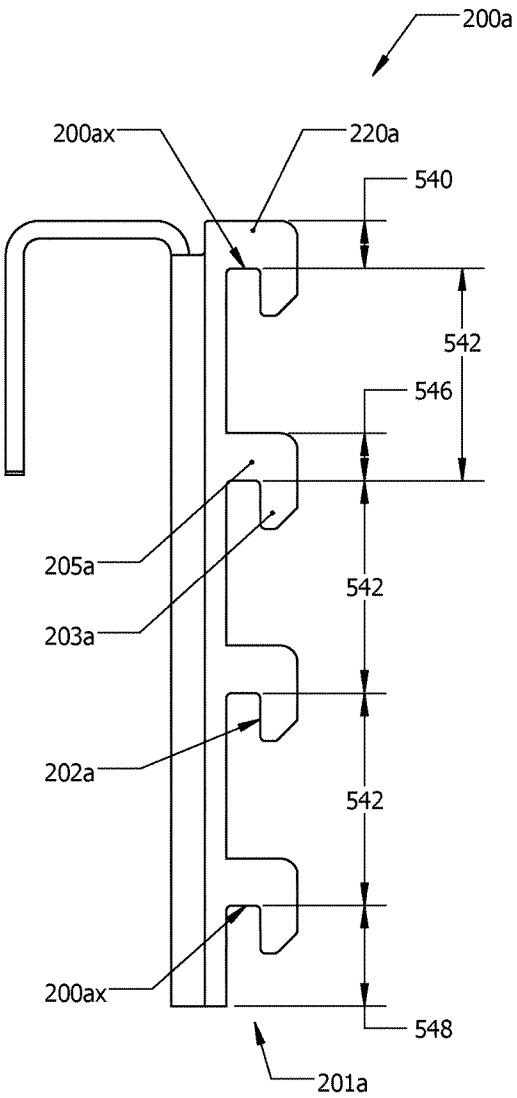
FIG. 23E illustrates a profile for another engaging structure for a support bracket, in accordance with an example embodiment.

FIG. 23E illustrates a profile for another engaging structure 201*a* for a support bracket 200*a*, in accordance with an example embodiment. The engaging structure 201*a* may include four teeth 202*a* (referred to herein as "top teeth"), where spacing 542 between the teeth 202*a* may be about equal. Specifically, the spacing 542 may be about 1.25 inches, where this spacing 542 may be a measure of a distance between the "points-of-contact" 200*ax* of the engaging structure 201*a*.

Other example dimensional information for FIG. 23E may include a depth 540 of the top-most tooth 220*a* that may be about 0.280 inches, a depth 546 of the remaining teeth 202*a* that may be about 0.28 inches, and a length 548 from the lowest point of contact 200*ax* to a bottom of the engaging structure 201*a* that may be about 0.59 inches. An overall height of the engaging structure 201*a* may be about 4.60 inches.

Major components of the mounting system 100 may be made from high strength low alloy (HSLA) columbium-vanadium steel, such as ASTM A1088 GR 50 sheet, in order to provide a high strength-to-weight ratio material with a relatively low manufacturing cost for these major components.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

What is claimed is:

1. A mounting system, comprising:

at least one first crossbar with a first end cavity and a second end cavity;

a first support bracket insertable into the first end cavity of the first crossbar, the first support bracket including a first engaging structure;

a second support bracket insertable into the second end cavity of the first crossbar, the second support bracket including a second engaging structure, the first engaging structure and the second engaging structure being configured to attach to a first column and a second column, respectively, of a consumer product display, the first support bracket and the second support bracket each being configured to remain freely and selectively slideable within the first end cavity and the second end cavity following assembly of the mounting system; and more than one vertical upright connectable to the at least one first crossbar, the more than one vertical upright including a third engaging structure, wherein the first support bracket and the second support bracket each include, a major body with a first surface and a second surface, a horizontal shaft extending substantially across an upper edge of the major body, as the horizontal shaft is oriented following the assembly of the mounting system, the horizontal shaft including at least an upper surface and a back surface, the upper surface extending substantially horizontally away from the first surface of the major body and the back surface extending substantially vertically away from the upper surface, the horizontal shaft being insertable into the respective first and second end cavities of the first crossbar, and the respective first and second engaging structures extending from the major body.

2. The mounting system of claim 1, further comprising:

at least one second crossbar, the at least one second crossbar connectable to the more than one vertical upright using a fourth engaging structure, wherein each of the more than one vertical upright includes a first end and a second end that is respectively connectable to the at least one first crossbar and the at least one second crossbar.

3. The mounting system of claim 1, wherein, the major bodies have a triangular shape, the first engaging structure and the second engaging structure each extend from the second surface of a respective one of the major bodies, the first surface and the second surface of each of the major bodies are opposing surfaces, and the first engaging structure has a first plurality of teeth and the second engaging structure has a second plurality of teeth, the first plurality of teeth having an identical configuration as compared to the second plurality of teeth.

4. The mounting system of claim 3, wherein each of the first and second plurality of teeth include, a series of top teeth, each of the series of top teeth having a vertical projection on a distal end of a horizontal projection.

5. The mounting system of claim 4, wherein a distance between points-of-contact of the first engaging structure and the second engaging structure are about equal, the distance being one of about 0.72 inches, 0.86 inches, 0.92 inches, 1.0 inches or 1.25 inches, and the points-of-contact of each of the first engaging structure and the second engaging structure are lower surfaces of the first engaging structure and the second engaging structure that would directly contact bottom surfaces of front slots of the respective first column and the second column of the consumer product display once the mounting system is connected to the consumer product display.

6. The mounting system of claim 5, wherein an upper corner of each of the series of top teeth is rounded, and an outer distal corner of each of the vertical projections is beveled.

7. The mounting system of claim 4, wherein each of the first plurality of teeth and the second plurality of teeth further include, a bottom-most tooth that is a horizontal protrusion, the bottom-most tooth being positioned below the series of top teeth, a distal end of the horizontal protrusion of the bottom-most tooth being rounded.

8. The mounting system of claim 1, wherein the major bodies of the first support bracket and the second support bracket are triangular in shape, and the first engaging structure and the second engaging structure each extend from the first surface of a respective one of the major bodies.

9. The mounting system of claim 8, wherein the first engaging structure and the second engaging structure of the first support bracket and the second support bracket each include a vertical plate, wherein the vertical plates each include one or more bolt holes, the vertical plates being about perpendicular to a longitudinal length of the horizontal shaft of a respective one of the major bodies.

10. The mounting system of claim 9, wherein the vertical plate of the first support bracket and the second support bracket each include two bolt holes, an outer surface of each of the vertical plates includes a mounting stub extending from a lower portion of the outer surface, the mounting stub facing away from the major body.

11. The mounting system of claim 9, wherein the vertical plate of each of the first support bracket and the second support bracket includes, a first proximal plate connected to the major body, a second intermediate plate connected to the first proximal plate and including two bolt holes, the second intermediate plate including a tapered distal end, a third distal plate connected to the tapered distal end of the second intermediate plate, the third distal plate including an upwardly projecting vertical extension, the first proximal plate, the second intermediate plate and the third distal plate being about parallel to each other, a first bend between the first proximal plate and the second intermediate plate, and a second bend between the second intermediate plate and the third distal plate, the first bend and the second bend each being inwardly-turning bends that respectively offset major surfaces of the second intermediate plate and the third distal plate relative to a major surface of the first proximal plate.

12. The mounting system of claim 2, wherein each of the more than one vertical upright includes, at least one first upright segment, at least one second upright segment, at least one coupling configured to connect the at least one first upright segment to the at least one second upright segment, the coupling defining an inner cavity capable of accepting ends of the at least one first upright segment and the at least one second upright segment, the coupling having a first wall and a second wall that are outwardly-flared away from a backwall of the coupling, the first wall and the second wall having distal ends that each form a J-shaped surface for retaining ends of the at least one first upright segment and the at least one second upright segment.

13. The mounting system of claim 12, further comprising:

one or more connector-plates for each of the more than one vertical upright, each of the connector-plates being used to connect a lower end of the more than one vertical upright to the at least one second crossbar, each of the connector-plates further including, a side plate connected along a side-edge of the connector-plate, the side plate projecting away from a front surface of the connector-plate and being about perpendicular to the connector-plate, a hinge positioned on a distal end of the side plate, a first J-shaped hook and a second J-shaped hook on either side of the hinge, the first J-shaped hook and the second J-shaped hook each project away from the connector-plate, an interior surface of the first J-shaped hook and the second J-shaped hook each being configured to insert into one of a series of notches defined by the lower end of the vertical upright, and an angled-tab projecting away, at an angle, from a rear surface of the connector-plate, the angled-tab having a major surface that is mushroom-shaped, the angled-tab being configured to insert into a respective slot running along a portion of a length of the at least one second crossbar.

14. The mounting system of claim 2, further comprising:

modularized shelving configured to connect to the more than one vertical uprights, the shelving including, at least one baseplate connectable to the more than one vertical upright, the at least one baseplate including, a fifth and a sixth engaging structure on ends of the baseplate and capable of inserting into vertical slots defined by a front surface of the more than one vertical upright, the vertical slots being the third engaging structure, the fifth and sixth engaging structures each including one or more teeth including a top-most tooth, each of the one or more teeth having a mushroom-shaped surface, the top-most tooth also including a vertically-extending triangular-shaped extension projecting from the mushroom-shaped surface of the top-most tooth, a gusset-indention defined along at least a portion of a longitudinal length of the baseplate, at least one shelf connectable to the at least one baseplate, the at least one shelf including, one or more protractable blades, each of the protractable blades including a vertical hook connectable to a top portion of the baseplate, the protractable blades configured to extend and retract the vertical hook from a first side of the at least one shelf, a rear bracket extending from a bottom portion of the first side of the at least one shelf, the rear bracket having an upper surface conformed to a bottom portion of the baseplate, more than one horizontally adjustable track on an upper surface of the shelf, one or more locking mechanisms on a side surface of the shelf, each locking mechanism capable of connecting the shelf to additional shelves, and at least one tray configured to be supported by the at least one shelf, the at least one tray including a seventh engaging structure on a bottom portion of the tray capable of connecting to the more than one horizontally adjustable track of the at least one shelf.

* * * * *